US007052310B2

(12) United States Patent
Matsunaga

(10) Patent No.: US 7,052,310 B2
(45) Date of Patent: May 30, 2006

(54) CONNECTOR

(75) Inventor: Hideki Matsunaga, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/037,987

(22) Filed: Jan. 18, 2005

(65) Prior Publication Data

US 2005/0159039 A1 Jul. 21, 2005

(30) Foreign Application Priority Data

Jan. 20, 2004 (JP) ..... 2004-011667
Jan. 22, 2004 (JP) ..... 2004-014481
Feb. 19, 2004 (JP) ..... 2004-042600

(51) Int. Cl.
*H01R 3/00* (2006.01)

(52) U.S. Cl. ..... 439/489; 439/352

(58) Field of Classification Search ..... 439/489, 439/352, 357, 350, 595
See application file for complete search history.

(56) References Cited

U.S. PATENT DOCUMENTS 6,234,827 B1 * 5/2001 Nishio et al. ..... 439/357
6,340,193 B1 1/2002 Sawayanagi
6,398,567 B1 * 6/2002 Nishimura ..... 439/159
6,688,907 B1 * 2/2004 Yamaoka et al. ..... 439/489

FOREIGN PATENT DOCUMENTS

JP 9-102353 4/1997
JP 9-139249 5/1997
JP 10-12316 1/1998
JP 10-41016 2/1998

* cited by examiner

*Primary Examiner*—Alexander Gilman
(74) *Attorney, Agent, or Firm*—Gerald E. Hespos; Anthony J. Casella

(57) ABSTRACT

Upon fitting a female housing (10) into a receptacle (44) of a male housing (40), metallic lock portions (42) are hidden behind receiving portions (12) when viewed from the front side of the receptacle (44) at an initial stage. When the lock portions (42) move over the receiving portions (12) while being resiliently deformed as this fitting operation progresses, the lock portions (42) are engaged with the receiving portions (12) and can be visually confirmed from the front side of the receptacle (44). Thus, the properly connected state of the two housings (10, 40) can be detected by visually confirming the lock portions (42) from the front side of the receptacle (44).

6 Claims, 53 Drawing Sheets

CONNECTOR

BACKGROUND OF THE INVENTION

1. Field of the Invention

The present invention relates to a connector.

2. Description of the Related Art

Japanese Unexamined Patent Publication No. 2002-216901 discloses a connector with male and female housing that are connectable with each other. The male housing is formed with a receptacle to surround male terminal fittings and a lock hole penetrates the upper wall of the receptacle. The female housing has a lock projection that is engageable with the lock hole. The receptacle is deformed resiliently outward in the process of connecting the two housings to permit insertion of the lock projection into the receptacle. The receptacle is restored resiliently to its initial position when the housings are connected properly connected. Thus, the lock projection engages in the lock hole to lock the two housings together.

Engagement of the lock projection in the lock hole can be confirmed visually when the lock hole is seen from above. Thus, proper connection of the housings can be detected. However, the connector may be installed in a small space or near other parts. Thus, an operator may not be able to see the lock hole from above and the connected state of the housings cannot be detected.

The above-described connection detection problems could be overcome if the locked state could be observed from the front of the receptacle, such as at the space provided before the receptacle for permitting entry of the female housing. However, the front surface of the receptacle is a connection surface with the female housing, and the prior art technology does not accommodate inspections from the front.

Japanese Unexamined Patent Publication No. 2003-173843 also discloses a connector with male and female housings connectable with each other. A wire cover is mountable on the male housing from behind and covers the rear end surface of the male housing. The wire cover enables wires connected with terminal fittings in the male housing to be drawn out along the rear end surface of the male housing and protects the wires from external matter. The wire cover is mounted on the male housing by engaging a locking section projecting from the front edge of the wire cover with an engageable section on the outer surface of the male housing.

The housings are connected by engaging a lock on the outer surface of the male housing with an engaging portion in a receptacle of the female housing. However, the engagement of the lock and the engaging portion is hidden in the receptacle and cannot be seen. Thus, it is not possible to judge precisely whether the housings are connected properly. The wire cover is exposed to the outside, and it would be desirable to use the wire cover for detecting the connected state of the housings. It would also be desirable to add a construction for clearly detecting the connected state of the housings.

The invention was developed in view of the above problem and an object thereof is to improve a detection of a proper connection.

SUMMARY OF THE INVENTION

The invention relates to a connector with first and second housings that are connectable with each other. The first housing has a forwardly open receptacle for receiving the second housing. At least one lock is formed on an inner surface of the receptacle, and at least one receiving portion is formed on an outer surface of the second housing for engaging the lock. The lock is hidden at least partly behind the receiving portion when viewed from the front of the receptacle at an initial stage of fitting the second housing into the receptacle. However, engagement of the lock and the receiving portion can be confirmed visually from the front of the receptacle when one of the lock and the receiving portion passes the other and resiliently deforms during and/or after the fitting operation. Accordingly, the operational efficiency is improved by allowing a connected state to be detected from the front of a receptacle.

The lock preferably is made of metal, and therefore has a metallic luster or shining for reliable visible confirmation. Visible confirmation can be enhanced by applying a glossy plating to the lock.

A fixing member preferably is mounted on an outer surface of the receptacle for mounting the first housing on a device such as a circuit board. Part of the fixing member can project through a wall of the receptacle to form the lock. The fixing member preferably is metallic. The formation of the lock on the fixing member reduces the number of parts. Additionally, the metallic fixing member can be fixed to the device efficiently by soldering.

The invention also relates to a connector, such as the above-described connector. The connector has first and second housings that are connectable with each other. Terminal fittings are connected with ends of wires and accommodated in the first housing. A wire cover at least partly covers a wire draw-out surface of the first housing and has at least one locking section. An engageable section is formed on the second housing for engaging the locking section when the two housings are connected properly. The locking section is distanced from the engageable section until the two housings reach a proper connection position. Accordingly, operational efficiency of the connector is improved by detecting a connected state of two housings using a wire cover.

The locking section is distanced from the engageable section until the two housings reach the proper connection position. However, the locking section can engage the engageable section when the housings reach the proper connection position, thereby permitting the wire cover to be mounted for closing the wire draw-out surface of the first housing. Thus, improper connection of the housings is known if the wire cover is not mountable. However, proper connection is known if the wire cover is mountable. In other words, the connected state of the housings can be detected merely by visually confirming whether the wire cover can be closed. A separate connection detecting member is not required, and the number of parts can be reduced.

The second housing preferably has an engaging portion and the first housing preferably has a lock arm for engaging the engaging portion. The engaging portion deforms lock arm resiliently towards a deformation space in the process of connecting the housings. The lock arm then restores resiliently to engage the engaging portion when the housings reach a proper connection position. At least one projection is formed on the wire cover and is disposed for entering the deformation space when the housings are properly connected. However, the lock arm is deformed and in the deformation space before the housings are connected properly. Thus, the lock arm prevents the projection from entering the deformation space before the two housings reach the proper connection position. The wire cover closes the wire draw-out surface as the projecting piece is inserted into the deformation space. Accordingly, operational efficiency of the connector is improved by using the wire cover to detect a connected state of two housings.

Thus, the two housings can be judged improperly connected when insertion of the projecting piece into the deformation space is impossible while they can be judged properly connected when insertion of the projecting piece into the deformation space is permitted. In other words, the connected state of the housings is detected merely by visually confirming whether the wire cover can be closed. The connection detection can be made by a simple construction of adding the projecting piece to a conventional wire cover. There are merits of easy production and handling. Additionally, there is no need for a separate connection detector, and the number of parts is reduced.

The wire cover preferably has a wire draw-out opening through which the respective wires are drawn out. Additionally, an inner surface of the wire cover preferably has a correcting surface for specifying a wire draw-out direction. The wire cover is displaceable between a partial locking position where the respective wires are drawn out in the specified direction along the correcting surface and a full locking position reached by pushing the wire cover at the partial locking position to at least partly close the wire draw-out surface. The wires can be aligned in the specified direction by leaving the wire cover at the partial locking position prior to connection of the two housings. Therefore, the connecting operation can be carried out smoothly, thus further improving operational efficiency of the connector.

The wire cover may be supported pivotably on the first housing at an end opposite from a wire draw-out opening through which the wires are drawn out. The wires are bent in the specified direction as the wire cover is pivoted. Thus, the wires are bent more easily than a case where the wire cover is a separate member mounted from behind. Further, if the pivotal movement of the wire cover is stopped before reaching the full locking position, the wire cover will be pushed back towards the partial locking position by the accumulated counteracting forces of the wires as the wires are bent. In this way, improper connection of the housings can be detected.

The wire cover may further comprise at least one resilient piece that starts touching the first housing before the housings are connected properly and accumulates a biasing force in returning direction for the wire cover as the housings move towards proper connection. The resilient restoring force of the resilient piece pushes the wire cover back if the connecting operating is stopped too soon. Thus, the wire cover is opened dynamically to indicate incomplete connection.

The wire cover also is opened to a large extent by the resilient restoring force of the resilient piece when the locking section and the engageable section are disengaged. Thus, there is a clear visual confirmation that the housings have been freed from the locked state.

The resilient piece preferably does not touch the first housing when the wire cover is partly locked to prevent deterioration of the resiliency.

The resilient piece preferably cantilevers from a front end edge of a side wall of the wire cover within the thickness range of the side wall. Thus, the resilient restoring force of the resilient piece is transmitted efficiently to the sidewall to quickly open the wire cover when the two housings are not properly connected. Further, since the resilient piece is within the thickness range of the sidewall, the wires can be accommodated into the wire cover while avoiding interference with the resilient piece. Furthermore, the thickness of the sidewall of the wire cover can be reduced for miniaturization.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Connectors according to preferred embodiments of the invention are described in detail in the following paragraphs. Even though the preferred embodiments refer to a pair of housings the invention also applies to connectors with more than two housings, such as connectors having several housings in a frame. The invention also refers to the single female or male housing constructed to cooperate with a mating housing. In the following description, ends of the two housings that connect with each other are referred to as the front. Additionally, the terms upper and lower are used herein as a convenient frame of reference, but are not intended to imply a required gravitational orientation.

Figure 1:
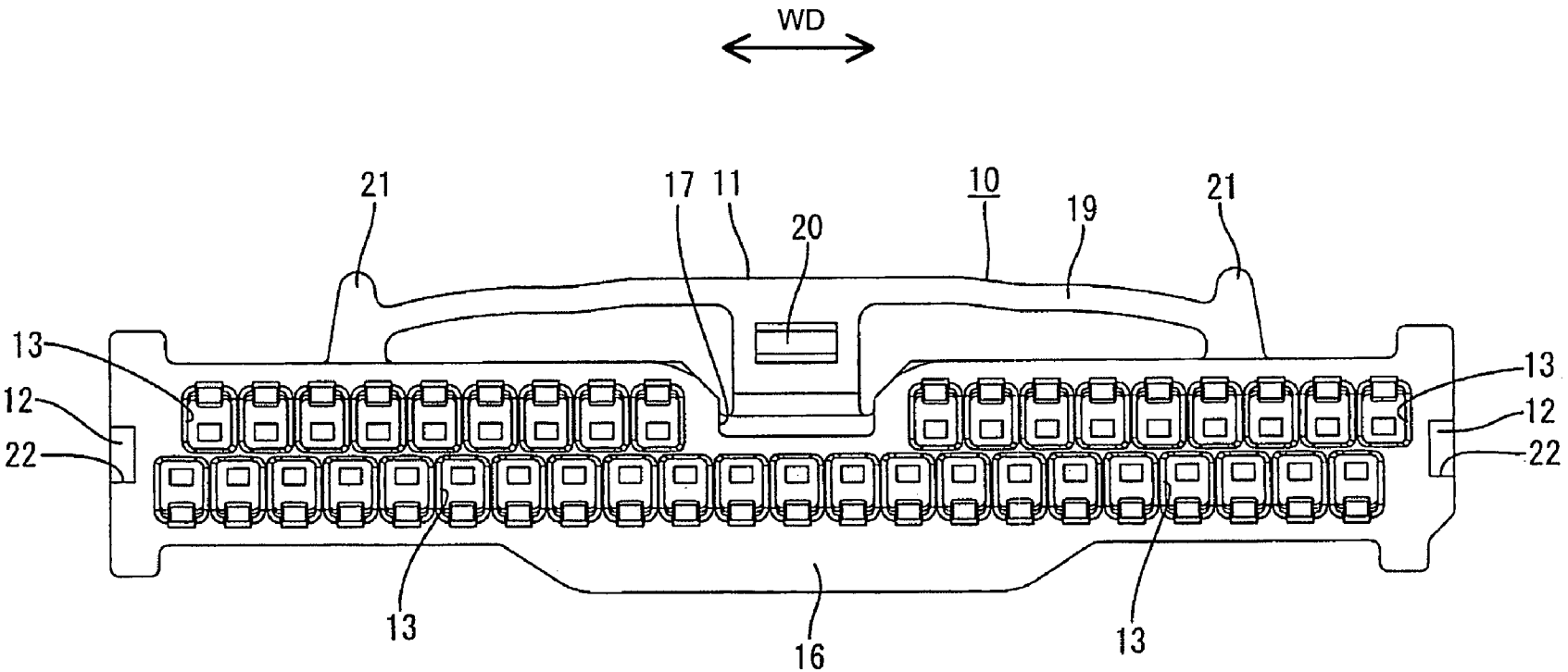
FIG. 1 is a rear view of a female housing of a first embodiment of the invention.
Figure 2:
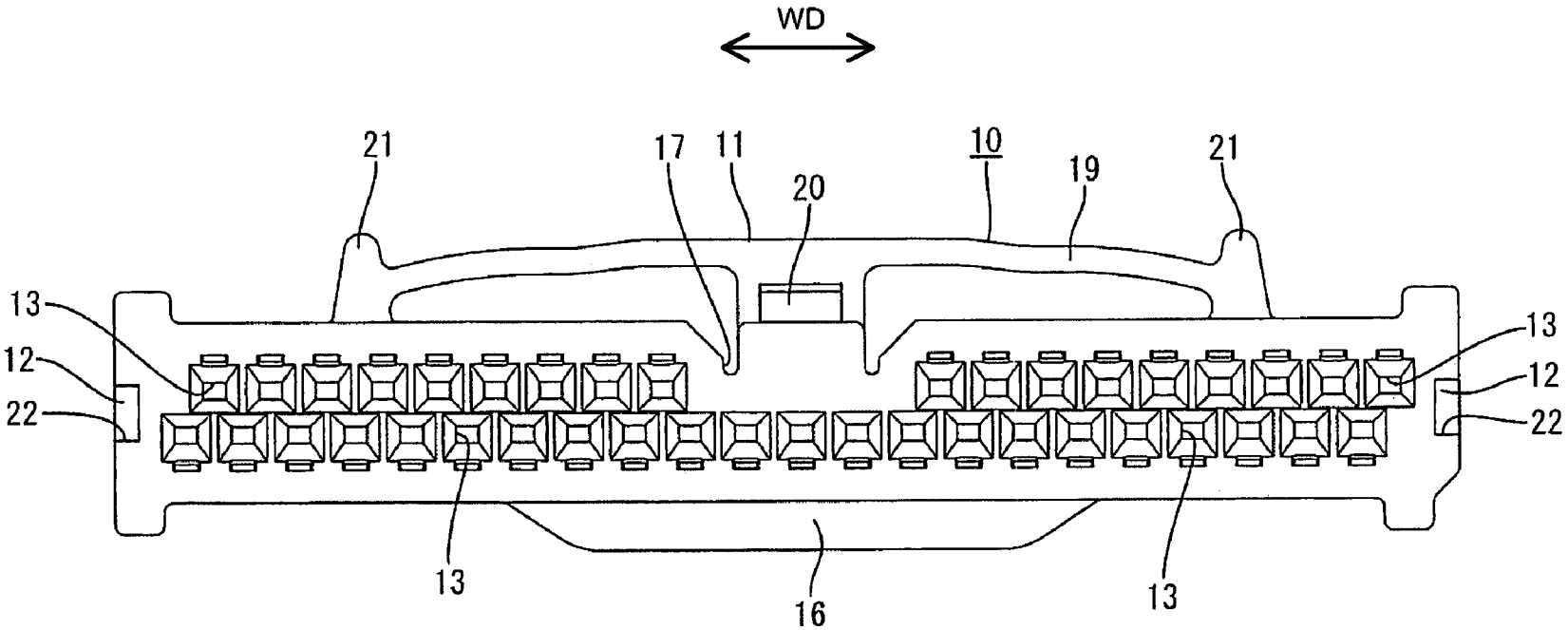
FIG. 2 is a front view of the female housing.
Figure 11:
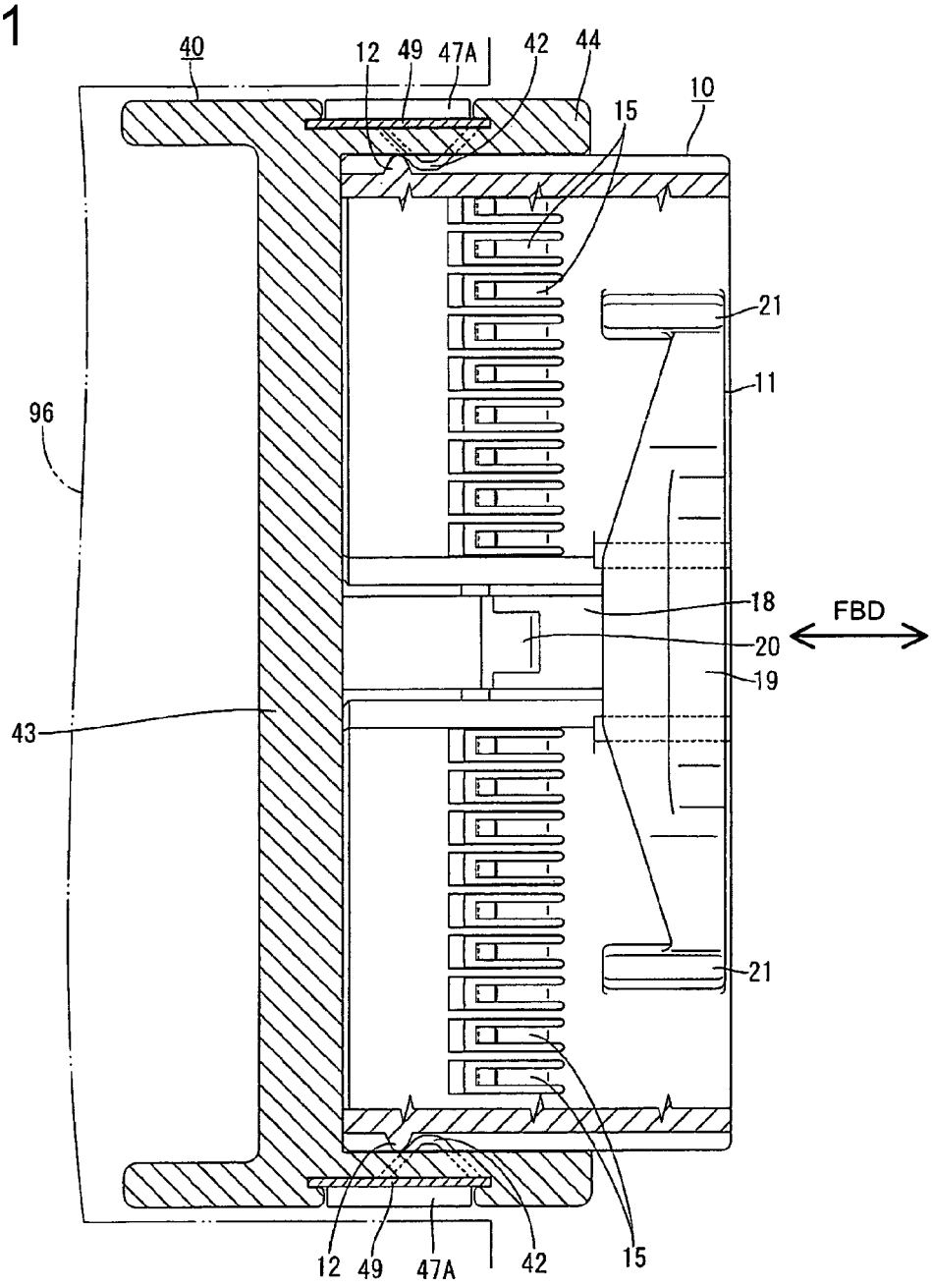
FIG. 11 is a horizontal section showing a state where the female housing is connected with the male housing.
Figure 12:
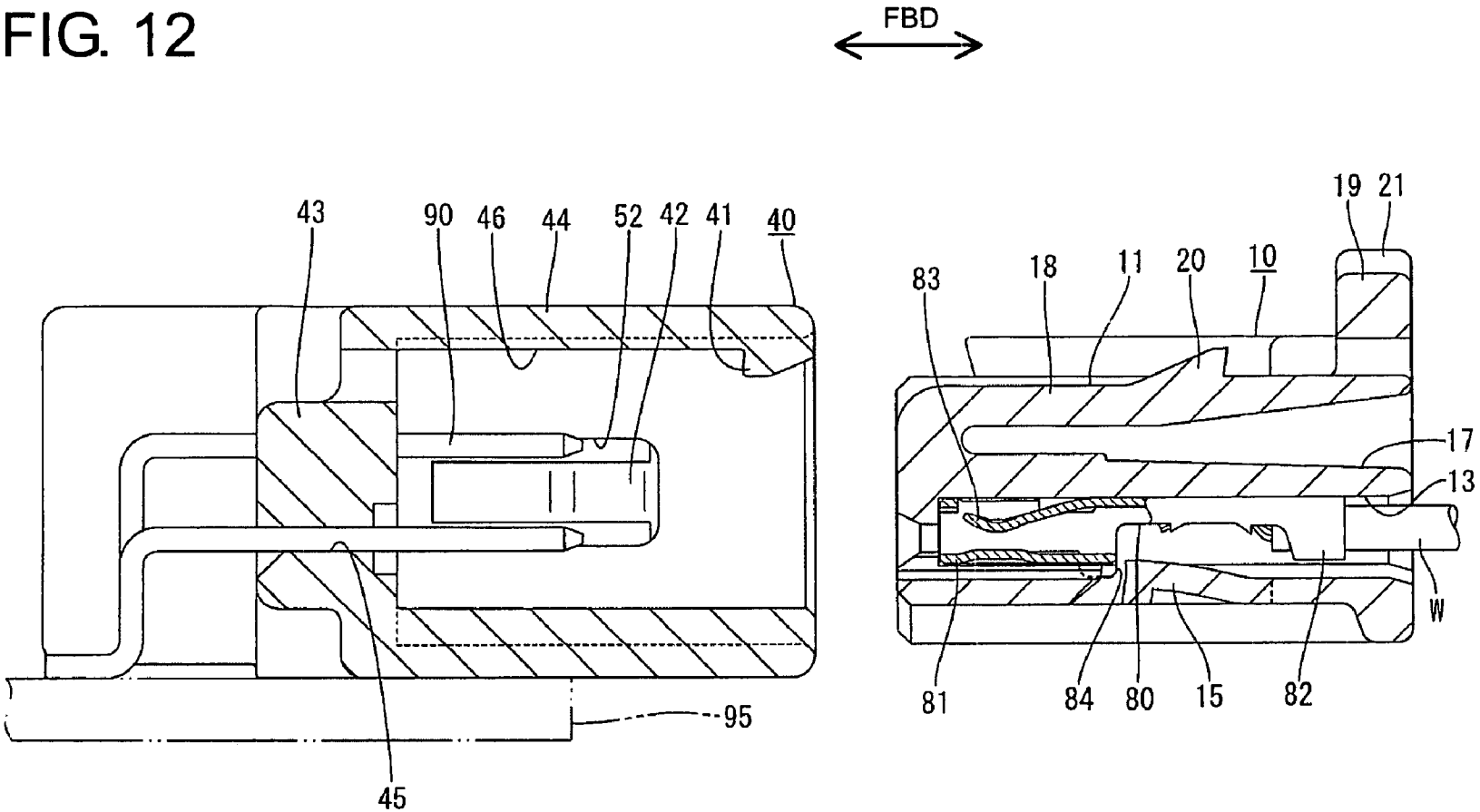
FIG. 12 is a side view in section showing the state before the female housing is connected with the male housing.

A first embodiment of the invention is described with reference to FIGS. 1 to 14. A connector of this embodiment has female and male housings 10, 40 connectable with each other. The female housing 10 is wide block made e.g. of a synthetic resin. Cavities 13 penetrate the female housing 10 in forward and backward directions FBD and female terminal fittings 80 are insertable into the cavities 13 from behind, as shown in FIG. 12. Each female terminal fitting 80 has a known construction, and includes a rectangular tubular main portion 81 that is hollow in forward and backward directions FBD. A barrel 82 is formed behind the main portion 81 and is crimped into connection with an end of a wire W. A contact piece 83 is formed in or at the main portion 81 and can be brought resiliently into contact with a male terminal fitting 90. As shown in FIGS. 1 and 2, the cavities 13 are arranged at upper and lower stages, with those at the upper stage offset from those at the lower stage.

Figure 9:
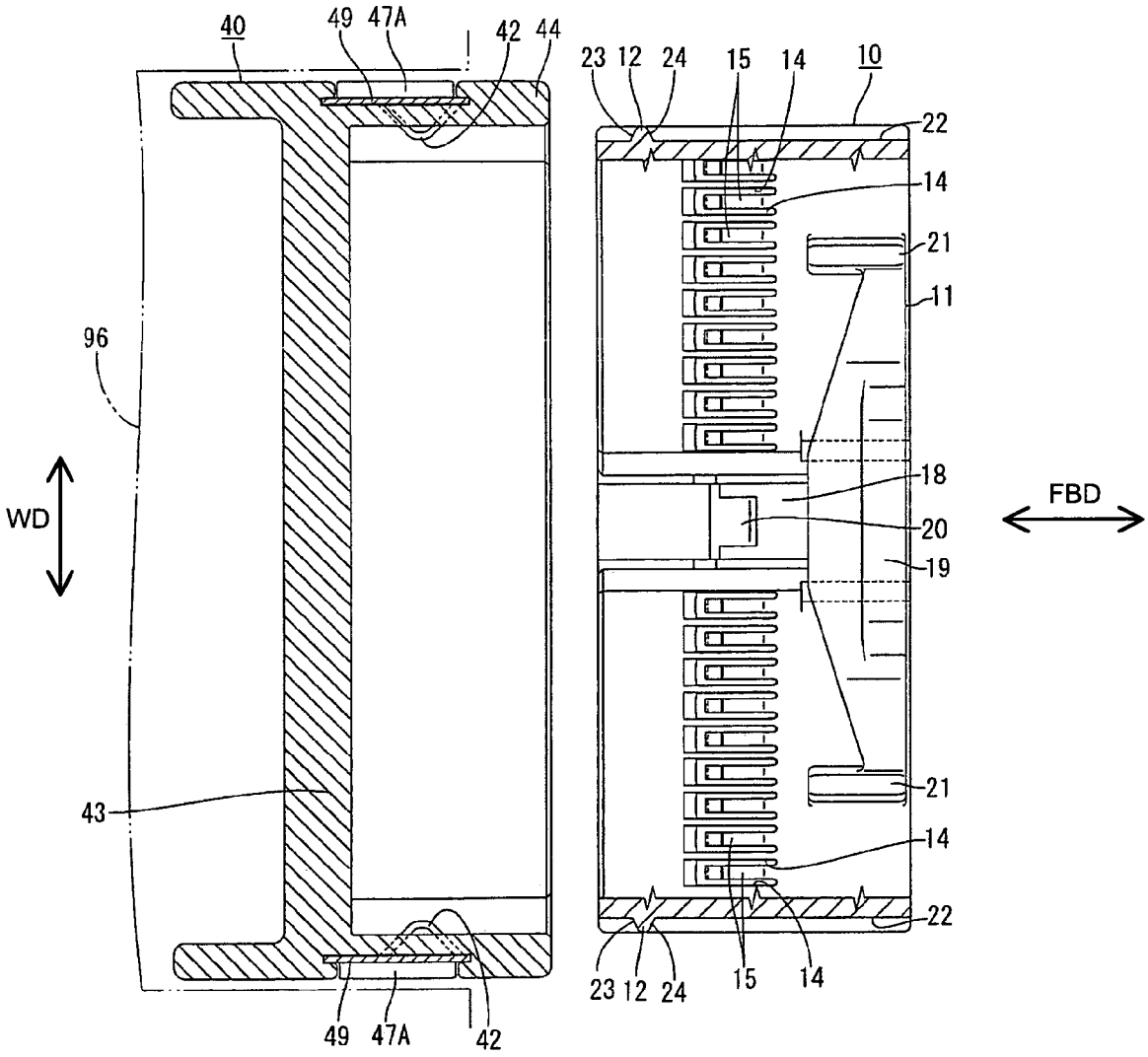
FIG. 9 is a horizontal section showing a state before the female housing is connected with the male housing.

A U-shaped slit 14 is formed in the outer wall of each cavity 13 to define a cantilevered lock 15, as shown in FIG. 9. The lock 15 is resiliently deformable away from the respective cavity 13 and is engageable with a jaw 84 at the rear end of the main portion 81 of the female terminal fitting 80 to retain the female terminal fitting 80 in the cavity 13. The outer surface of each undeformed lock 15 is substantially continuous with the outer surface of the female housing 10. However, a deformed lock 15 projects out from the outer surface of the female housing 10 and collides with the front edge of the male housing 40 if an attempt is made to connect the housings 10, 40 in this state.

A finger placing portion 16 projects at the rear end of the bottom surface of the female housing 10, as shown in FIG. 1, and can be gripped by fingers of an operator to connect or separate the female housing 10. The finger placing portion 16 is wide in a widthwise intermediate portion of the female housing 10 and contributes to the strength of the female housing 10.

A recess 17 is formed in a widthwise intermediate portion of the upper surface of the female housing 10, and a lock arm 11 projects from the bottom surface of the recess 17. The lock arm 11 has a beam 18 that extending along forward and backward directions FBD. A pressable portion 19 is substantially continuous with the rear end of the beam 18 and extends transversely along a width direction WD. As shown in FIG. 12, the beam 18 has a base end coupled to the front end of the bottom surface of the recess 17 and is resiliently deformable with the base end as a support. The upper surface of the beam 18 is substantially aligned with the same height as the upper surface of the female housing 10. Equal numbers of cavities 13 are arranged in the upper stage at the opposite widthwise sides of the beam 18. Further, a lock projection 20 projects up at a longitudinal intermediate portion of the upper surface of the beam 18.

Protrusions 21 project up from the upper surface of the female housing 10 and opposite widthwise ends of the pressable portion 19 are coupled unitarily to the protrusions to define an arch extending above the female housing 10 and along the width direction WD (see FIGS. 1 and 2). A downward force on the pressable portion 19 will deform the beam 18 down towards the female housing 10 to cancel the locking by the lock arm 11. The protrusions 21 project higher than the pressable portion 19 to protect the pressable portion 19.

Grooves 22 are formed in the opposite side surfaces of the female housing 10, as shown in FIG. 9. The grooves 22 have a substantially U-shaped cross section and extend over substantially the entire area along forward and backward directions FBD to form openings in the front and rear surfaces of the female housing 10.

A receiving projection 12 is formed in each groove 22 near the front of the female housing 10. Each receiving projection 12 has a height substantially corresponding to the width of the groove 22 and a projecting distance substantially corresponding to the depth of the groove 22. A guiding surface 23 is formed on the front of each receiving projection 12 and slopes out and back with respect to the forward and backward directions FBD. On the other hand, a separation guiding surface 24 is formed on the rear of each receiving projection 12 and slopes in a direction opposite the connection guiding surfaces 23. The connection guiding surface 23 and the separation guiding surface 24 are substantially symmetrical about a plane passing a center of the receiving projection 12 with respect to forward and backward directions FBD.

Figure 3:
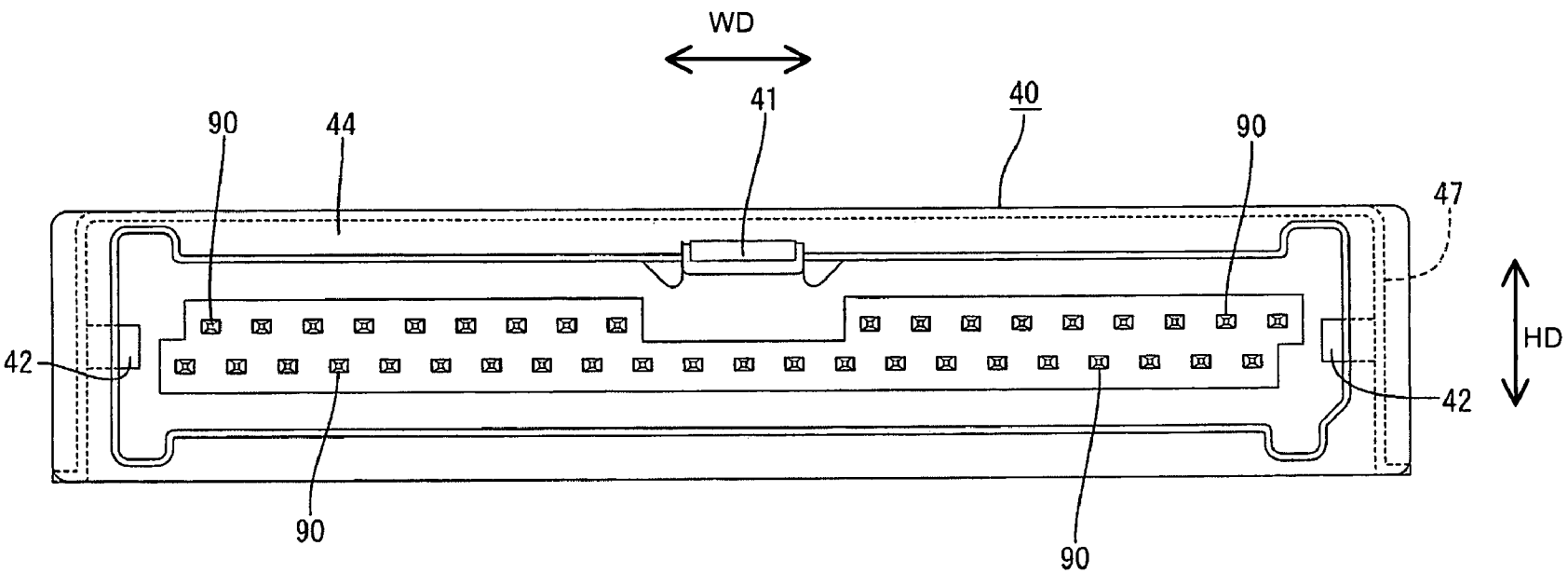
FIG. 3 is a front view of a male housing.

As shown in FIGS. 3 and 12, the male housing 40 has a main body 43 made e.g. of a synthetic resin and a rectangular tubular receptacle 44 projects forward from the main body 43. The male housing 40 is mounted to a circuit board 95 in an accommodating portion 97 formed in a casing 96, such as an aluminum box, while being fixedly mounted on the circuit board 95 via a fixing member 47. In this way, only the front surface is exposed to the outside while the remaining surfaces are covered by the casing 96.

The main body 43 is formed with terminal insertion holes 45 and male terminal fittings 90 are insertable into the terminal insertion holes 45 from behind. The terminal insertion holes 45 are arranged at upper and lower stages and at positions corresponding to the respective cavities 13 of the female housing 10. Thus, the terminal insertion holes 45 at the upper stage are offset from those at the lower stage along the width direction WD. Each male terminal fitting 90 has a known construction with a front portion that projects forward into the receptacle 45 and an intermediate portion that projects back from the rear of the main body 43. The intermediate portion of each male terminal fitting 90 is bent down, and a rear end is bent again to extend backward. The front portion of each male terminal fitting 90 in the receptacle 44 is electrically connectable with the female terminal fitting 80 in the female housing 10, whereas the rear end portion is connectable by soldering, welding, press fitting or the like with a conductor path on the circuit board 95.

The female housing 10 is insertable into the receptacle 44 from the front and along the forward and backward direction FBD. An escaping recess 46 is formed in a widthwise middle of the upper wall of the receptacle 44 and opens in the rear surface of the receptacle 44 for receiving the lock projection 20 of the lock arm 11. The engaging portion 41 projects down at the front end of the escaping recess 46 for engaging the lock projection 20.

Figure 4:
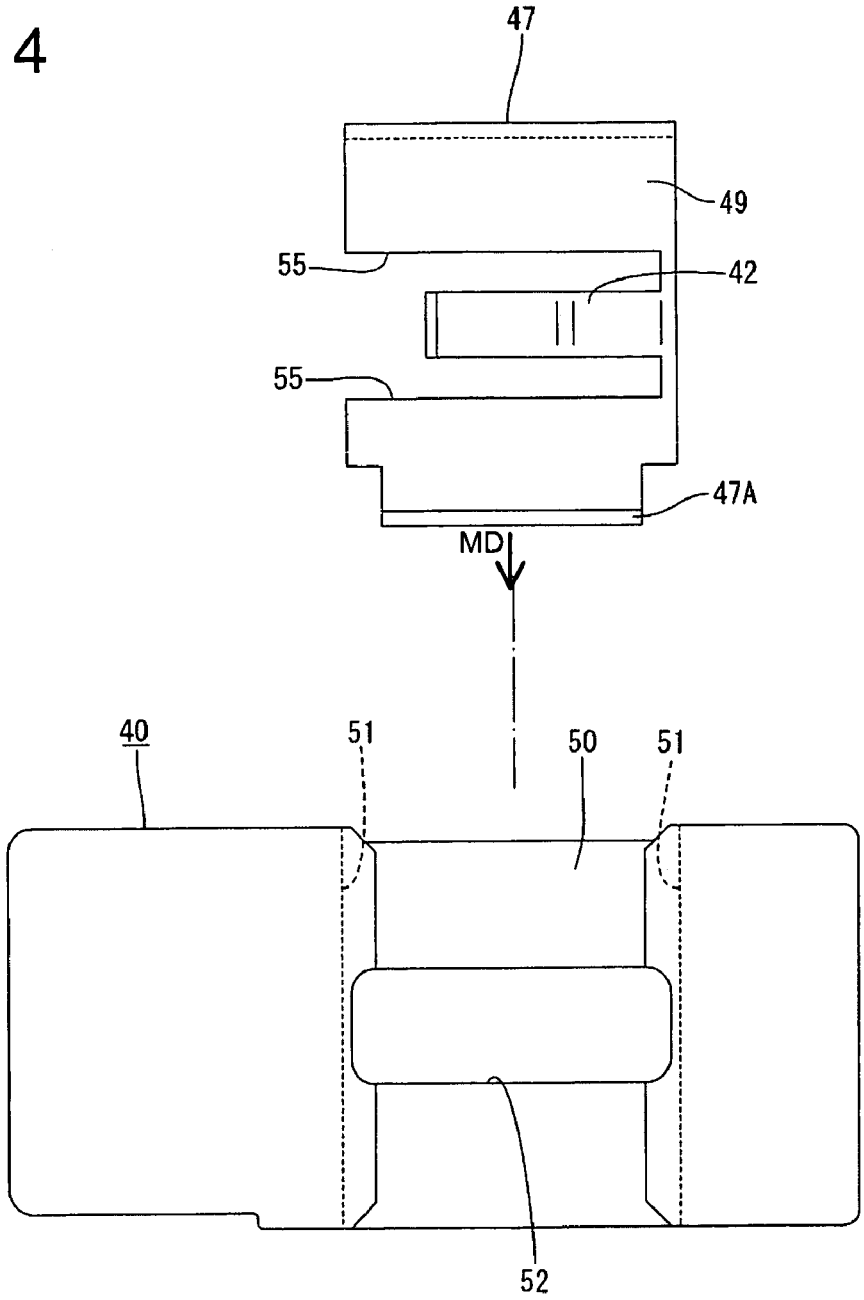
FIG. 4 is an exploded side view of the male housing and fixing member.
Figure 7:
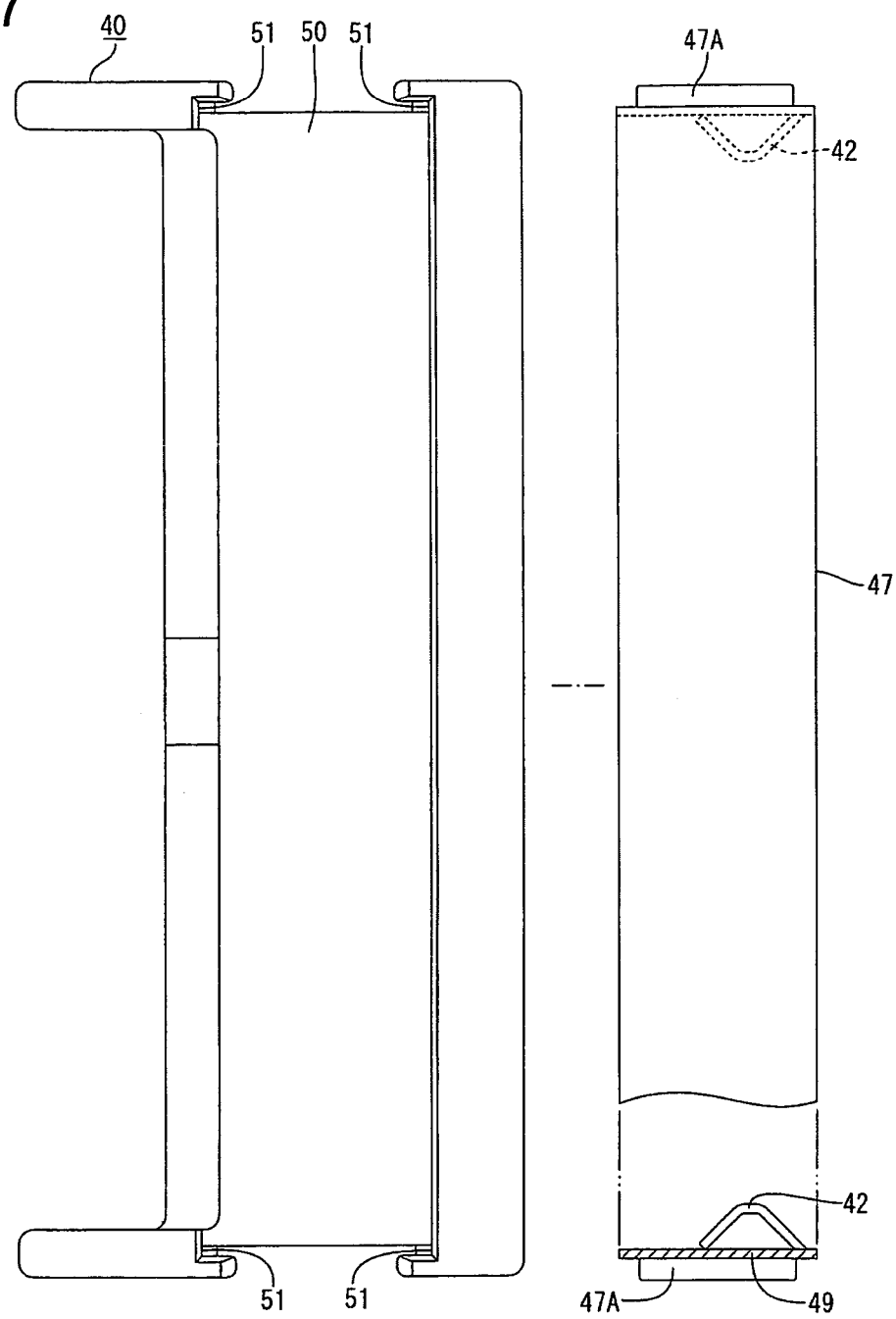
FIG. 7 is an exploded plan view of the male housing and the fixing member.

A mounting recess 50 is formed in an outer surface of the receptacle 44 of the male housing 40 and extends across the upper surface and the side surfaces of the receptacle 44. The mounting recess 50 accommodates the fixing member 47. As shown in FIGS. 4 and 7, the mounting recess 50 has a wide strip-shaped bottom surface substantially in a middle part of the male housing 40 with respect to forward and backward directions FBD. Mount grooves 51 are formed along the front and rear ends of the portions of the mounting recess 50 in the opposite side surfaces of the male housing 40. Substantially oblong mount holes 52 are formed in the side surfaces of the mounting recess 50 at intermediate positions with respect to a height direction HD. The mount holes 52 extend across the side surfaces of the mounting recess 50 along forward and backward directions FBD.

Figure 6:
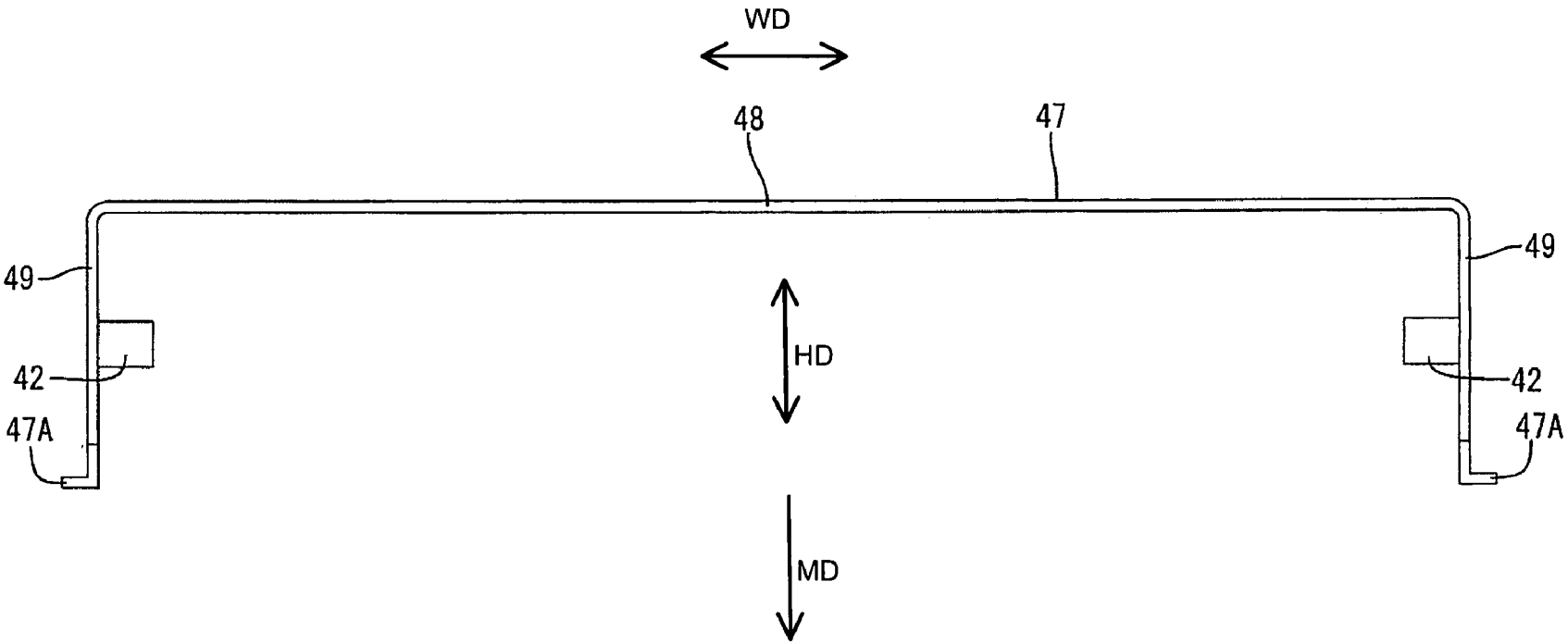
FIG. 6 is a front view of the fixing member.

The fixing member 47 is formed by bending a stamped-out metallic plate to define a ceiling plate 48 and left and right side plates 49 that extend orthogonally from the opposite ends of the ceiling plate 48. The locks 42 are formed unitarily at the side plates 49, as shown in FIGS. 4 and 6. The fixing member 47 is mounted in the mounting recess 50 to cross over the male housing 40 from above. Specifically, front and rear edges of the side plates 49 are fit into the mount grooves 51 from above. The fixing member 47 then is pushed down in a mounting direction MD until the ceiling plate 48 contacts the upper surface of the mounting recess 50. In this state, the upper surface of the ceiling plate 48 is flush with the upper surface of the male housing 40. The side plates 49 contact the opposite side surfaces of the mounting recess 50 and the bottom ends of the side plates 49 are substantially flush with the bottom surface of the male housing 40. Bottom ends of the side plates 49 are bent out at substantially right angles to form fixing portions 47A that can be fixed to the circuit board 95 by soldering, welding or by fixing means, such as screws/bolts. The fixing portions 47A are narrower along forward and backward directions FBD than remaining parts of the side plates 49. Thus, the fixing portions 47 do not interfere with the walls defining the mount grooves 51.

Two cuts 55 extend forward from the rear edge of each side plate 49, and locks 42 are defined in each side plate 49 between the pair of cuts 55. Each lock 42 is a strip of substantially constant width that cantilevers back from a base end that is coupled unitarily to the side plate 49 at a position near the front edge. A middle part of the lock 42 along the extending direction is bent to project in along the width direction WD. The locks 42 project through the mount holes 52 and into the receptacle 44 when the fixing member 47 is mounted on the male housing 40.

Figure 5:
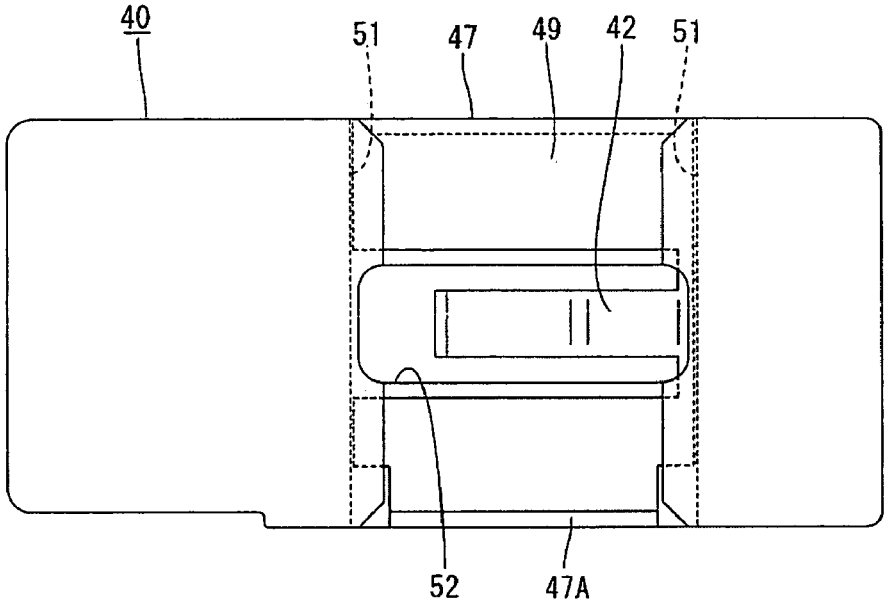
FIG. 5 is a side view of the male housing and the fixing member.
Figure 8:
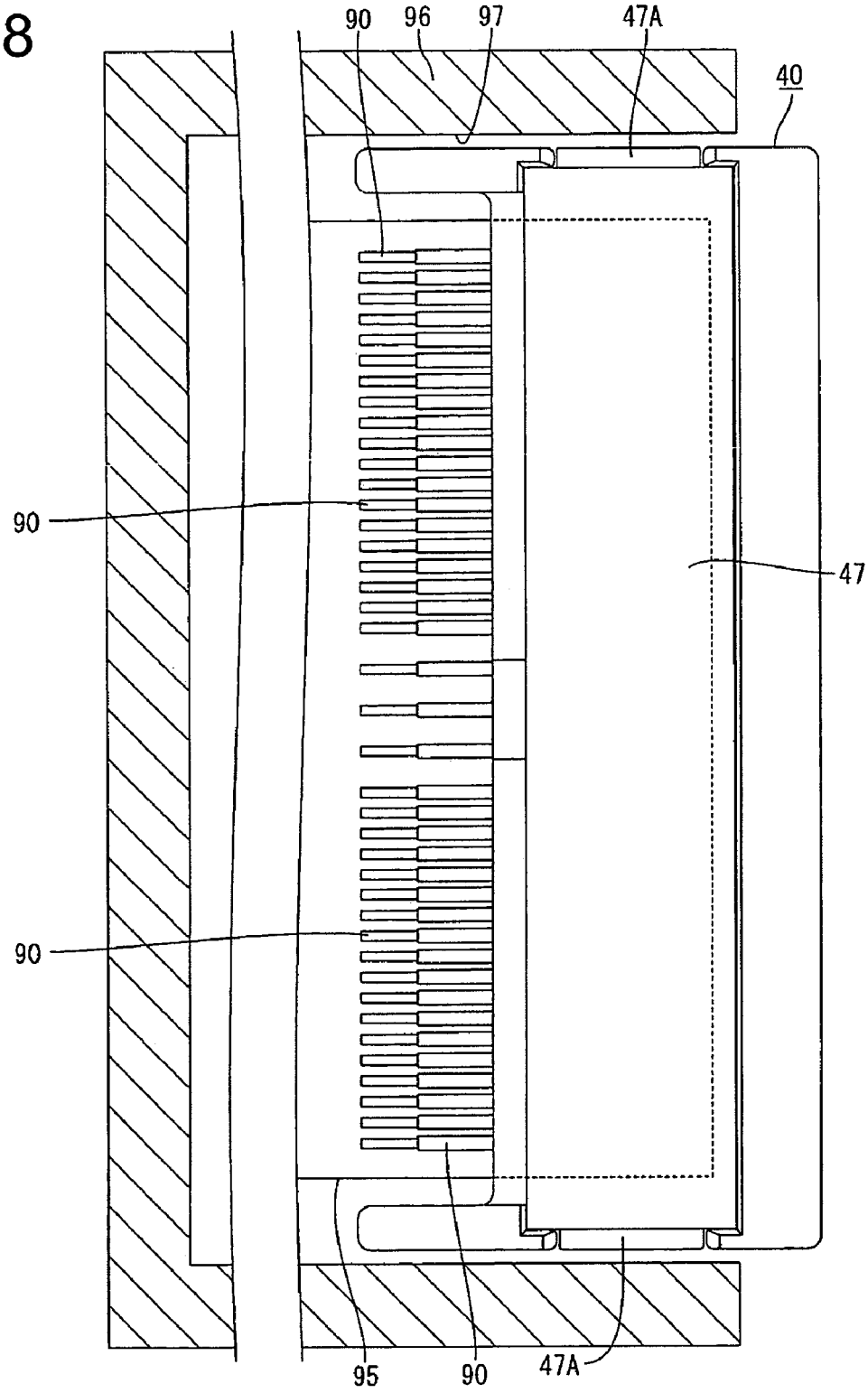
FIG. 8 is a plan view showing a state where the male housing is accommodated in a casing.

As shown in FIGS. 5 and 8, the fixing member 47 is mounted into the mounting recess 50 of the male housing 40 from above and in the mounting direction MD to cross over the male housing 40. The locks 42 deform out during an initial stage of mounting the fixing member 47, but resiliently return to project through the mount holes 52 and into the receptacle 44. The fixing member 47 then is fixed to a specified position of the circuit board 95 e.g. by soldering, and the rear ends of the male terminal fittings 90 are connected with conductor paths of the circuit board 95 e.g. by soldering. The male housing 40 fixed to the circuit board 95 is accommodated into the accommodating portion 97 of the casing 96 so that only the front of the receptacle 44 is exposed to the outside.

The female housing 10 then is fit into the receptacle 44. The locks 42 enter the grooves 22 at the start of the connection, but are behind the receiving projections 12 in the grooves 22. Thus, the locks 42 cannot be confirmed visually from the front of the receptacle 44. On the other hand, the lock projection 20 of the lock arm 11 contacts the front surface of the engaging portion 41 when the female housing 10 is connected to a specified depth, and the lock arm 11 deforms in towards the female housing 10.

Figure 10:
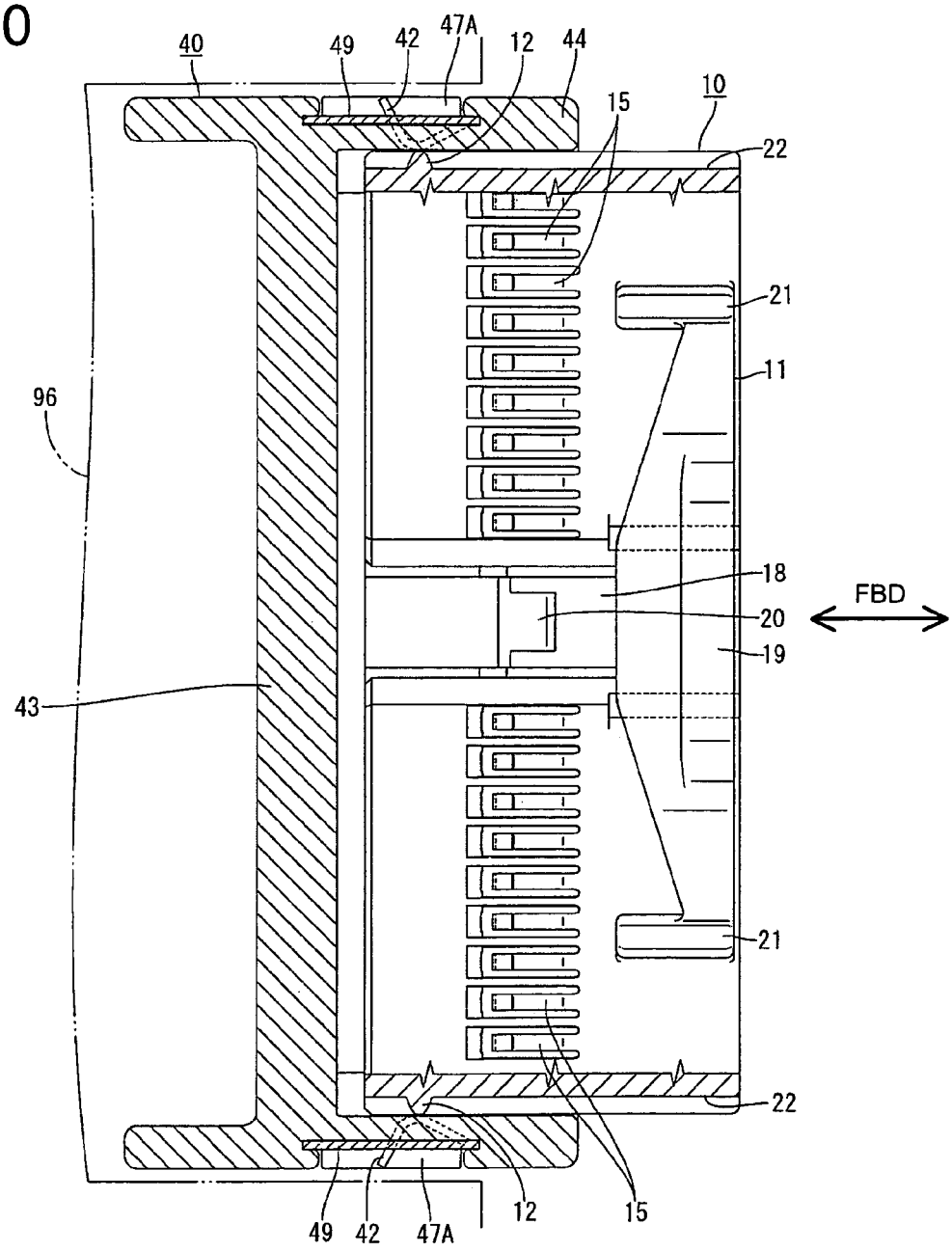
FIG. 10 is a horizontal section showing an intermediate stage of connecting the female housing with the male housing.
Figure 13:
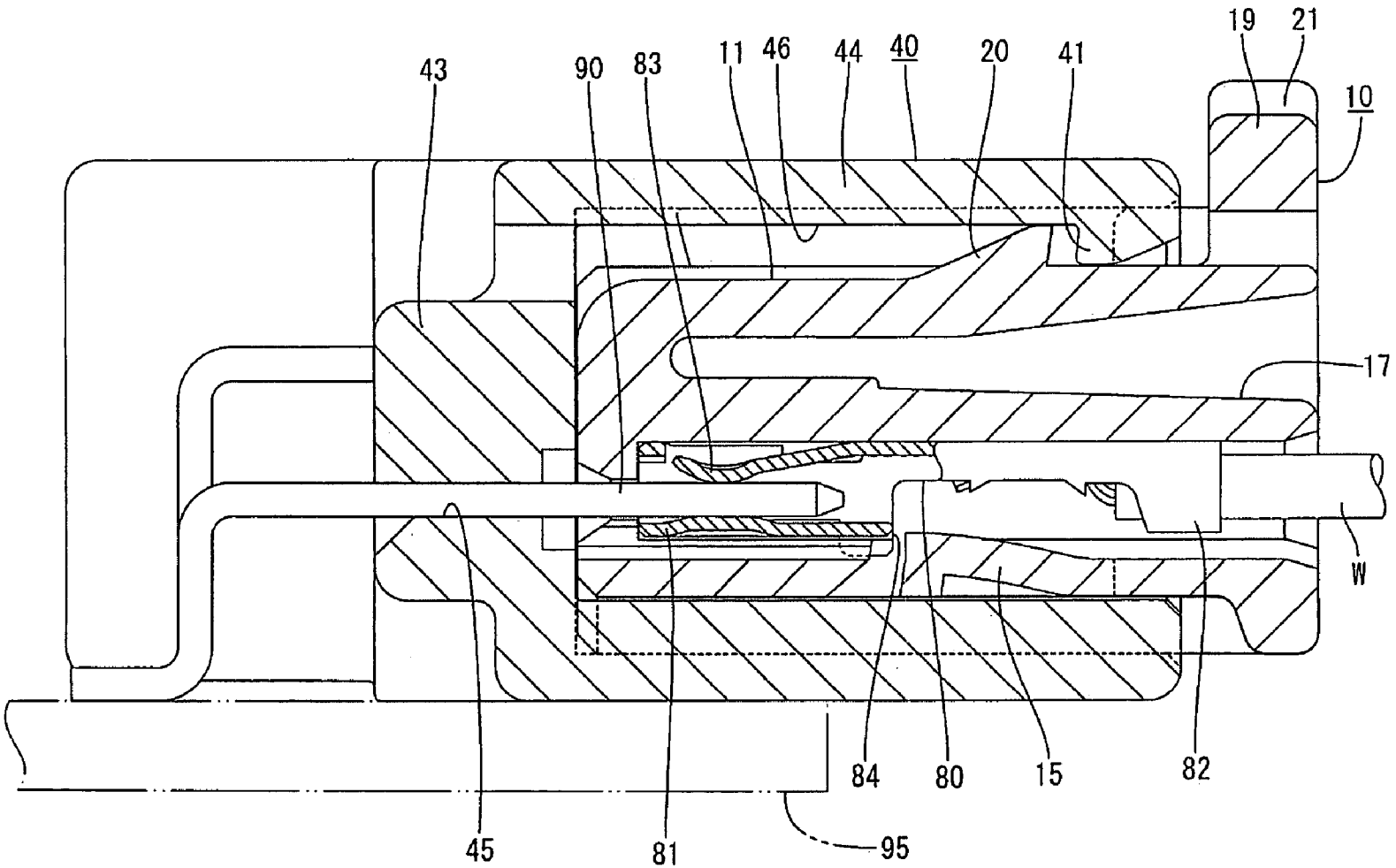
FIG. 13 is a side view in section showing the state where the female housing is connected with the male housing.
Figure 14:
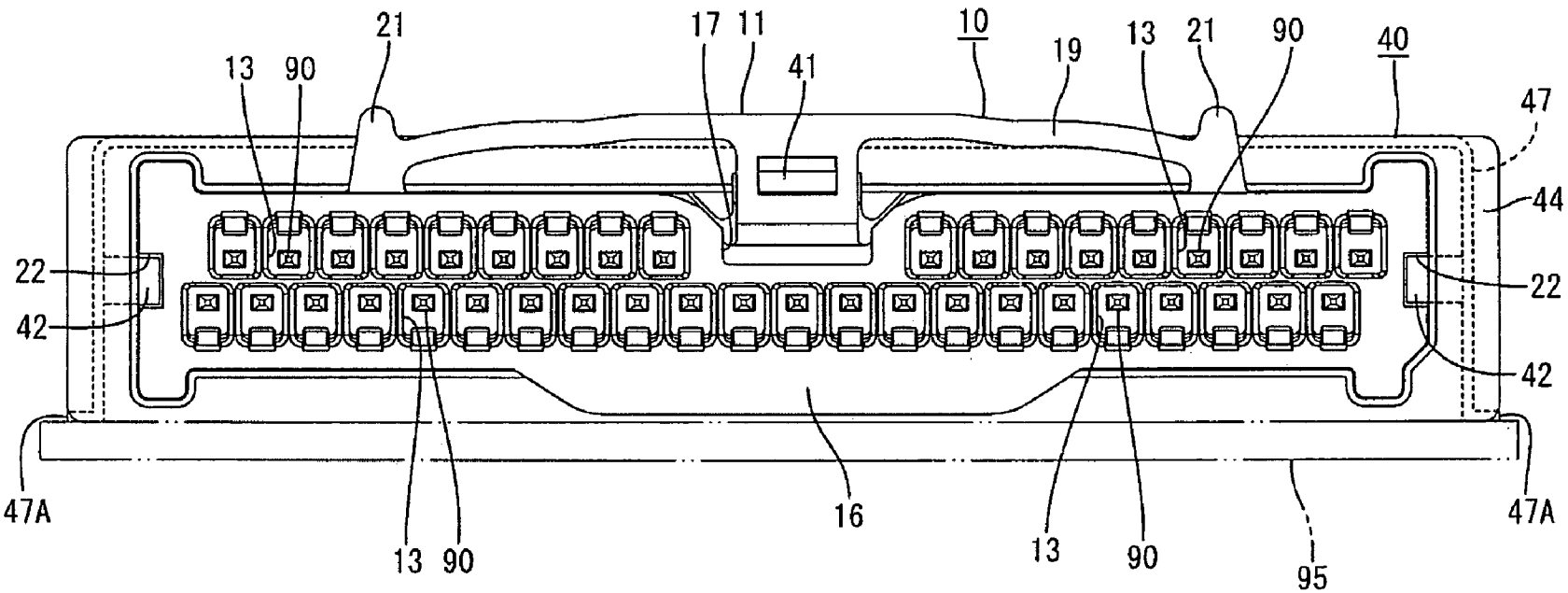
FIG. 14 is a rear view showing the state where the female housing is connected with the male housing.

The lock projection 20 enters the escaping recess 46 when the female housing 10 is connected to a proper connection position, and the lock arm 11 is restored resiliently so that the rear surface of the lock projection 20 engages the rear surface of the engaging portion 41, as shown in FIG. 13, for holding the two housings 10, 40 together. The locks 42 move onto the connection guiding surfaces 23 of the receiving projections 12 and deform out, as shown in FIG. 10, while the lock arm 11 is deformed. The inclined parts of the locks 42 from the base ends to the tips of the locks 42 slide in contact with the connection guiding surfaces 23 of the receiving projections 12 to guarantee a smooth connecting operation. The locks 42 move over the receiving projections 12 and resiliently restore to their initial postures for retain the receiving projections 12, as shown in FIG. 11, as the lock arm 11 is restored resiliently into a position for the lock projection 20 to engage the engaging portion 41. As shown in FIG. 14, the locks 42 move over the receiving projections 12 and into a position before the receiving projections 12 in the grooves 22. The locks 42 have a different outer appearance (e.g. a golden luster), and hence the presence of the locks 42 can be seen easily from the front of the receptacle 44. As a result, the arrival of the two housings 10, 40 at the proper connection position can be detected.

The two housings 10, 40 could be left partly connected and before the proper connection position due to the operator's misunderstanding or other reason. In this situation, the locks 42 are hidden behind the receiving projections 12 when viewed from the front of the receptacle 44. As a result, improper connection of the housings 10, 40 can be detected. In such a case, the two housings 10, 40 are brought to the proper connection position by further pushing the female housing 10. The locks 42 move over the receiving projections 12 and into a position before the receiving projections 12 in the grooves 22. Therefore, the presence of the locks 42 can be confirmed visually from the front of the receptacle 44.

The female housing 10 may have to be separated from the male housing 40 for maintenance or other reason. Thus, the pressable portion 19 is pressed down e.g. by fingers to deform the lock arm 11. The pressable portion 19 is displaced down towards the female housing 10 with the opposite widthwise ends thereof as the base ends and the lock projection 20 comes out of the escaping recess 46. Thus, the female housing 10 can be separated from the male housing 40 by pulling the female housing 10 back. In the meanwhile, the locks 42 slide along the separation guiding surfaces 24 of the receiving projections 12 and deform resiliently to permit separation of the female housing 10. Inclined parts of the locks 42 from the tips to the free ends slide contact with the separation guiding surfaces 24 to guarantee a smooth separating operation. In other words, the locks 42 and the receiving projections 12 define a semi-locking construction, and the locked state can be canceled if a specified force acts to pull the female housing 10 away from the male housing 40.

As described above, the metallic locks 42 are hidden behind the receiving projections 12 at the start of the operation of fitting the female housing 10 into the receptacle 44 of the male housing 40 when viewed from the front. The locks 42 deform and move over the receiving projections 12 as the connection progresses, and then return resiliently to engage the front sides of the receiving projections 12 when the connection is complete. Thus, proper connection of the two housings 10, 40 can be confirmed by visually observing the locks 42 from the front. In this embodiment, the connected state can be confirmed visually only from the front of the receptacle because the male housing 40 is in the casing 96. Accordingly, this embodiment has a high value. The locks 42 have a clearly distinguishable outer surface (e. g. a metallic luster), and therefore have a good visual confirmability. The locks 42 can have a gloss plating for enhanced observation The metallic fixing member 47 for mounting the male housing 40 on the circuit board 95 is mounted on outer sides of the receptacle 44. The locks 42 are formed by the parts of the fixing member 47 to reduce the number of parts. Additionally, the fixing member 47 is metallic and can be fixed to the circuit board 95 by soldering or other fixing means to present a good operational efficiency.

A second embodiment of the invention is described with reference to FIGS. 15 to 17. The second embodiment differs from the first embodiment in the constructions of the locks 42 and the receiving portions 12. Since the other construction is similar to the first embodiment, no repetitive description is given and similar parts merely are identified the same reference numerals.

Figure 15:
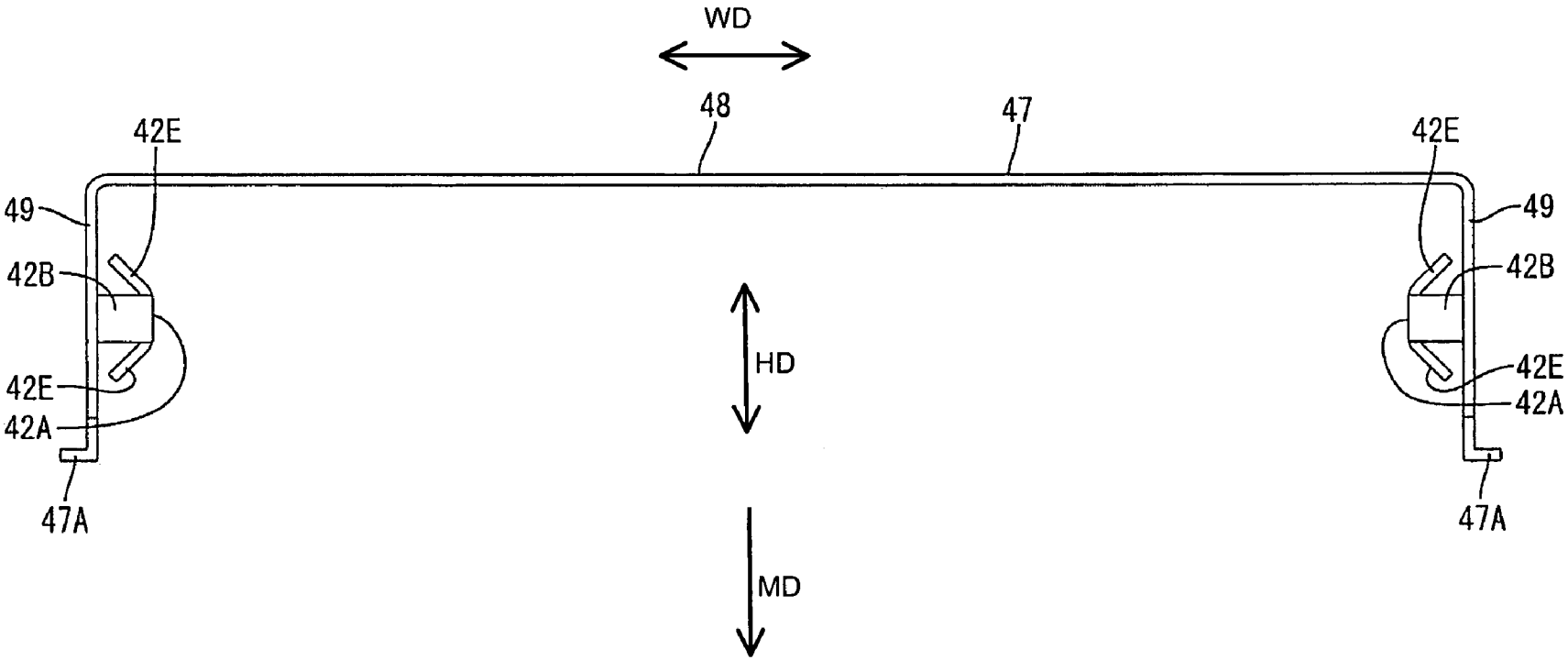
FIG. 15 is a front view of a fixing member of a second embodiment.
Figure 16:
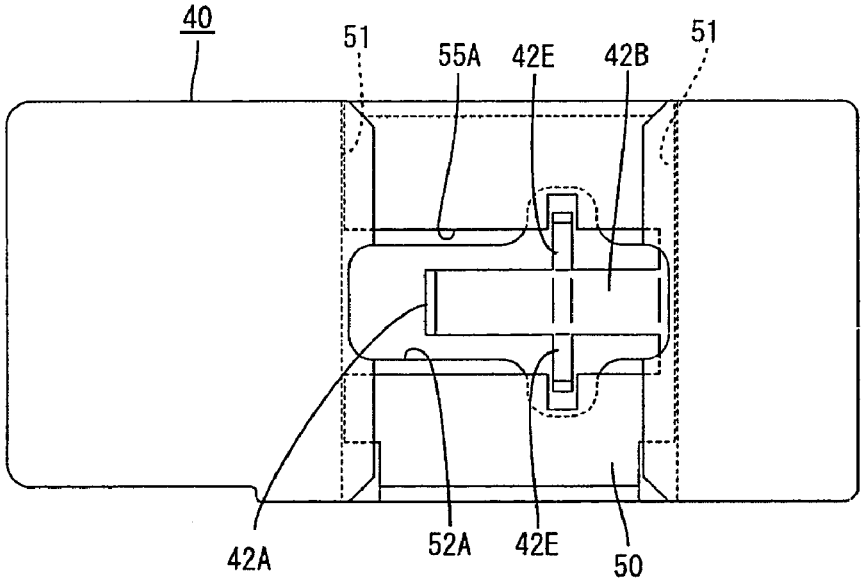
FIG. 16 is a side view of a male housing having the fixing member mounted thereon.
Figure 17:
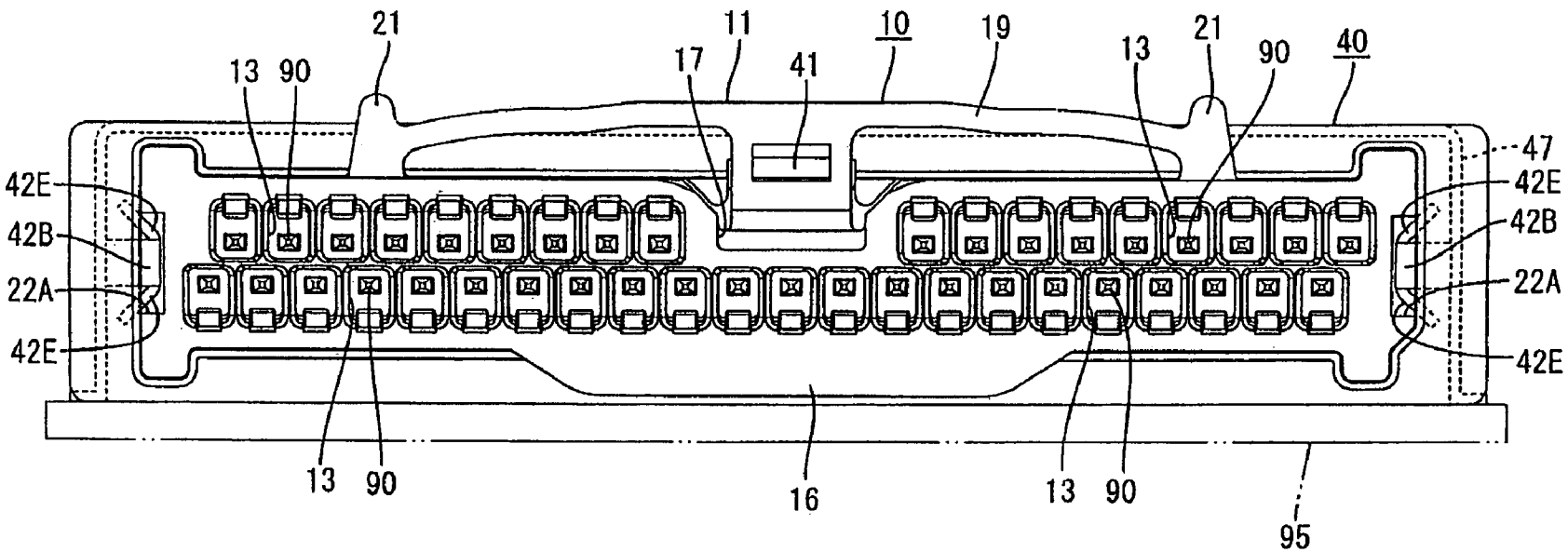
FIG. 17 is a rear view showing a state where a female housing is connected with the male housing.

As shown in FIGS. 15 and 16, locks 42A are formed by making substantially cross-shaped cuts 55A that open at the rear of the side plates 49 of the fixing member 47. The cross-shaped piece inside the cut 55A then is bent to project inward so that an intersection of the cross-shaped piece is at an innermost position. Each lock 42A has a main body 42B that extends back from a position near the front edge of the side plate 49. Upper and lower guides 42E project up and down substantially normal to the extending direction of the main body 42B from the opposite widthwise edges of the main body 42B. The guides 42E are narrower than the main body 42B and are bent out at the intersection of the cross-shaped piece to gradually widen the spacing therebetween and part of the main body 42B at the front and rear sides of this intersection are bent out at this intersection to gradually widen the spacing therebetween.

Mount holes 52A are formed in the male housing 40 and have a cross shape conforming to the locks 42A. Thus, the locks 42A can be inserted through the mount holes 52A. Grooves 22A formed in the female housing 10 are wider than the grooves 22 of the first embodiment and can receive the guides 42E, as shown in FIG. 17.

The fixing member 47 of the second embodiment is mounted onto the male housing 40 from above and along the mounting direction MD. Thus, the inclined surfaces of lower guides 42E slide along the opposite widthwise edges of the upper surface of the male housing 40. Accordingly, the locks 42A are guided through outward resilient deformations, and the fixing member 47 is mounted smoothly. On the other hand, the inclined surfaces of the upper guides 42E slide along the edges of the mount holes 52A when the fixing member 47 is separated upwardly from the male housing 40, and the locks 42A are guided through outward resilient deformations. Thus, the fixing member 47 also can be separated smoothly.

A third embodiment of the invention is described with reference to FIGS. 18 to 32. A connector of this embodiment has female and male housings 110, 140 connectable with each other along a connecting direction CD and a wire cover 160 rotatably mounted on the female housing 110. As shown in FIGS. 21 to 23 and 30, the male housing 140 has a main body 142 in the form of a wide wall made of a synthetic resin. A rectangular tubular receptacle 143 projects forward from the peripheral edge of the main body 142. The male housing 140 and a circuit board 180 are mounted in an accommodating portion 182 formed in a casing 181, such as an aluminum box, while being fixedly mounted on the circuit board 180 via an unillustrated fixing member (such as the fixing member 47 of the first and second embodiments).

The main body 142 has terminal insertion holes 144 and male terminal fittings 183 are insertable into the terminal insertion holes 144 from behind. The terminal insertion holes 144 are at upper and lower stages, and the terminal insertion holes 144 at the upper stage are offset from those at the lower stage along the width direction WD. The male terminal fittings 183 can be pressed into the terminal insertion holes 144. Each male terminal fitting 183 has a known construction with a front portion that projects into the receptacle 143. An intermediate portion projects back from the rear end of the main body 142 and is bent down. A rear portion is bent again to extend back. The front portion of each male terminal fitting 183 projecting into the receptacle 143 is electrically connectable with a female terminal fitting 190 in the female housing 110, whereas the rear end thereof is connectable with a conductor path on the circuit board 180 by soldering, welding, press fitting or the like.

A rearwardly open escaping recess 145 is formed in a widthwise middle portion of the upper wall of the receptacle 143, and an engaging portion 141 projects down at the front end of the escaping recess 145. A slanted surface 146 is formed front of the engaging portion 141 and slopes up towards the front. Guiding grooves 147 are formed at opposite ends of the ceiling and inner bottom surfaces of the receptacle 143. Further, fixing-member mounts 148 used to mount the fixing member are formed by recessing in outer-circumferential areas extending from the upper surface to the opposite side surfaces of the receptacle 143.

Figure 21:
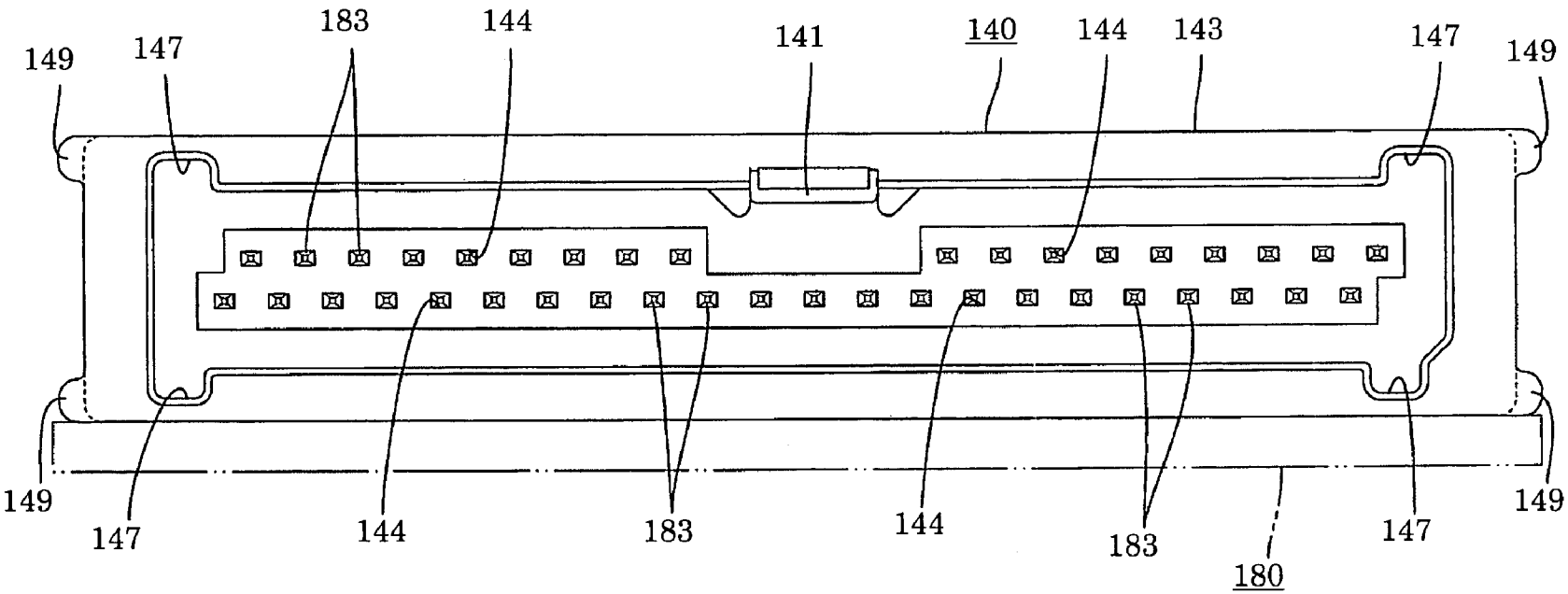
FIG. 21 is a front view of a male housing.

Engageable sections 149 are provided on the opposite side surfaces of the receptacle 143. More specifically, as shown in FIG. 21, the engageable sections 149 project sideways from the opposite side surfaces at four corners of the front end edge of the receptacle 143.

Figure 18:
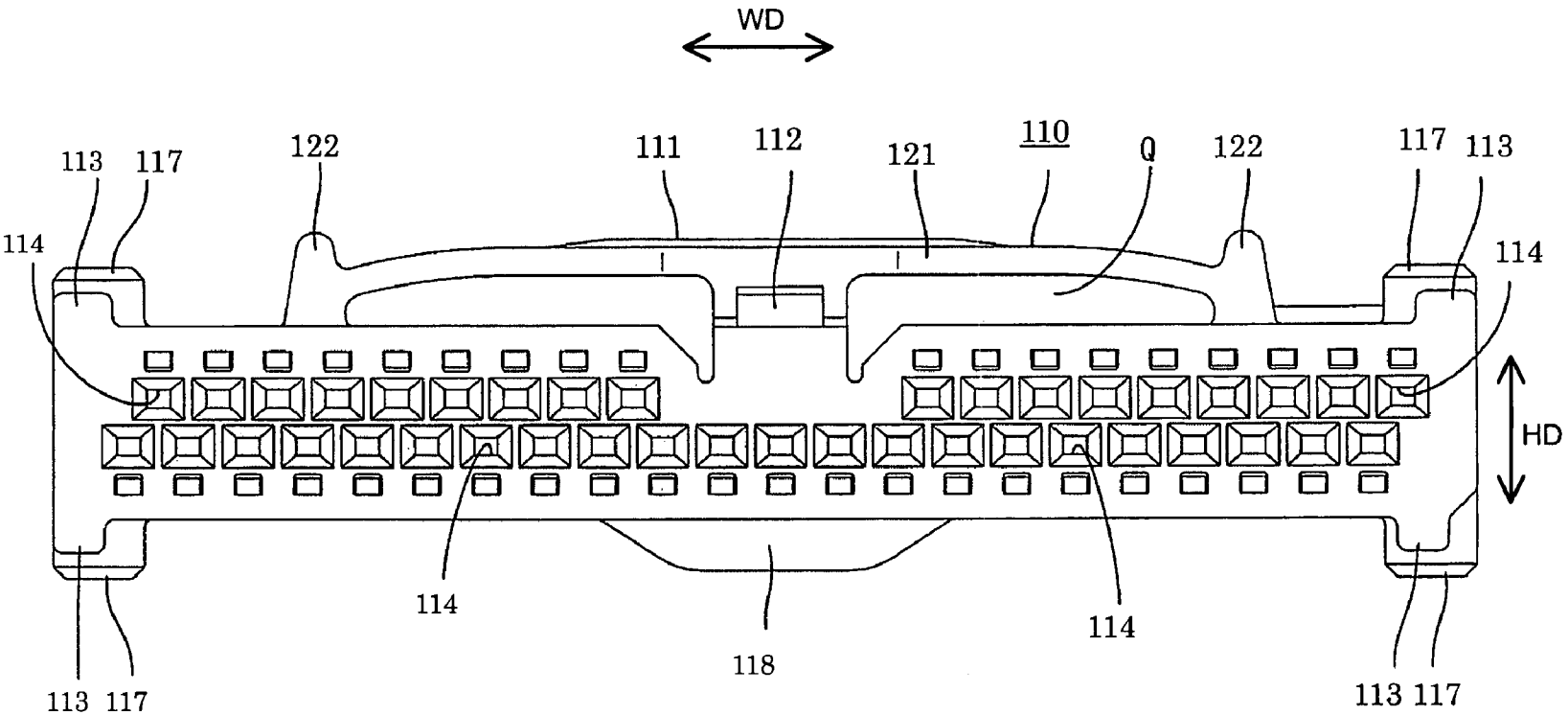
FIG. 18 is a front view of a female housing according to a third embodiment of the invention.
Figure 19:
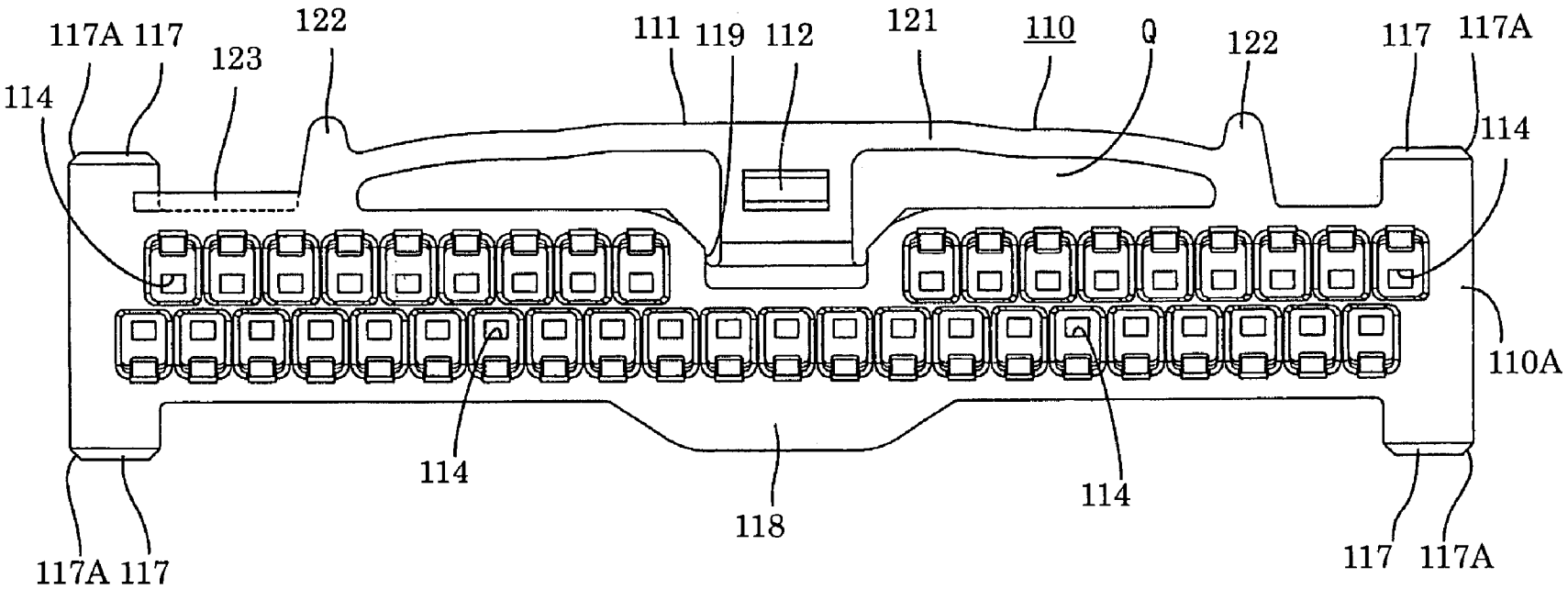
FIG. 19 is a rear view of the female housing.
Figure 20:
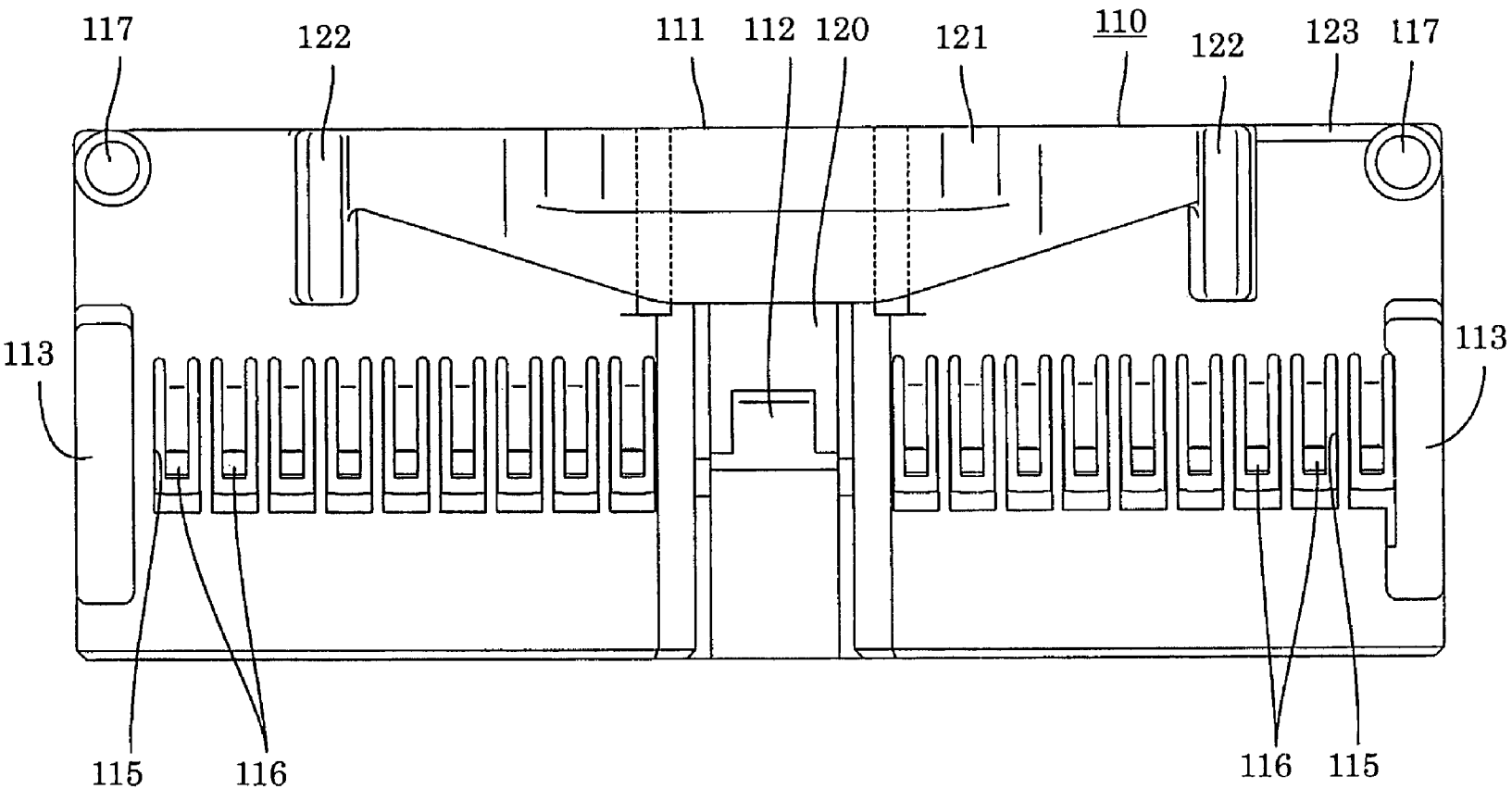
FIG. 20 is a plan view of the female housing.
Figure 30:
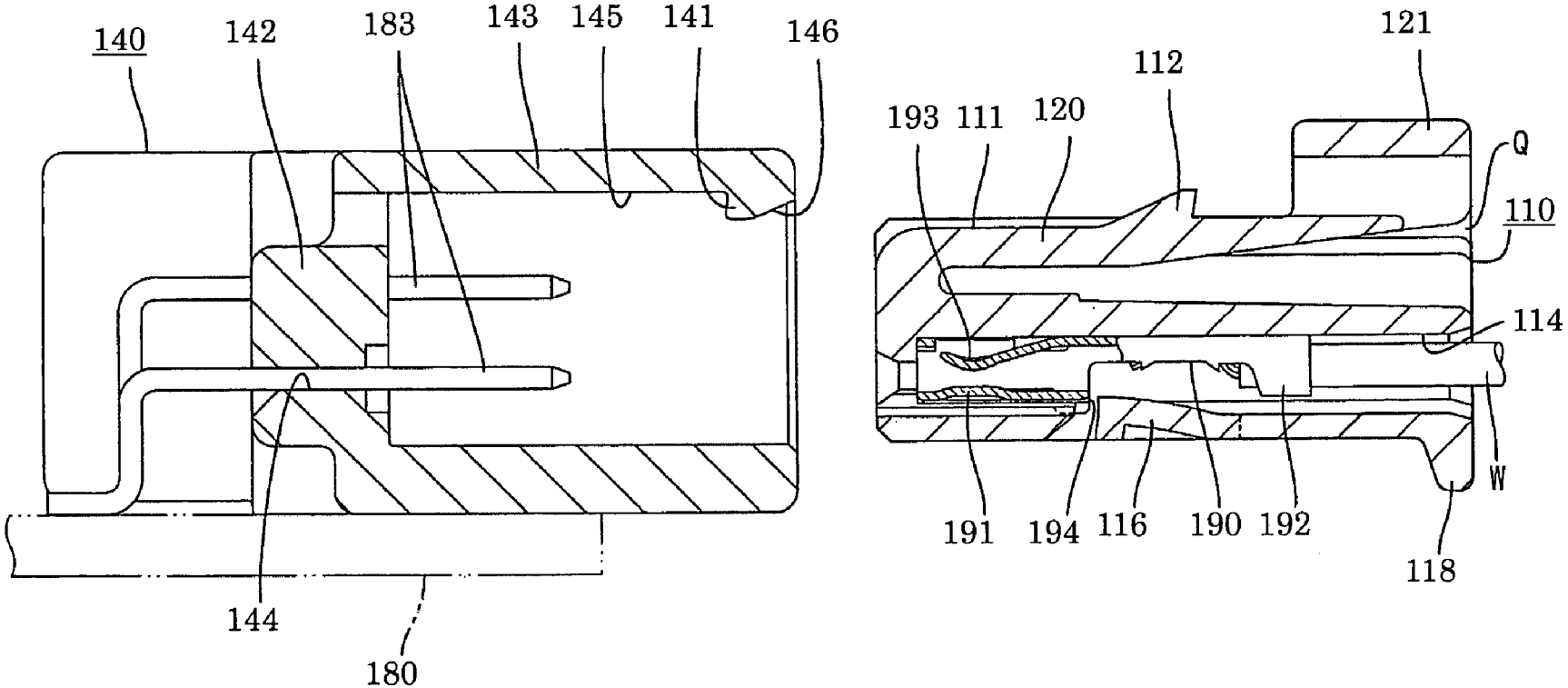
FIG. 30 is an exploded horizontal section showing the state before the two housings are connected.

The female housing 110 is a wide block made e.g. of a synthetic resin. Cavities 114 extend through the female housing 110 and the female terminal fittings 190 are insertable into the cavities 114 from behind, as shown in FIGS. 18 to 20. Wires W can be drawn out through a wire-draw out surface at the rear end 110A of the female housing 110. As shown in FIG. 30, each female terminal fitting 190 has a known construction including a rectangular tubular main portion 191. A barrel 192 is behind the main portion 191 and is crimped to an end of the wire W. A contact piece 193 is formed in the main portion 191 and can be brought into contact with the male terminal fitting 183.

As shown in FIGS. 18 and 19, the cavities 114 are arranged at upper and lower stages and correspond to the arrangement of the terminal insertion holes 144 for the male terminal fittings 183. As shown in FIG. 20, a U-shaped slit 115 is formed in the outer wall of each cavity 114 to form a cantilevered lock 116. The lock 116 is resiliently deformable vertically away from the respective cavity 114 and is engageable with a jaw 194 at the rear end of the main portion 191 of the female terminal fitting 190 to retain the female terminal fitting 190 in the cavity 114. The outer surface of each lock 116 is substantially continuous with the outer surface of the female housing 110 and is exposed to the outside. The lock 116 projects out from the outer surface of the female housing 110 while being resiliently deformed. Thus, the lock 116 collides with the front edge of the male housing 140 if an attempt is made to connect the two housings 110, 140 in this state.

The ribs 113 project from the upper and lower surfaces for guiding the connection of the two housings 110, 140. More specifically, the ribs 113 are near the opposite widthwise ends of the upper and lower surfaces of the female housing 110, but are arranged asymmetrically along the width direction WD.

Substantially identical cylindrical shafts 117 project behind the ribs 113 on the upper and lower surfaces of the female housing 110 for rotatably supporting the wire cover 160. The shafts 117 project from the upper and lower surfaces at four corners of the rear end edge of the female housing 110. A slanted guiding surface 117A is formed at the projecting end of each shaft 117 so that the wire cover 160 can be easily fittable on the shaft 117.

A finger placing portion 118 projects at the rear end of the bottom surface of the female housing 110 for engagement by fingers of an operator to connect or separate the female housing 110. The finger placing portion 118 is wide to contribute to the strength of the female housing 110.

A recess 119 is formed in a widthwise intermediate portion of the upper surface of the female housing 110, and a lock arm 111 projects from the bottom of the recess 119. More specifically, the lock arm 111 has a beam 120 extending along forward and backward directions. A pressable portion 121 extends along the width direction WD at the rear end of the beam 120. As shown in FIG. 30, the base end of the beam 120 is coupled to the front end of the bottom surface of the recess 119. The beam is resiliently deformable towards the female housing 110 with the base as a support. The upper surface of the beam 120 aligns with the upper surface of the female housing 110. Equal numbers of upper stage cavities 114 are arranged at the left and right sides of the beam 120. A lock 112 projects up from the beam 120 and is engageable with the engaging portion 141 of the male housing 140.

The widthwise middle of the pressable portion 121 is coupled to the rear end of the beam 120 while opposite widthwise ends are coupled unitarily to protrusions 122 that project up from the upper surface of the female housing 110 to form of an arch. A deformation space Q is defined between the lock arm 111 and the female housing 110 so that the lock arm 111 can be deformed into the deformation space Q. Projecting ends of the protrusions 122 are higher than the pressable portion 121 to protect the pressable portion 121. A partial locking projection 123 is formed between the protrusion 122 and the shaft 117 on the upper surface of the female housing 110.

Figure 24:
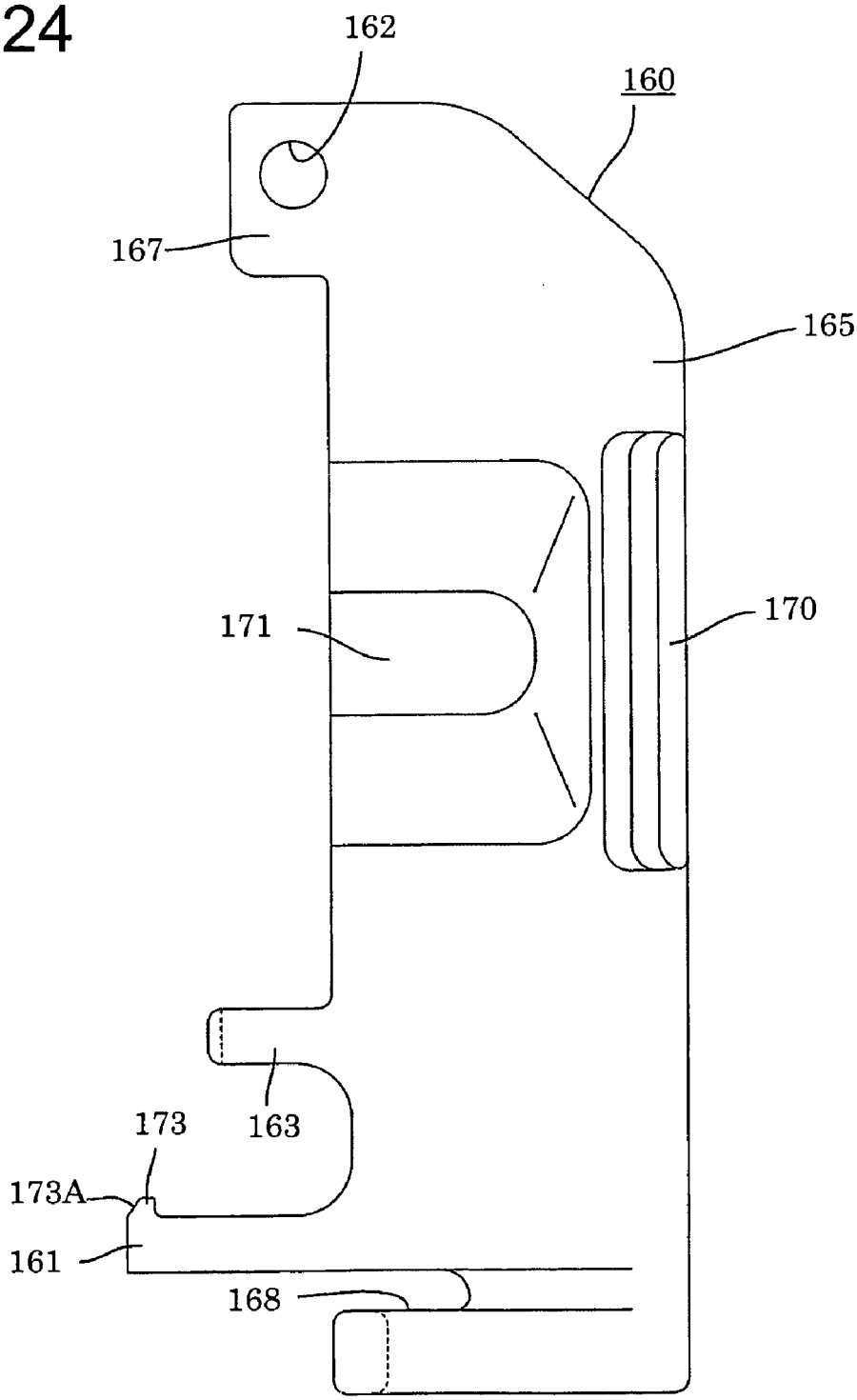
FIG. 24 is a plan view of a wire cover.
Figure 25:
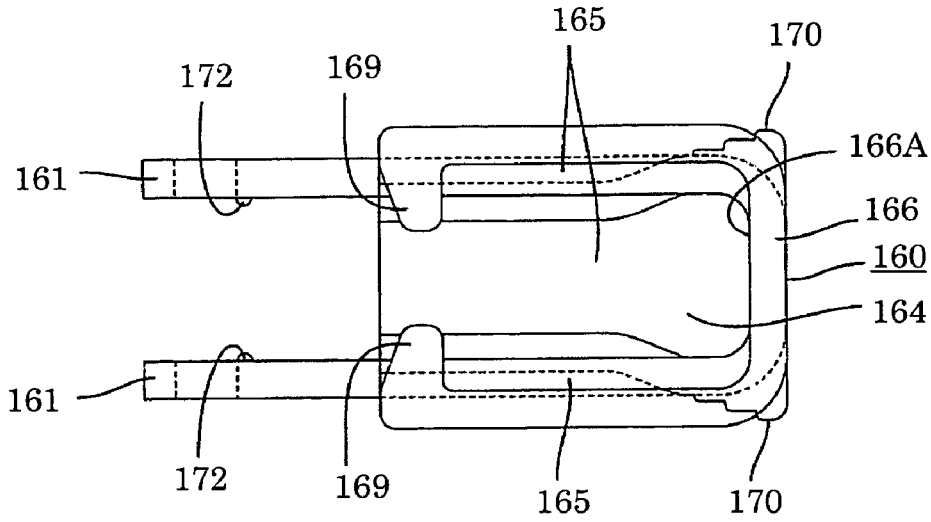
FIG. 25 is a side view of the wire cover.
Figure 26:
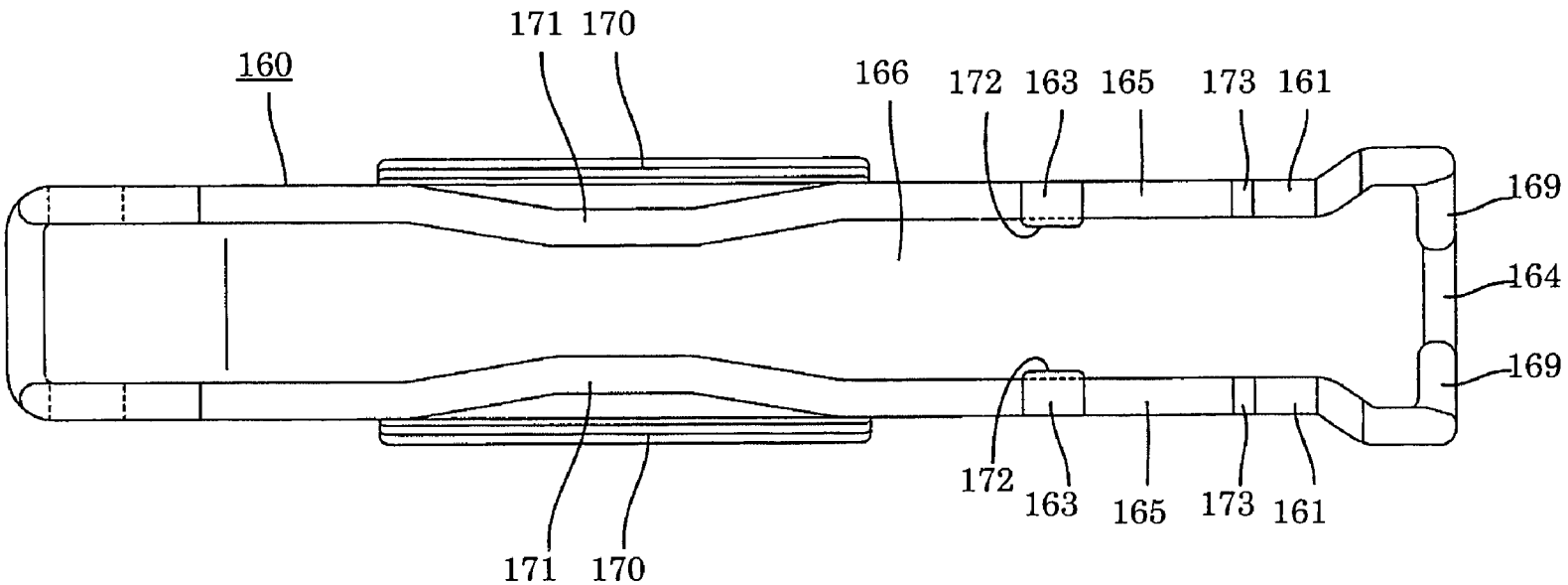
FIG. 26 is a front view of the wire cover.

As shown in FIGS. 24 to 26, the wire cover 160 is substantially bowl-shaped and a front part of the wire cover 160 is slightly larger than a rear part of the female housing 110. The wire cover 160 has an open front surface for mounting on the female housing 110, and a wire draw-out opening 164 through which the wires W are drawn out. The wire cover 160 has sidewalls 165 at three sides and a rear wall 166. The wires W that are drawn out through the rear end surface 110A of the female housing 110 are bent substantially normal to a connecting direction CD to extend substantially along an inner surface 166A of the rear wall 166 and through the wire draw-out opening 164.

Two opposed sidewalls 165 are formed with attachments 167 that bulge out forward at ends substantially opposite from the wire draw-out opening 164, and substantially circular shaft receiving holes 162 are formed in intermediate portions of the attachments 167. The opening diameter of the shaft receiving holes 162 is equal to or slightly larger than the diameter of the shafts 117 of the female housing 110, and the wire cover 160 is mountable rotatably on the shafts 117 through the shaft receiving holes 162. As described above, two pairs of shafts 117 align along height direction HD at the four corners at the rear end of the female housing 110. The shaft receiving holes 162 engage only one pair of shafts 117, and either pair is selected depending on use conditions. Accordingly, although the wire cover 160 is rotated clockwise in the illustrated embodiment, it may be rotated counterclockwise by supporting the wire cover 160 on the other shafts 117.

A groove 168 is formed at the end of each sidewall 165 that has the wire draw-out opening 164, and at least one resiliently deformable wire pressing piece 169 is formed below the groove 168. The wires W are drawn out through the wire draw-out opening 164 while being held between the wire pressing pieces 169. Finger placing portions 170 are embossed at the rear ends of the respective sidewalls 165. The operator can rotate the wire cover 160 while holding the finger placing portions 170. Inwardly recessed constrictions 171 are formed before the finger placing portions 170 for preventing loose movements of the respective wires W in the wire cover 160.

A partial lock 163 projects forward from the front end edge of each sidewall 165. Partial locking protuberances 172 project towards each other from the projecting ends of the partial locks 163. The partial locking protuberances 172 engage the partial locking projections 123 of the female housing 110 to prevent rotation of the wire cover 160 towards an open position. The wire cover 160 at a partial locking position is oblique to the rear end surface 110A of the female housing 110 and at an angle to the connecting direction CD.

A lock 161 projects forward from the front end edge of each sidewall 165. The locks 161 are substantially parallel with the partial locks 163 but project farther than the partial locks 163 from positions on the front end edges of the sidewalls 165 nearer the other end. A locking protuberance 173 projects in along the width direction WD from the projecting end of each lock 161. The locking protuberances 173 engage the engageable sections 149 of the female housing 110 when the housings 110, 140 are connected properly to keep the wire cover 160 at a full locking position. Slanted surfaces 173A are formed at the front of the locking protuberances 173 to guide the engagements with the engageable sections 149. Two pairs of the engageable sections 149 are provided at the opposite widthwise ends of the receptacle 143. Thus, the wire cover 160 can be held at the full locking position regardless of whether the wire cover 160 is rotated clockwise or counterclockwise by suitably selecting the supporting shafts 117 for rotational movement of the wire cover 160. The front edge of the wire cover 160 at the full locking position substantially aligns with the rear end surface 110A of the female housing 110 to close the rear end surface 110A of the female housing 110.

Figure 22:
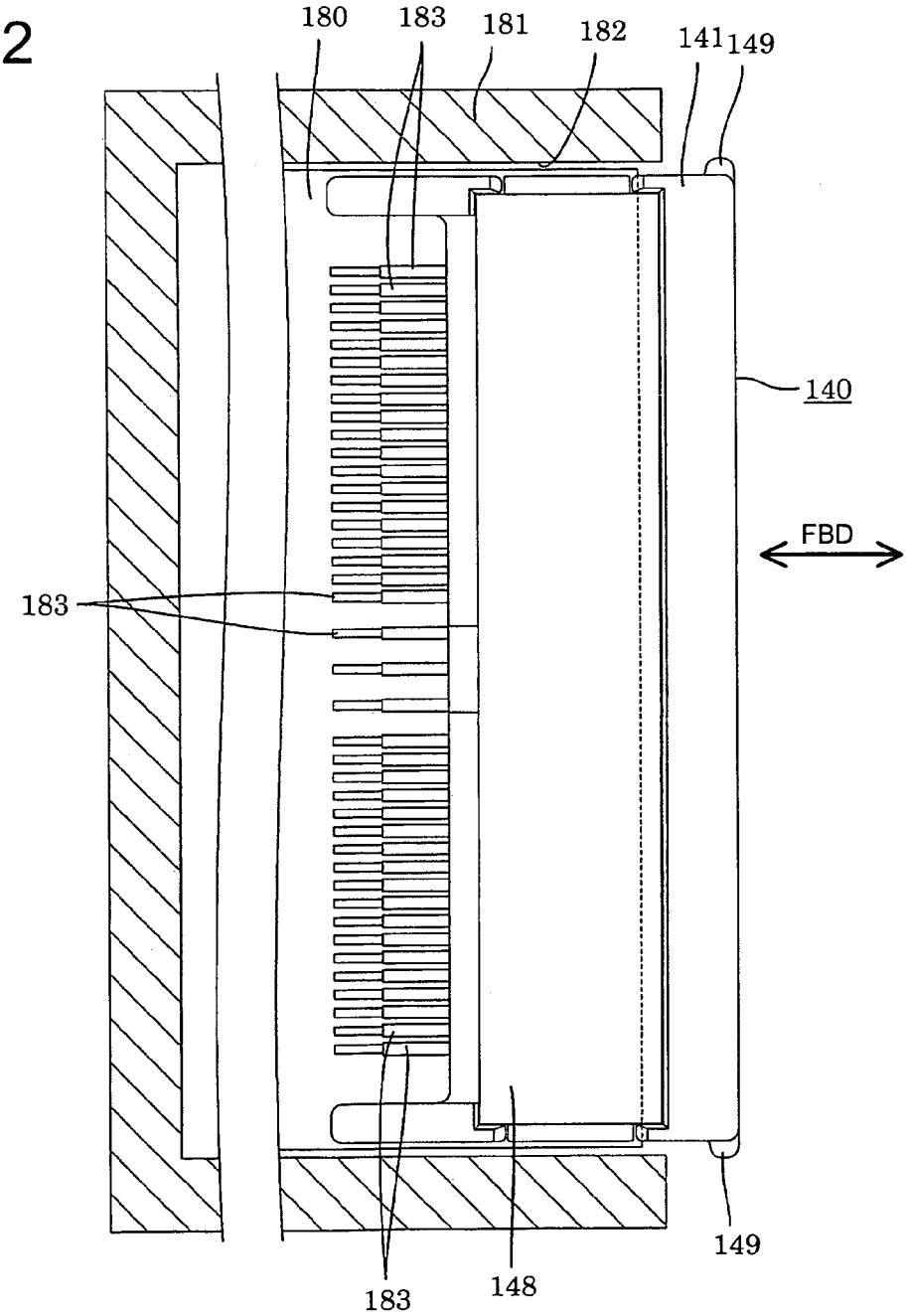
FIG. 22 is a plan view of the male housing.
Figure 23:
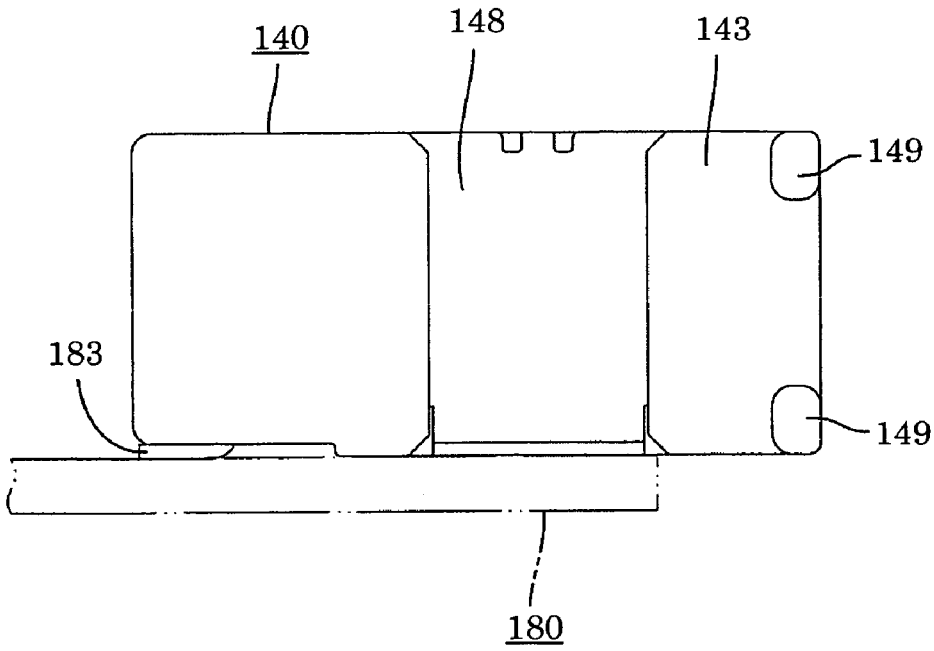
FIG. 23 is a side view of the male housing.

The male housing 140 is mounted at a specified position on the circuit board 180, and the rear ends of the male terminal fittings 183 are connected with the conductor paths of the circuit board 180 e.g. by soldering. Then, as shown in FIG. 22, the male housing 140 fixed to the circuit board 180 is accommodated into the accommodating portion 182 of the casing 181 with only the front surface of the receptacle 143 exposed to the outside. In this way, the male housing 140 is held in a standby state where the connection with the female housing 110 can be started as shown in FIGS. 27 and 30.

The wire cover 160 is mounted on the female housing 110 by engaging the shaft receiving portions 162 of the wire cover 160 on the shafts 117 at one widthwise end of the female housing 110. The wire cover 160 then is rotated towards the partial locking position shown in solid line from a position shown in phantom line in FIG. 27. The partial locking protuberances 172 of the wire cover 160 interfere with the partial locks 123 of the female housing 110 to hinder rotation of the wire cover 160. However, an increased rotational force on the wire cover 160 will urge the partial locking protuberances 172 over the partial locks 123 for engaging the rear surfaces of the partial locking projections 123. The wires W bend to extend along the inner surface 166A of the rear wall 166, and are drawn out substantially normal to the connecting direction CD as the wire cover 160 is rotated to the partial locking position.

The female housing 110 covered by the wire cover 160 is connected with the male housing 140 in the standby state. An attempt could be made to connect the female housing 110 upside down with the male housing 140. However, the ribs 113 will contact the opening edge of the receptacle 143 to prevent an erroneous connection.

Figure 27:
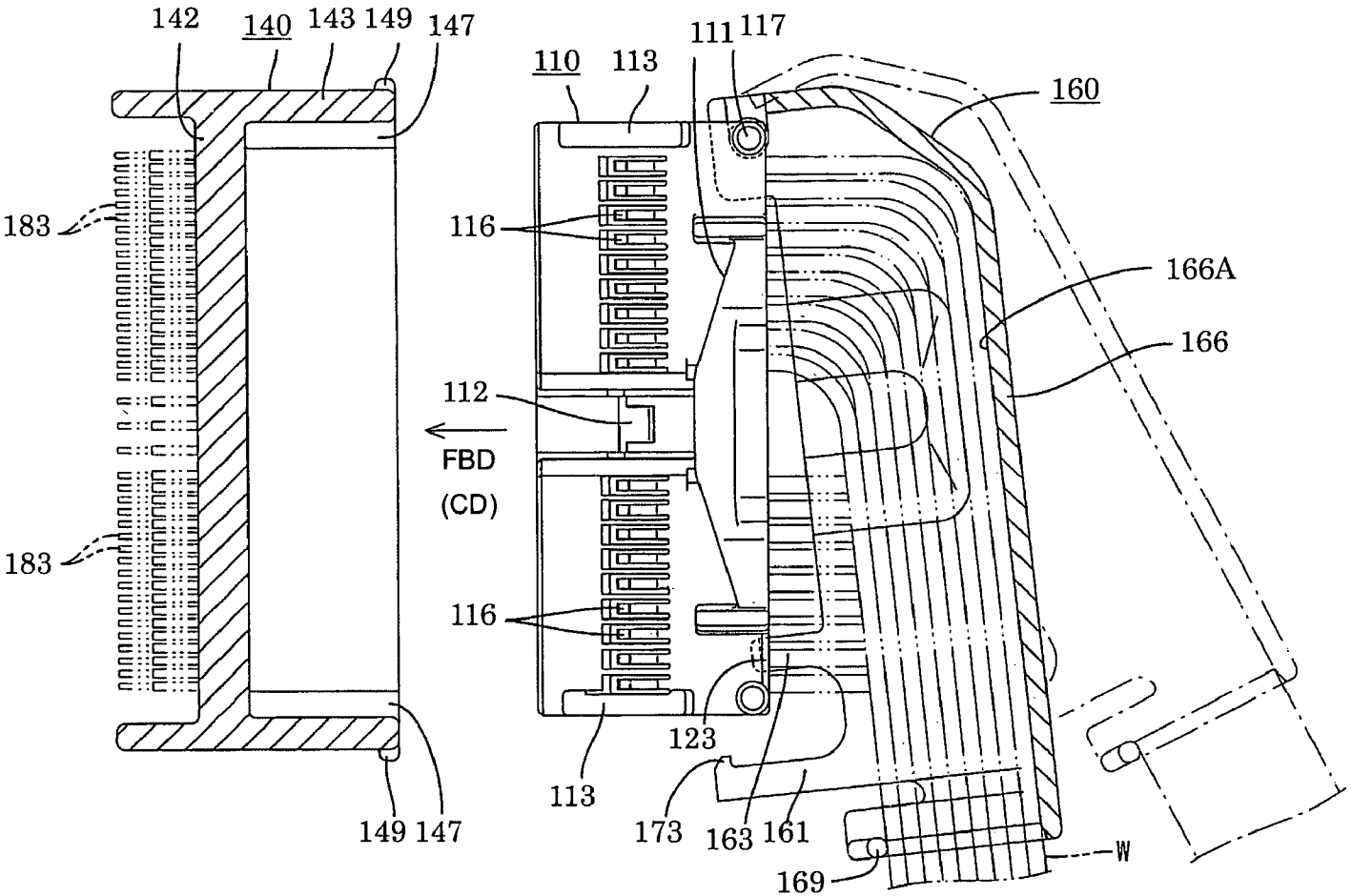
FIG. 27 is an exploded horizontal section before the housings are connected.
Figure 28:
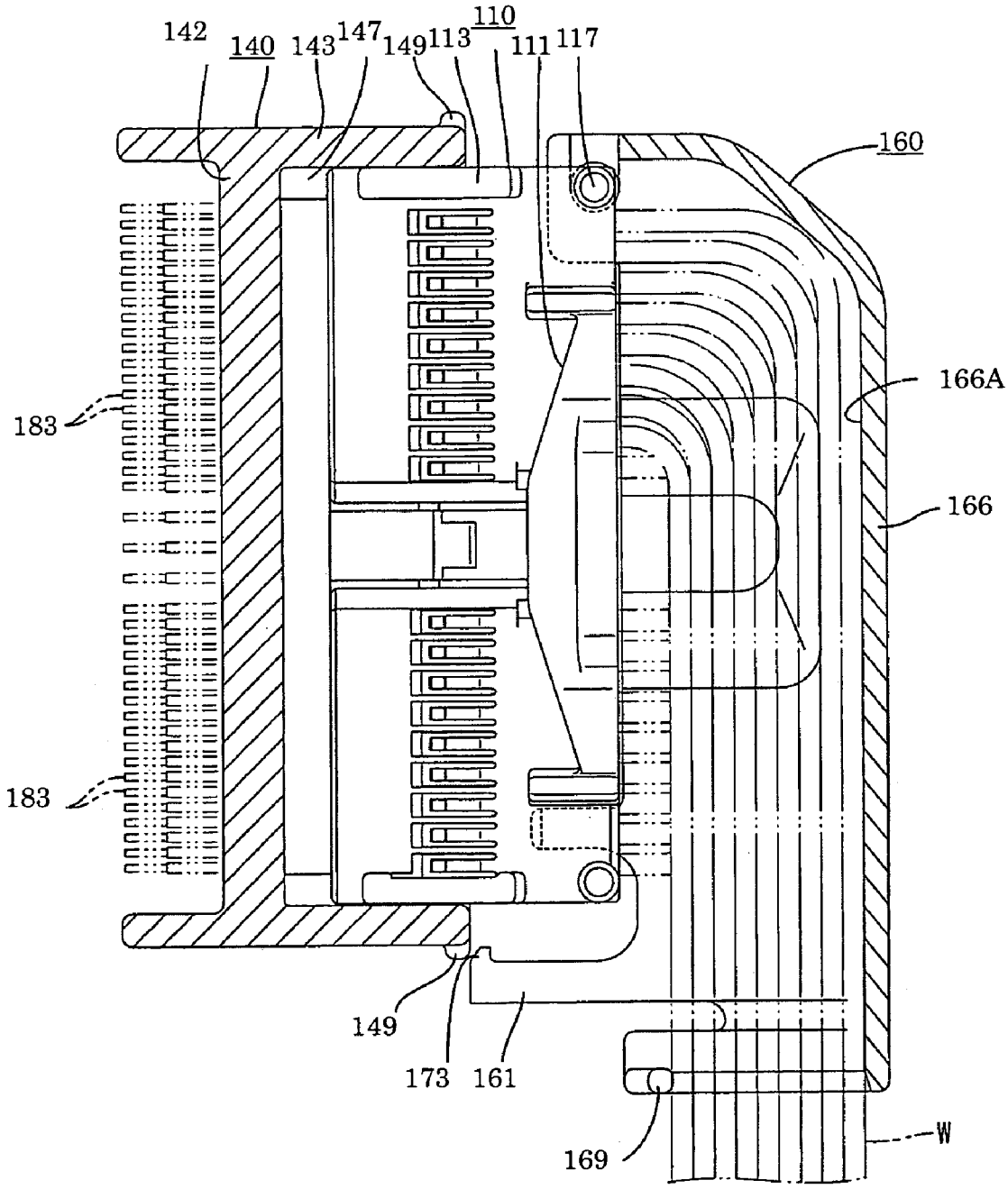
FIG. 28 is a horizontal section showing an intermediate state of the connection of the two housings
Figure 31:
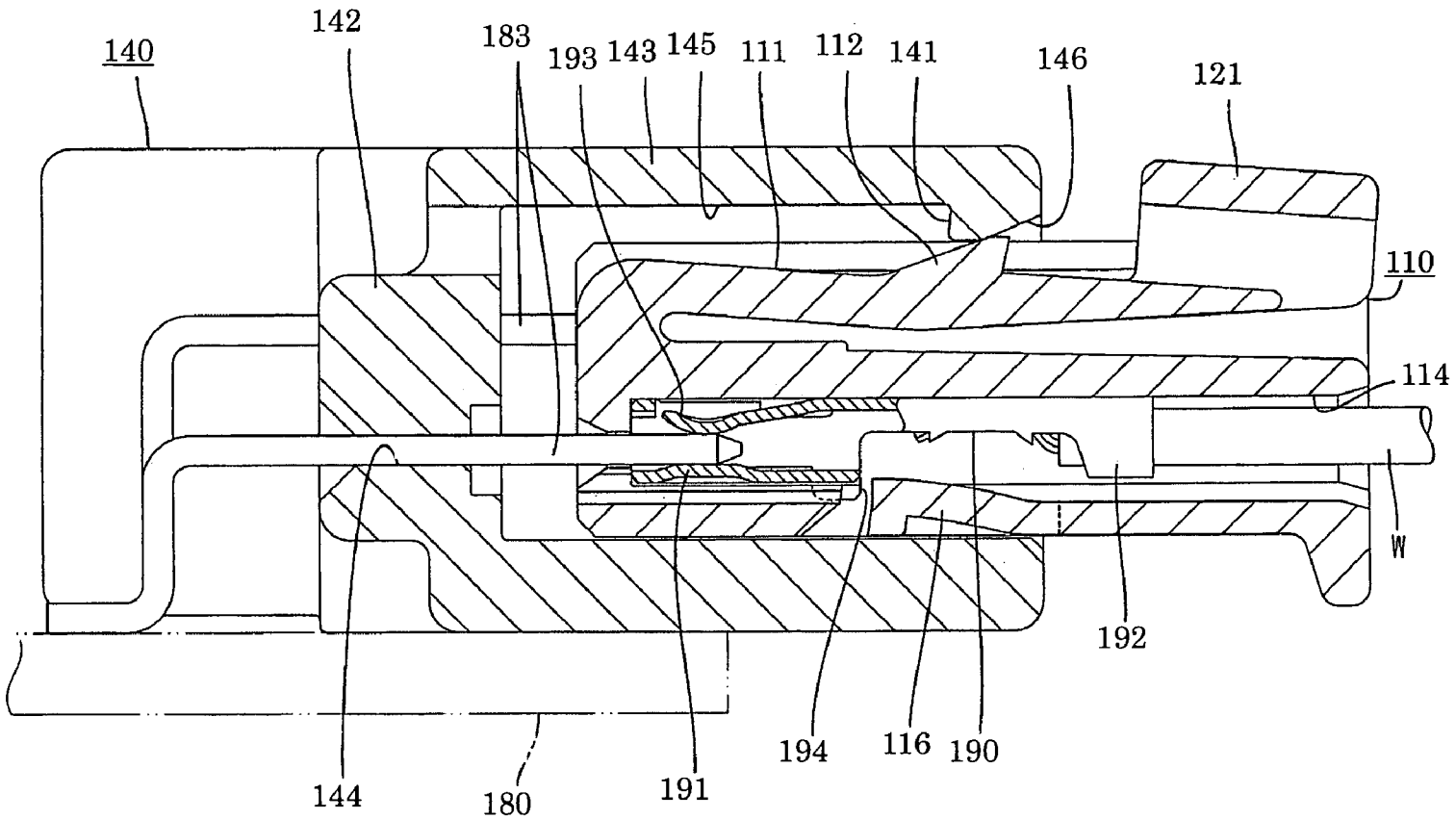
FIG. 31 is a side view in section showing the intermediate state of the connection of the two housings.
Figure 32:
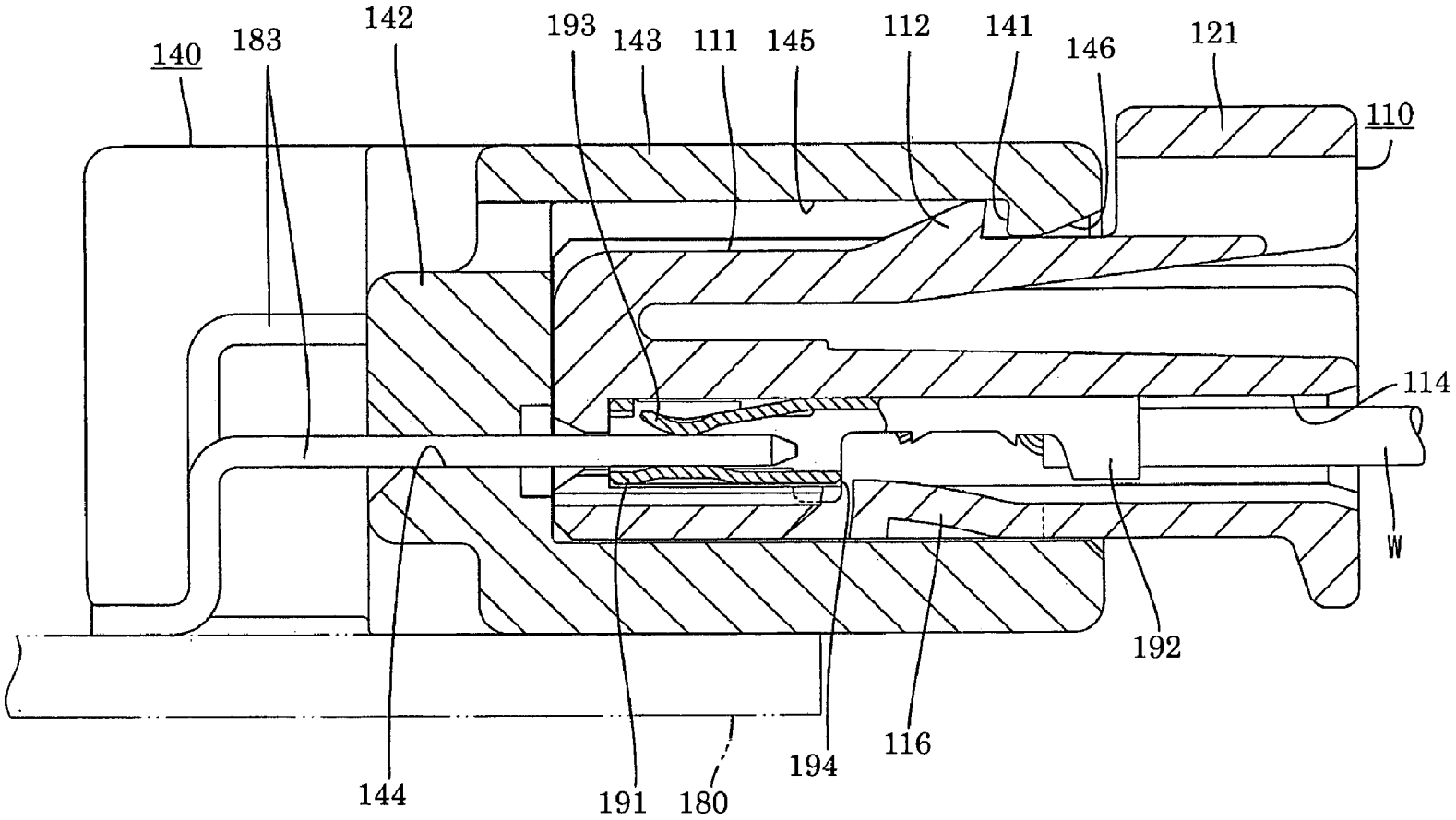
FIG. 32 is a side view in section showing the housings connected.

The properly oriented female housing 110 is fit into the receptacle 143 of the male housing 140 along the connecting direction CD, as shown in FIG. 27. Thus, the ribs 113 enter the guiding grooves 147, as shown in FIG. 28. The lock 112 of the lock arm 111 slides against the engaging portion 141 when the female housing 110 is connected to a specified depth, as shown in FIG. 31. Thus, the lock arm 111 deforms toward the deformation space Q. The lock 112 enters the escaping recess 145 when the housings 110, 140 reach a properly connected position, and the lock arm 111 is restored resiliently so that the rear surface of the lock 112 engages the rear surface of the engaging portion 141 to hold the two housings 110, 140 together, as shown in FIG. 32. At this proper connection position, the tongues 193 of the female terminal fittings 190 are connected electrically with the male terminal fittings 183.

The locks 161 of the wire cover 160 are distanced from the engageable sections 149 of the male housing 140, as shown in FIG. 28, until the housings 110, 140 reach the proper connection position. Thus, there is no possibility of engaging the locks 161 with the engageable sections 149. Accordingly, the wire cover 160 is not mounted on the male housing 140 and is loosely movable towards the full locking position. Observation of this state confirms that the housings 110, 140 are not properly connected. Thus, the female housing is pushed 110 further.

Figure 29:
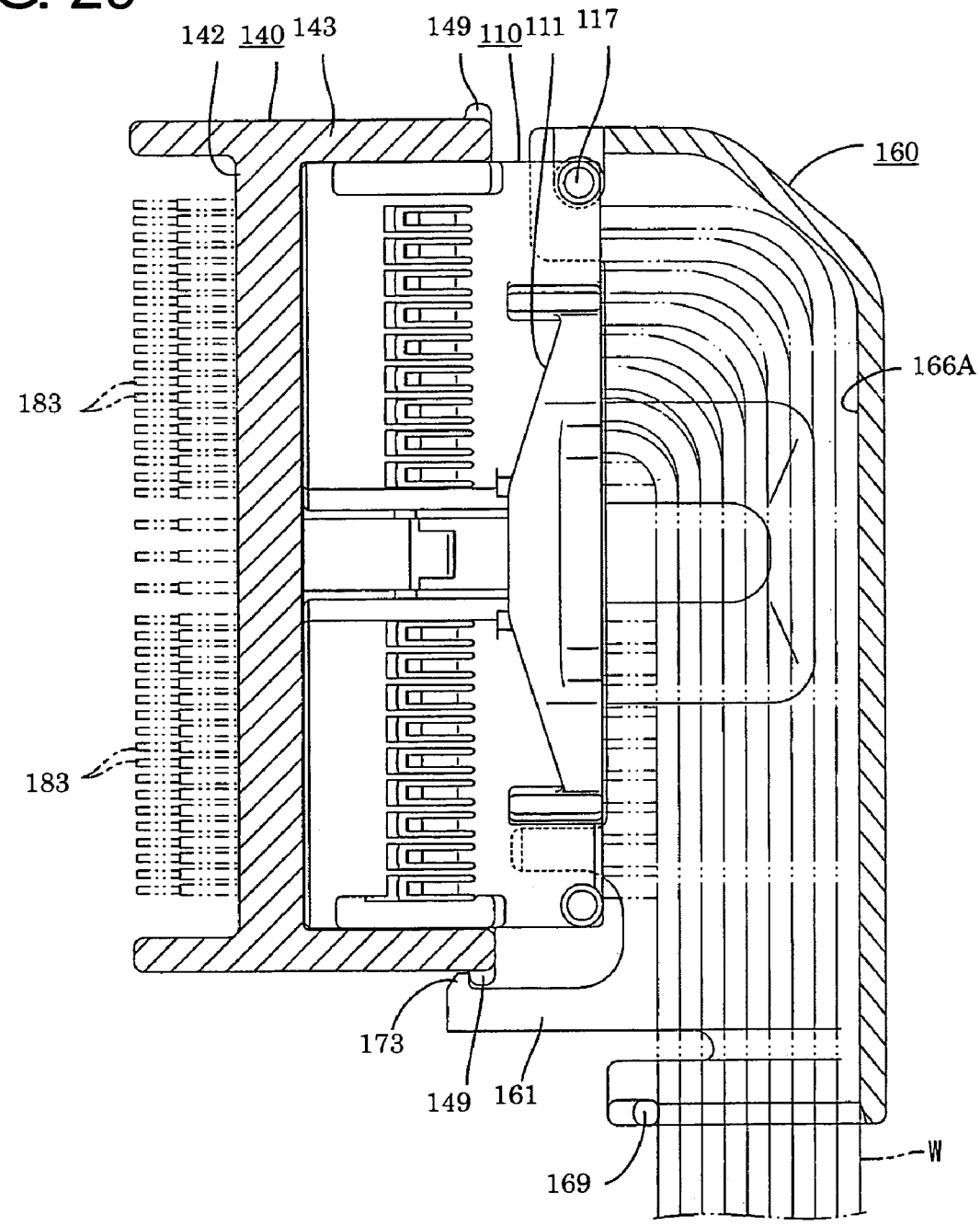
FIG. 29 is a horizontal section showing the two housings connected.

The locking protuberances 173 of the locks 161 of the wire cover 160 engage the engageable sections 149 of the male housing 140 when the housings 110, 140 approach the proper connection shown in FIG. 29. The locking protuberances 173 then slide in contact with the engageable sections 149 to deform the locks 161. The locks 161 resiliently restore when the locking protuberances 173 pass the engageable sections 149. Thus, the locking protuberances 173 engage the rear surfaces of the engageable sections 149. At this full locking position, the wire cover 160 is mounted on the male housing 140 and closes the rear end surface 110A of the female housing 110. A visual observation of this state confirms proper connection of the housings 110, 140.

The female housing 110 may have to be separated from the male housing 140 for maintenance. Thus, the pressable portion 121 is pressed from above to deform the lock arm 111 towards the female housing 110 (see FIG. 31). The pressable portion 121 is displaced towards the deformation space Q with opposite widthwise ends thereof as the base ends and the lock 112 comes out of the escaping recess 145. The female housing 110 is separated from the male housing 140 by pulling the female housing 110 backward in this state.

As described above, the locks 161 are distanced from the engageable sections 149 until the housings 110, 140 reach the proper connection position. Thus, the two housings 110, 140 are judged to be connected improperly since the wire cover 160 cannot be mounted on the male housing 140. On the other hand, with the two housings 110, 120 properly connected, the locks 161 engage the engageable sections 149 to permit the wire cover 160 to be mounted on the male housing 140 while closing the rear end surface 110A of the female housing 110. Thus, proper connection of the housings 110, 140 can be judged. In other words, the connected state of the housings 110, 140 can be detected easily by visually confirming the open or closed state of the wire cover 160. There is no need for a separate connection detecting member, thereby reducing the number of parts.

The wire cover 160 is displaceable between the full locking position and the partial locking position, and the respective wires W are drawn out along the inner surface 166A of the rear wall 166 of the wire cover 160 at the partial locking position. Thus, by leaving the wire cover 160 at the partial locking position prior to the connection of the two housings 110, 140, the respective wires W can be aligned in a specified direction and the two housings 110, 140 can be connected without being hindered by the wires W.

The wire cover 160 is rotatable about the shafts 117 relative to the female housing 110, and the wires W are bent in the direction along the inner surface 166A of the rear wall 166 of the wire cover 160 as the wire cover 160 is rotated. Thus, the wires W can be bent more easily than if the wire cover was a separate member mounted on the female housing 110 from behind. Further, the wire cover is pushed back towards the partial locking position by the accumulated counteracting forces of the bent wires W, if rotational of the wire cover 160 is stopped before the full locking position. In this way, incomplete connection of the housings 110 140 is detected more clearly.

A fourth embodiment of the invention is described with reference to FIGS. 33 to 40. The fourth embodiment differs from the third embodiment in that the connection of the two housings 110, 140 can be detected between the female housing 110 and the wire cover 160 mounted on the female housing 110. The fourth embodiment has parts structurally common to the third embodiment. Similar or identical parts are not described again, and merely are identified by the same reference numerals.

Figure 33:
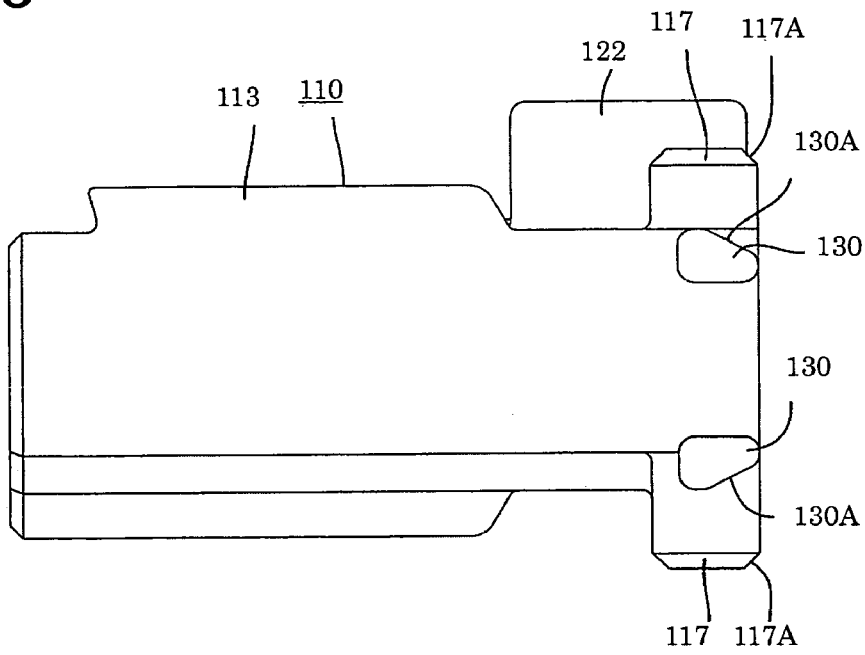
FIG. 33 is a side view of a female housing of a fourth embodiment.

A locking construction for the wire cover 160 of the fourth embodiment is provided on the female housing 110. More specifically, as shown in FIG. 33, the female housing 110 has two engaging portions 130 that bulge out from the opposite upper and lower ends of the rear end edge of one side surface. Guiding surfaces 130A are formed at the front surfaces of engaging portions 130.

Figure 34:
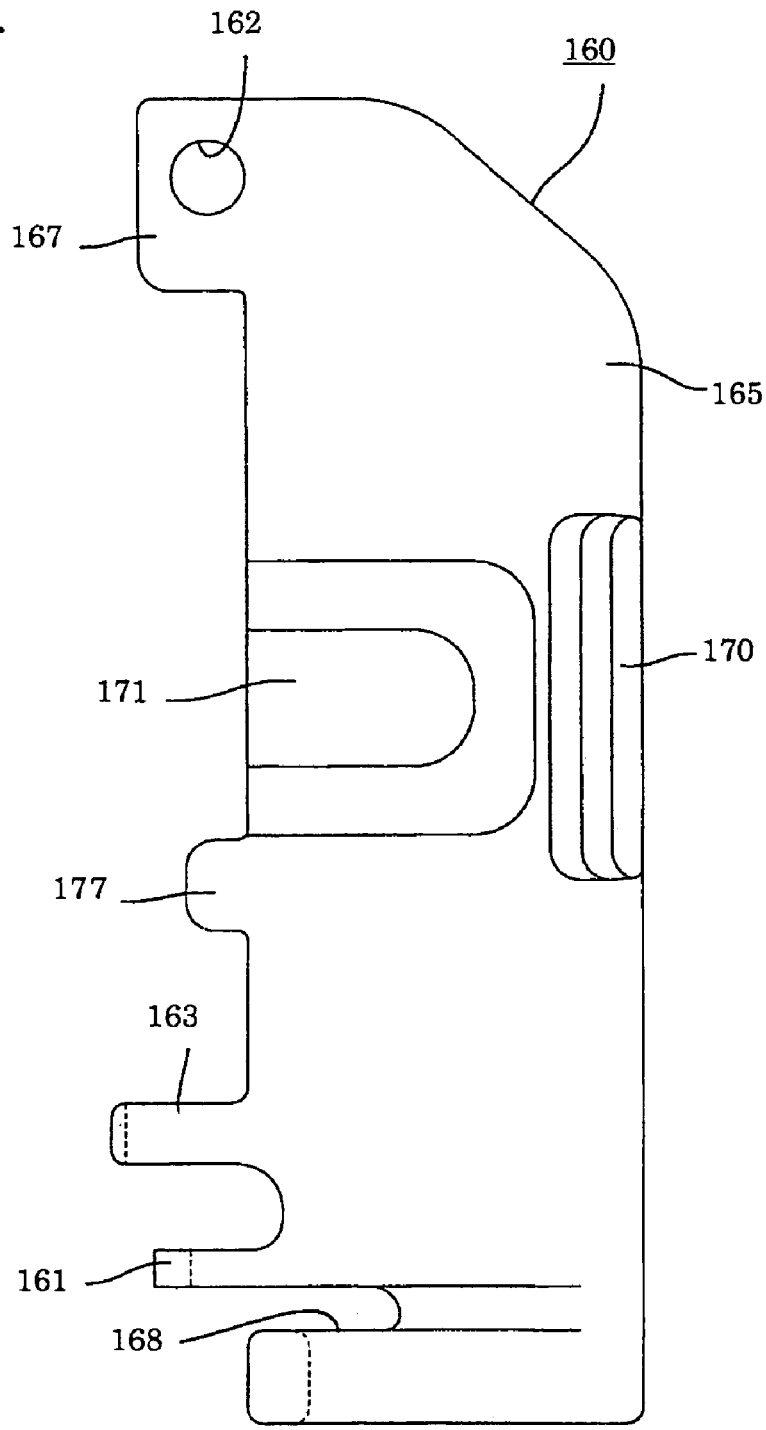
FIG. 34 is a plan view of a wire cover.
Figure 35:
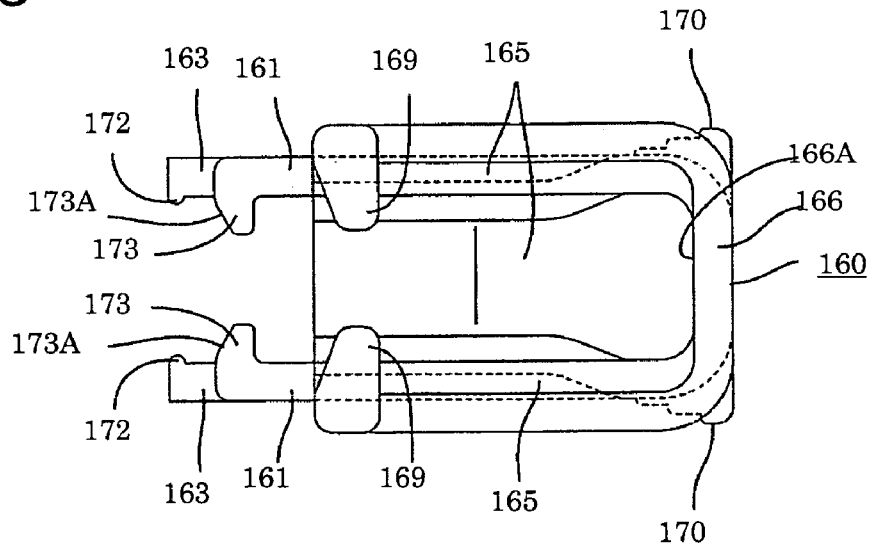
FIG. 35 is a side view of the wire cover.

As shown in FIG. 34, locking sections 161 project forward from the front end edge of the wire cover 160 near the other end, and are shorter than and substantially in parallel to the partial locks 163. A locking protuberance 173 projects in from the projecting end of each lock 161, and has a guidable surface 173A for sliding contact with a corresponding guiding surface 130A of the corresponding engageable section 149 as shown in FIG. 35.

Projecting pieces 177 project forward from the front end edge of the wire cover 160. The projecting pieces 177 are wider than the partial locks 163 and shorter than the locks 161 and are insertable into the deformation space Q of the female housing 110 when the wire cover 160 reaches a full locking position.

Figure 36:
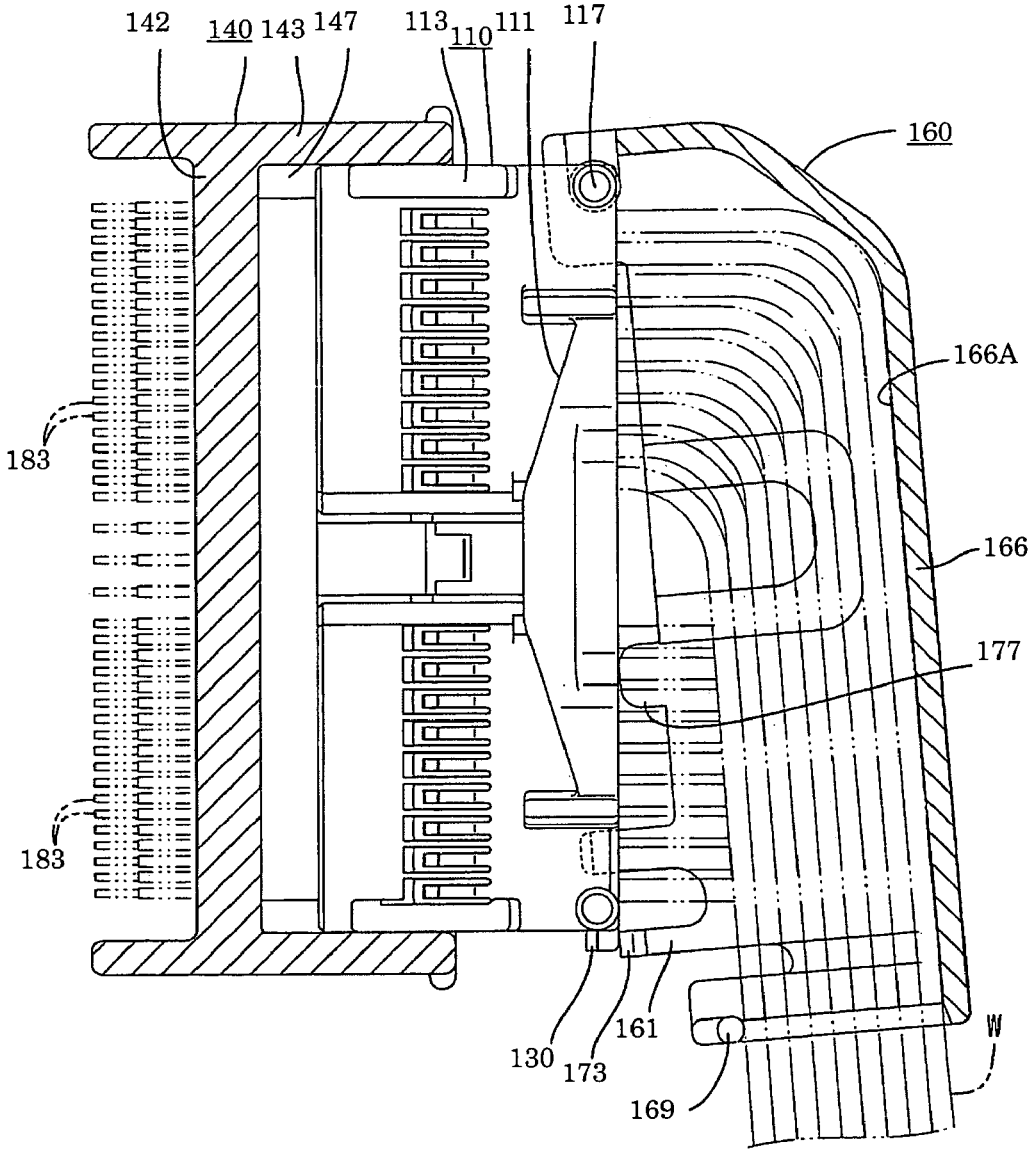
FIG. 36 is a horizontal section showing an intermediate state of the connection of the two housings.
Figure 37:
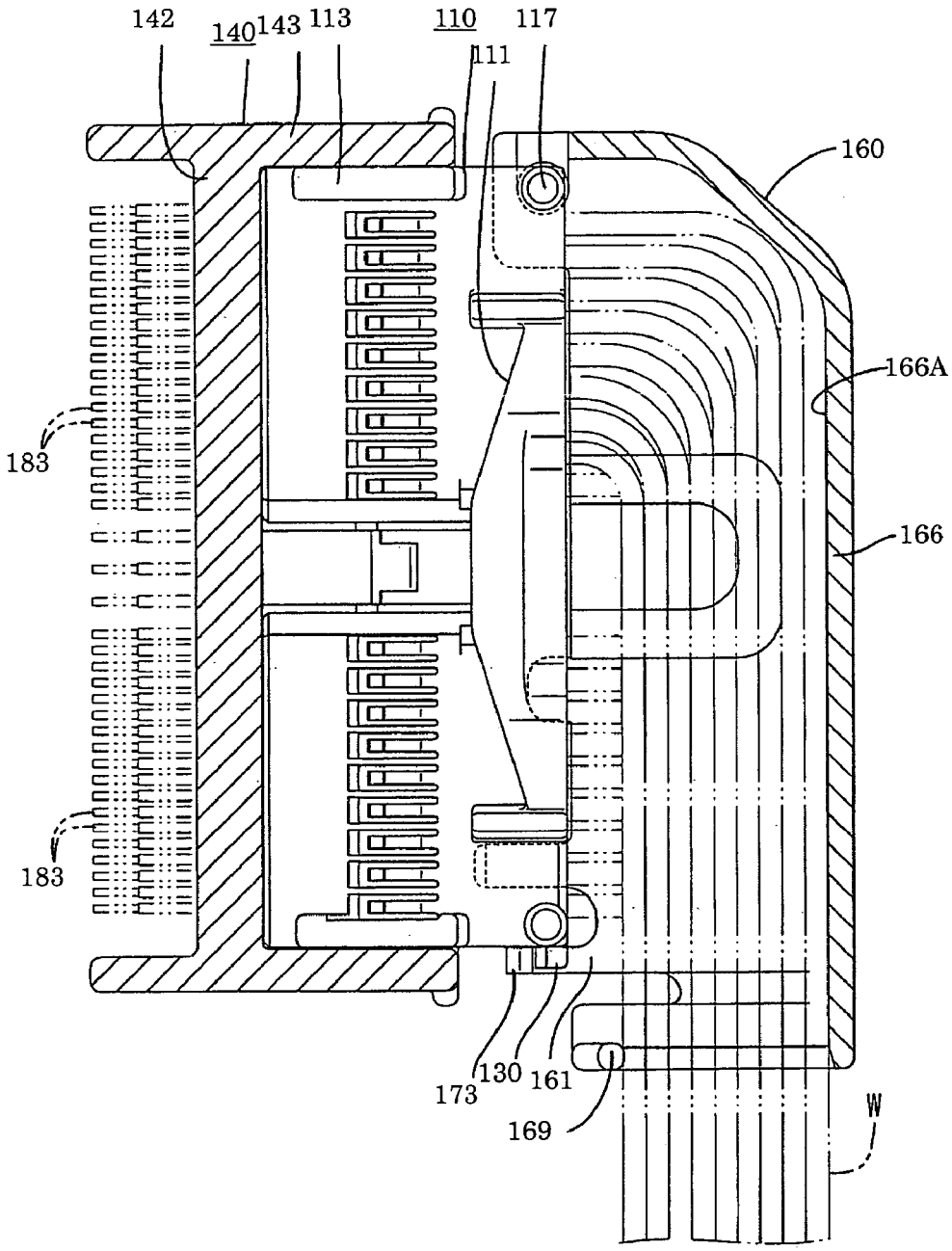
FIG. 37 is a horizontal section showing the two housings connected.
Figure 38:
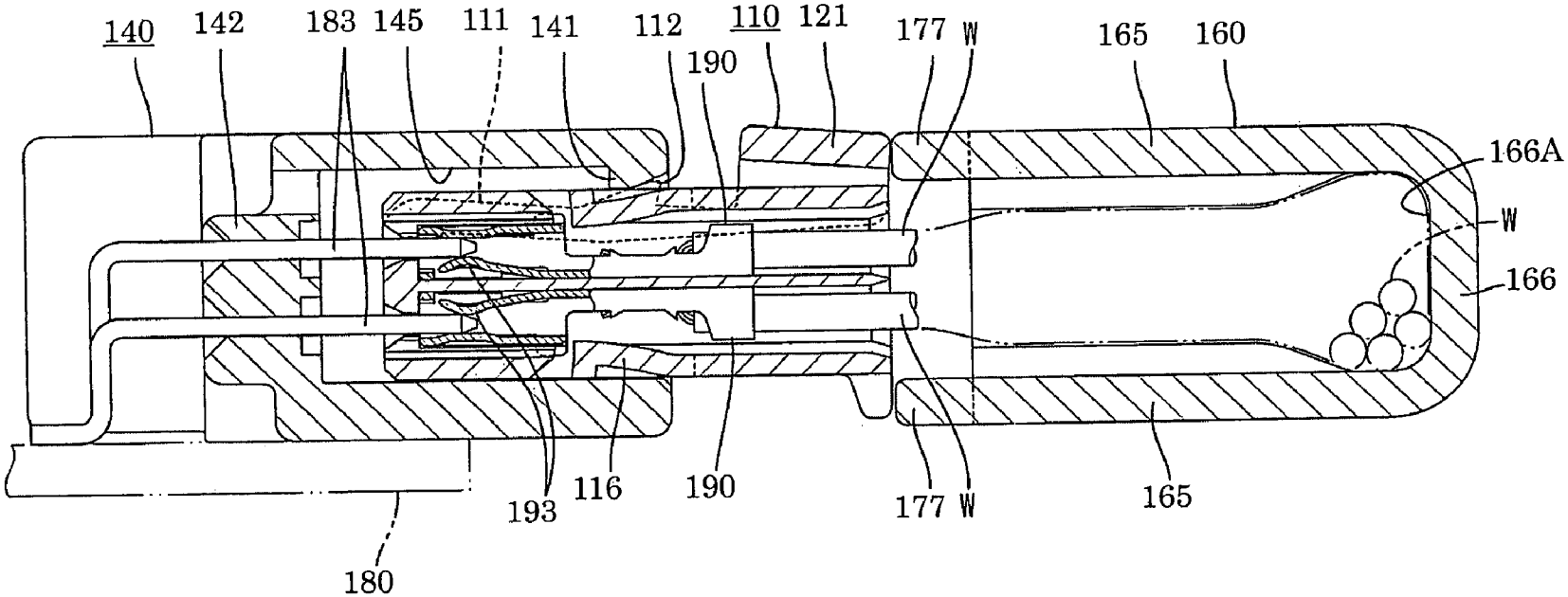
FIG. 38 is a side view in section showing the intermediate state of the connection of the two housings.

As shown in FIG. 36, an attempt could be made to connect female housing 110 with the male housing 140 while the wire cover 160 is at the partial locking position. However, the lock 112 of the lock arm 111 of the female housing 110 will slide in contact with the engaging portion 141 of the male housing 140 to deform the lock arm 111 towards the deformation space Q, as shown in FIG. 38. An attempt could be made to rotate the wire cover 160 toward the full locking position in this state. However, the projecting pieces 177 will contact the pressable portion 121 of the lock arm 111 to hinder further rotation. Therefore, the wire cover 160 cannot reach the full locking position.

Figure 39:
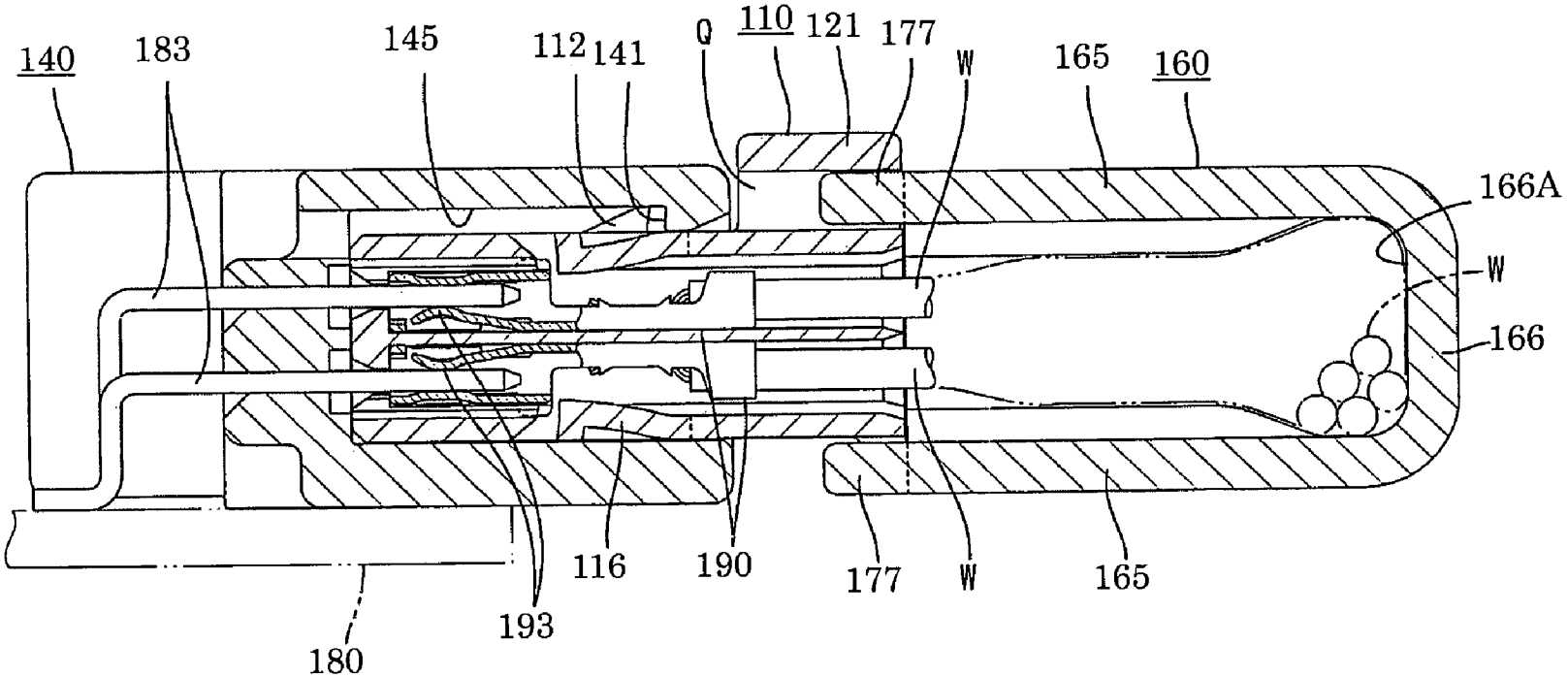
FIG. 39 is a side view in section of the two connected housings.
Figure 40:
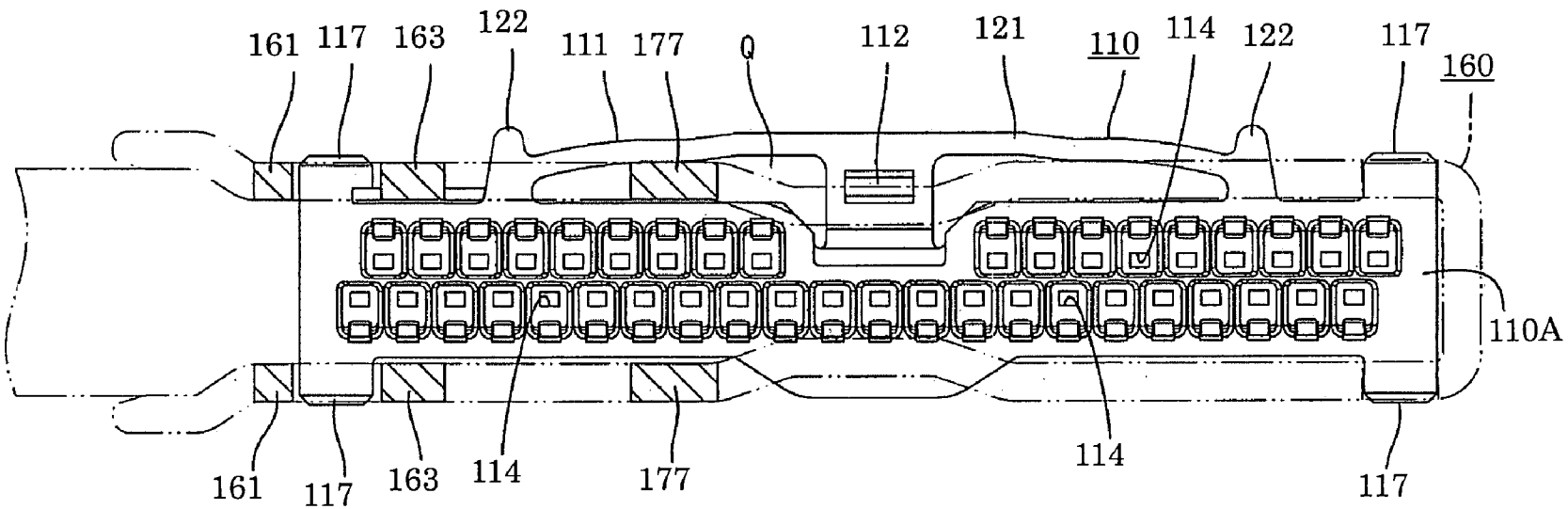
FIG. 40 is a rear view of the female housing having the wire cover left at a full locking or second position.

The lock 112 of the lock arm 111 passes the engaging portion 141 as the connection of the housings 110, 140 progresses. The lock 112 then engages the rear surface of the engaging portion 141 to connect the two housings 110, 140. The lock arm 111 is restored resiliently towards its initial posture and comes out of the deformation space Q at the proper connection position, as shown in FIGS. 39 and 40. Thus, the projecting pieces 177 can enter the deformation space Q and the wire cover 160 can be rotated to the full locking position. The locks 161 engage the engageable sections 149 of the female housing 110 to prevent rotation of the wire cover 160 from the position where the wire cover 160 closes the rear end 110A of the female housing 110.

According to the fourth embodiment, the projecting pieces 177 on the wire cover 160 cannot enter the deformation space Q when the lock arm 111 is deformed into the deformation space Q. This situation exists only if the housings 110, 140 have not yet reached the proper connection position. In this way, incomplete connection of the housings 110, 140 can be judged. On the other hand, the lock arm 111 comes out of the deformation space Q when the housings 110, 140 are connected properly to permit entry of the projecting pieces 177 into the deformation space Q. The wire cover 160 closes the rear end surface 110A of the female housing 110 as the projecting pieces 177 enter into the deformation space Q. In this way, it can be judged that the two housings 110, 140 are connected properly. As a result, the connected state of the two housings 110, 140 can be detected by visually confirming the presence or absence of the projecting pieces 177 in the deformation space Q, i.e. the open or closed state of the wire cover 160. Thus, the connection detection is made merely by adding the projecting pieces 177 to a conventional wire cover, there are merits of easy production and better handling.

A fifth embodiment is described with reference to FIGS. 18 to 23 and 41 to 49. A connector of this embodiment differs from the connectors according to the third and fourth embodiments by the inclusion of resin springs 178 on the wire cover 160. Other parts of the fifth embodiment, however, are substantially the same as the third and fourth embodiments. These similar elements are identified by the same reference numerals, but are not described again.

Figure 41:
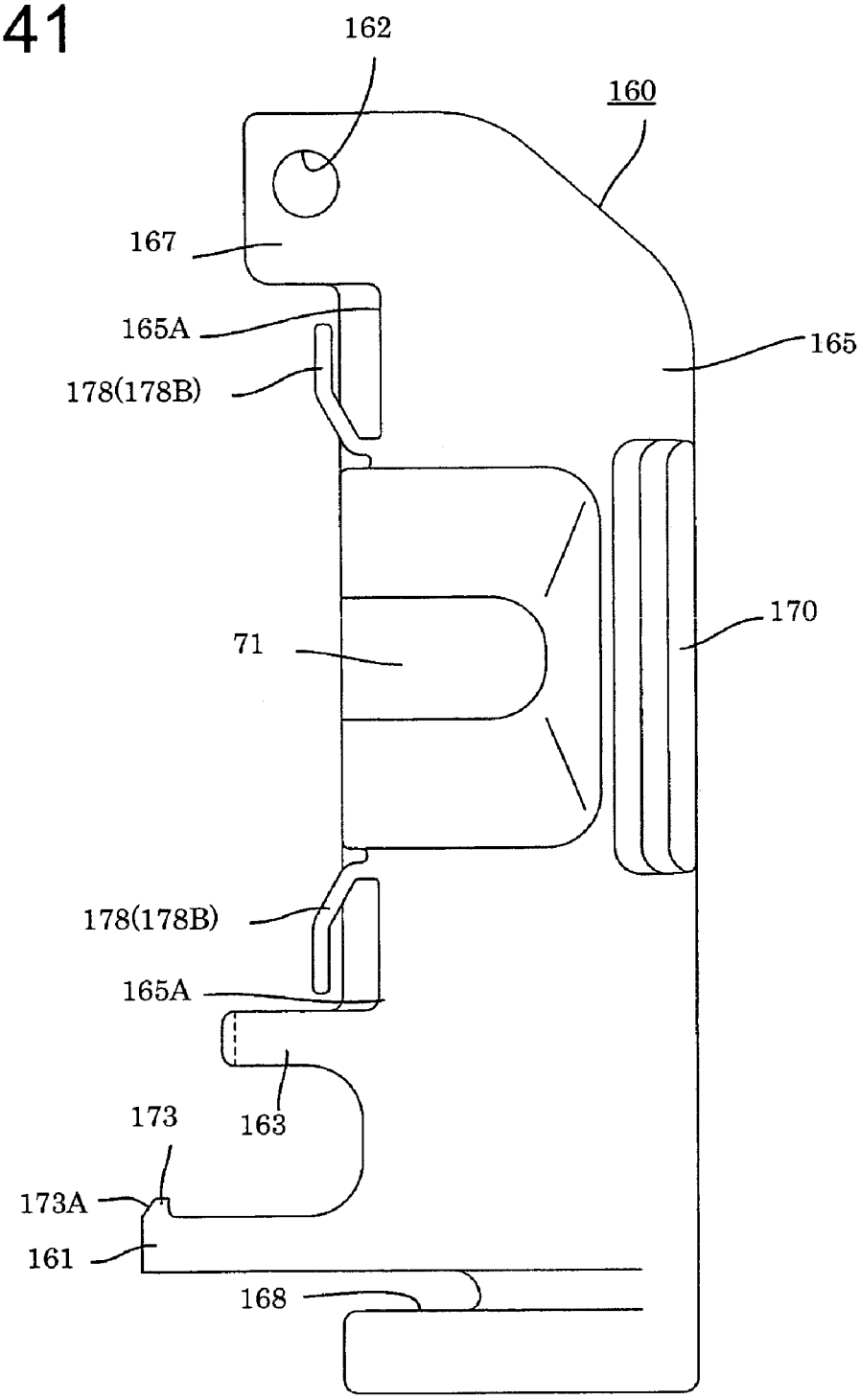
FIG. 41 is a plan view of a wire cover of a sixth embodiment.
Figure 42:
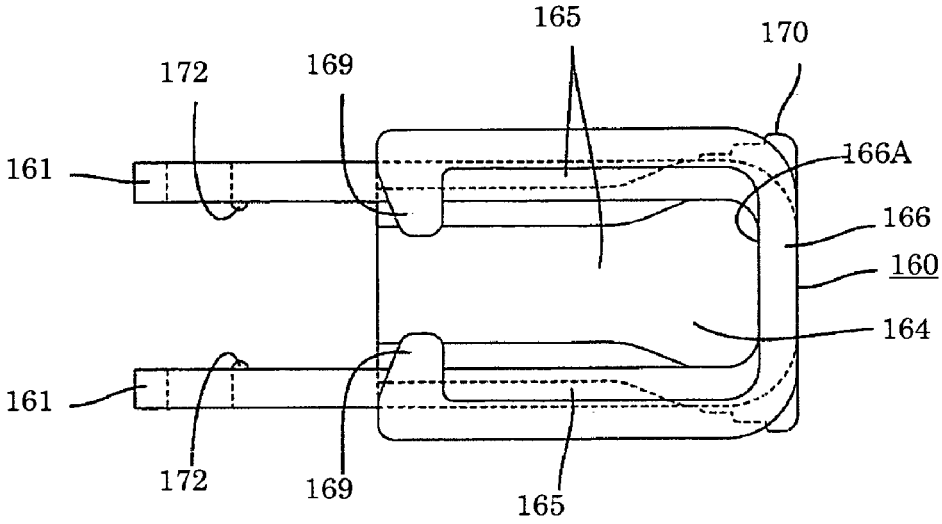
FIG. 42 is a side view of the wire cover.
Figure 43:
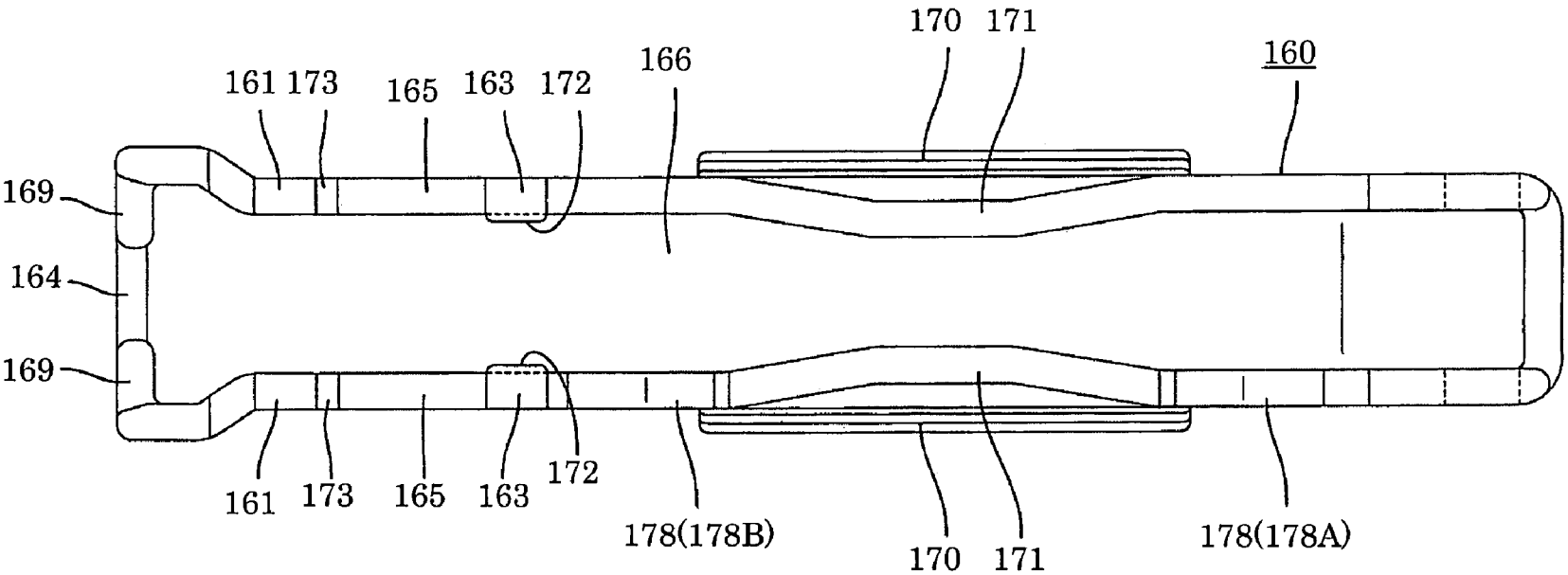
FIG. 43 is a front view of the wire cover.
Figure 44:
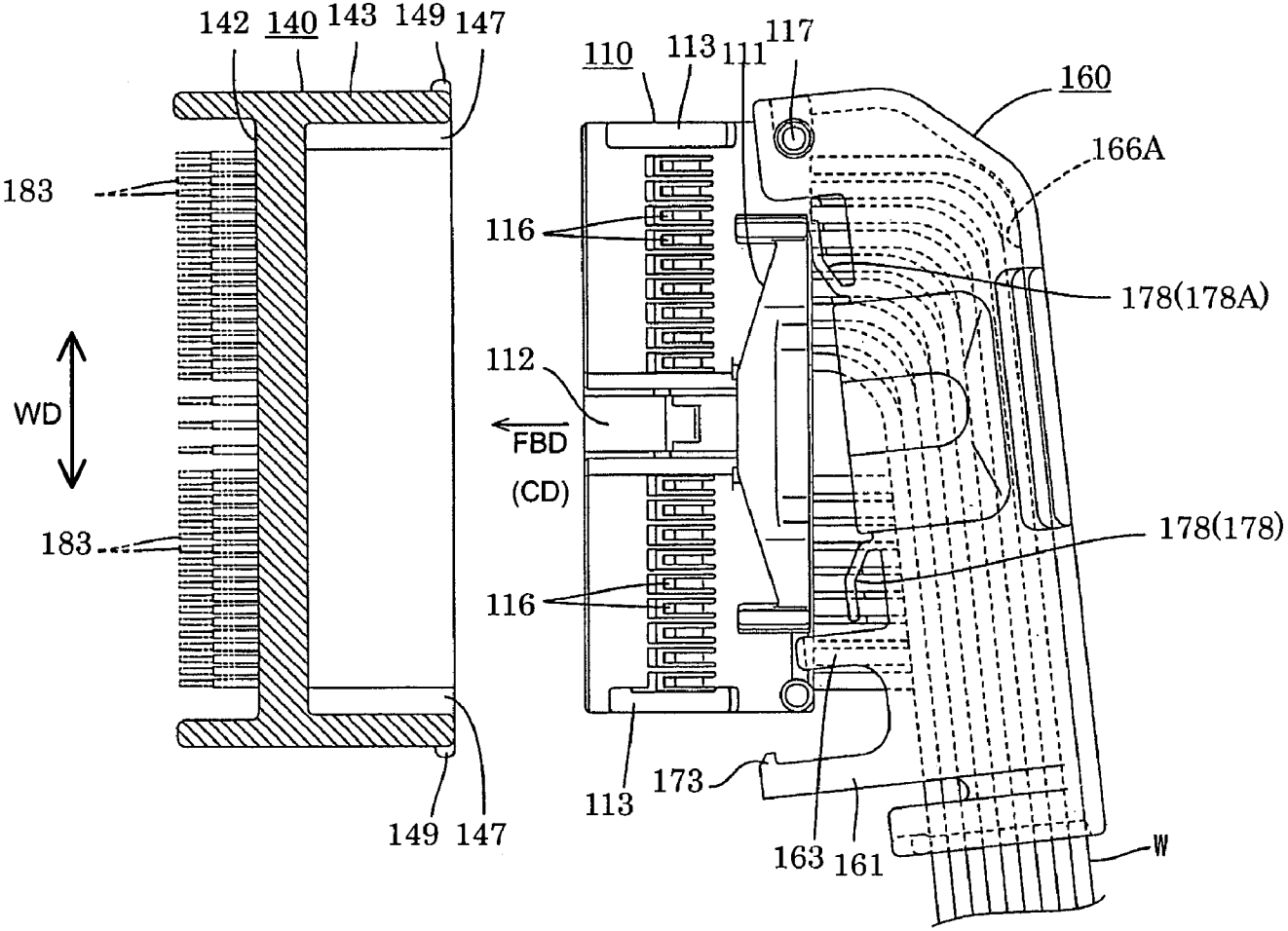
FIG. 44 is an exploded horizontal section showing a state before the two housings are connected.
Figure 45:
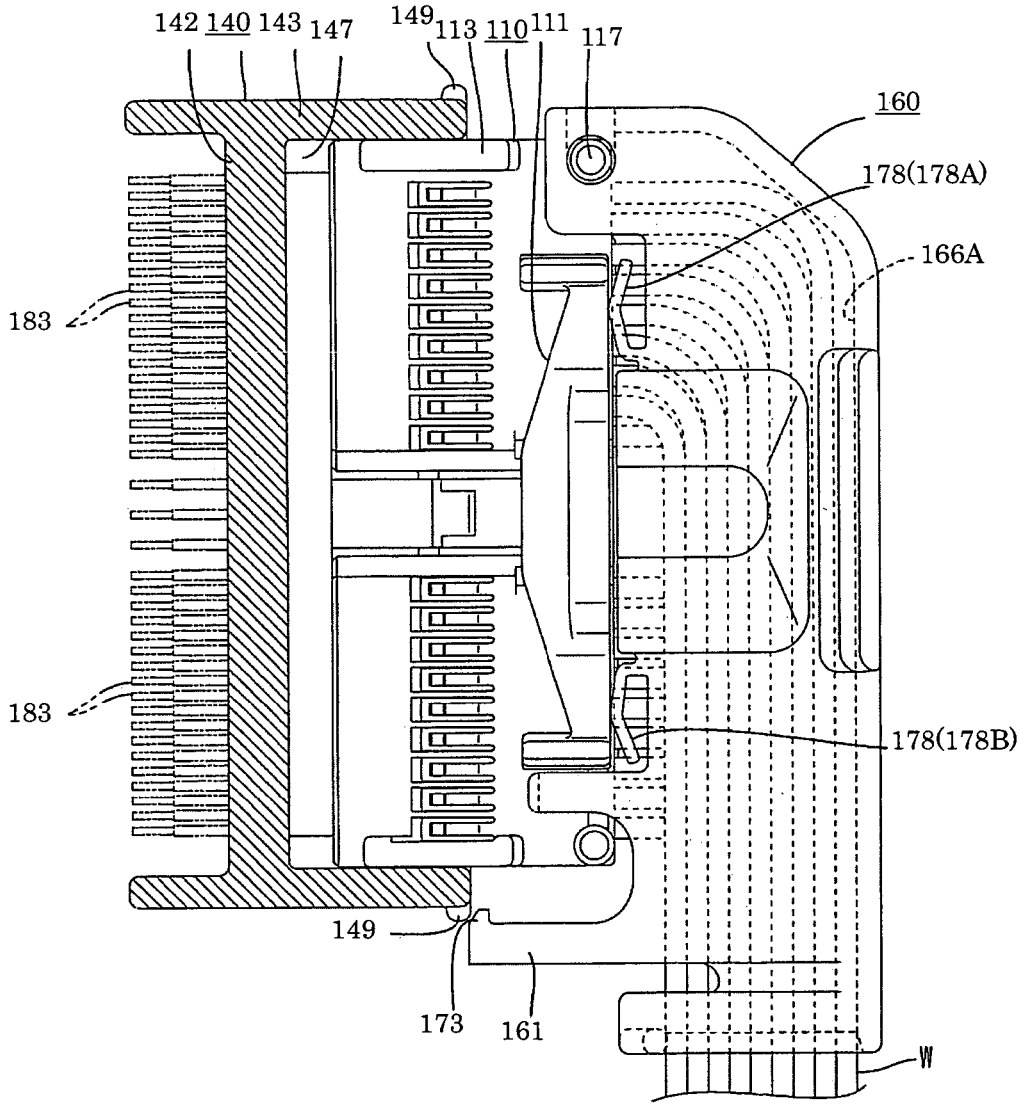
FIG. 45 is a horizontal section showing an intermediate state of the connection of the two housings.
Figure 46:
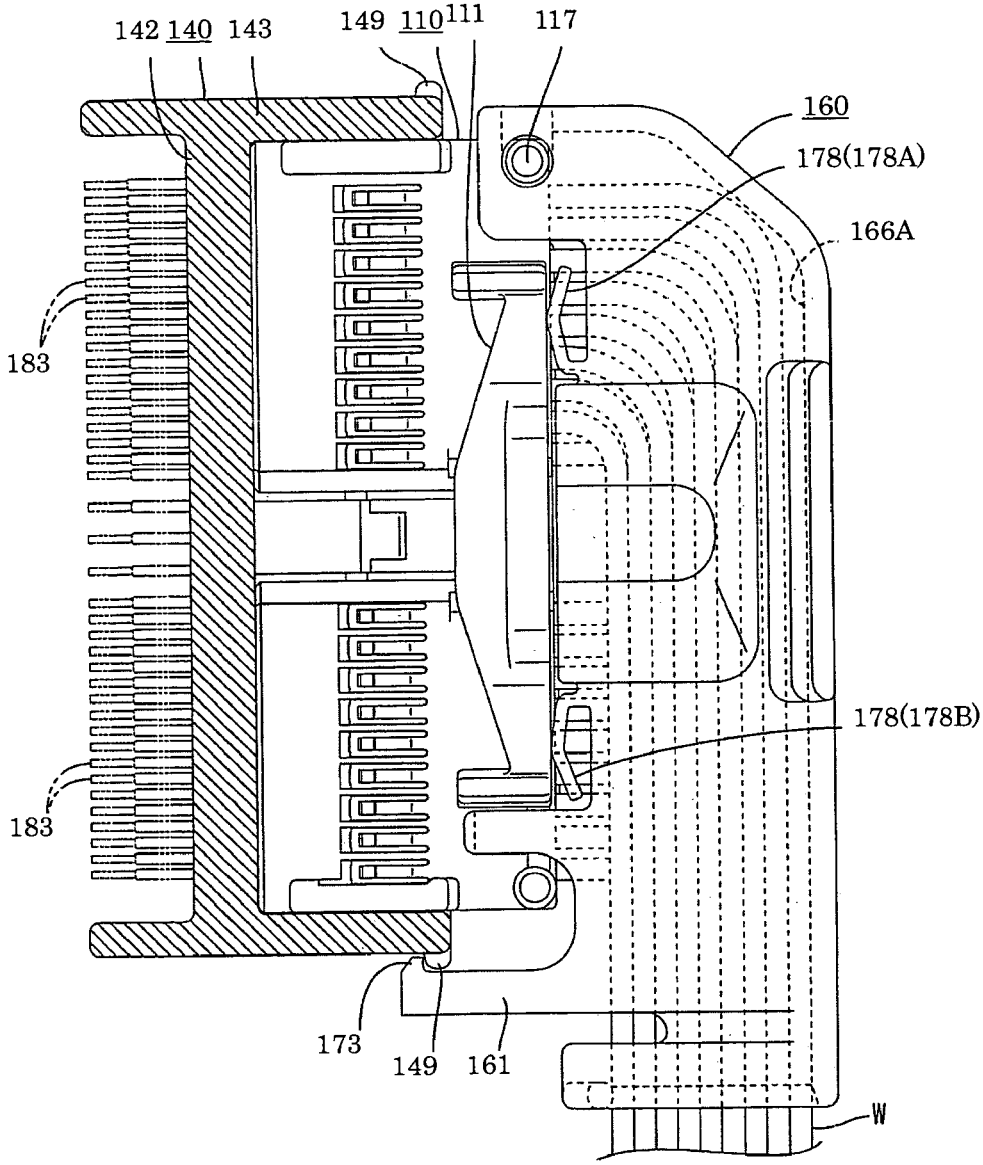
FIG. 46 is a horizontal section showing the two housings connected.
Figure 47:
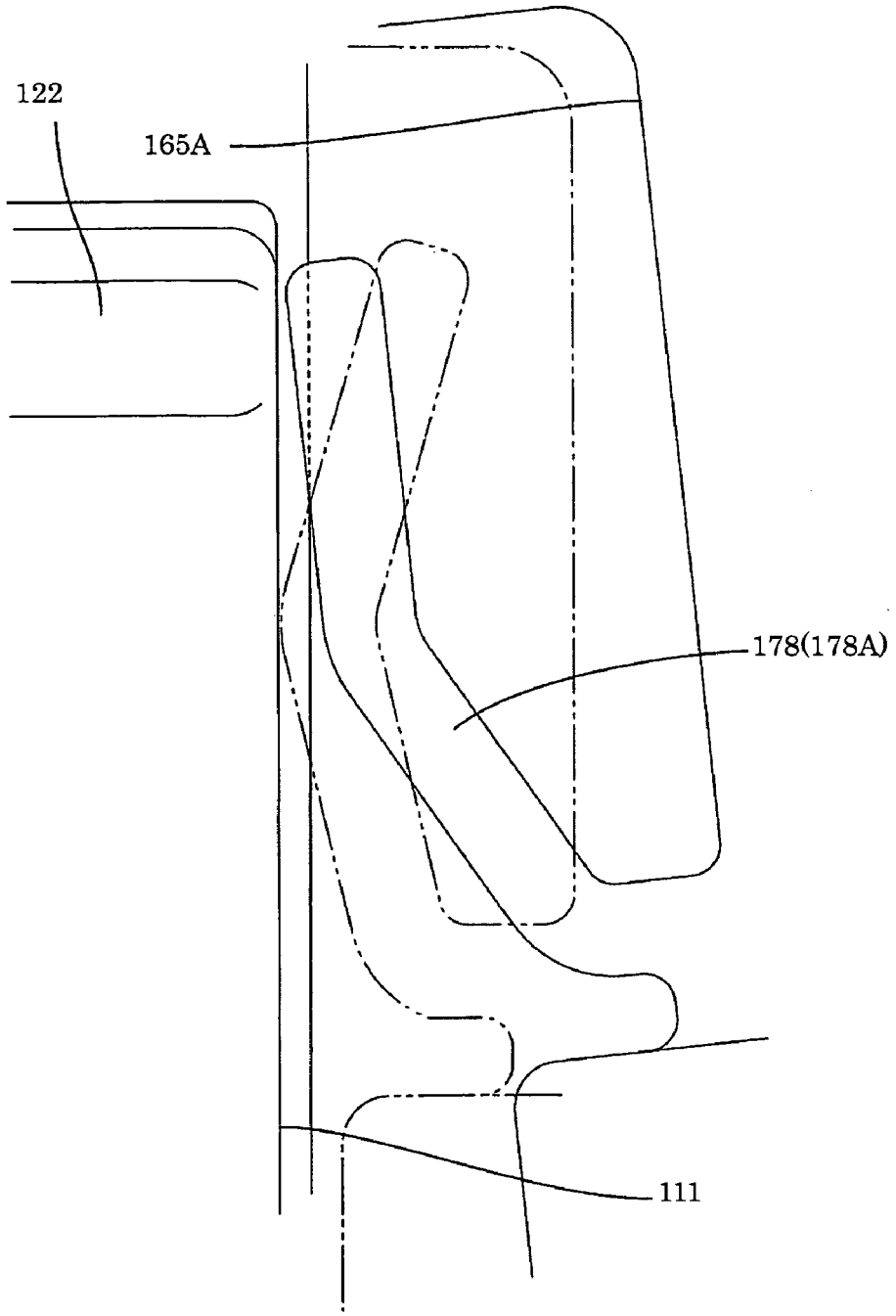
FIG. 47 is an enlarged plan view of an essential portion showing a resin spring when the wire cover is at a partial locking or first position.
Figure 48:
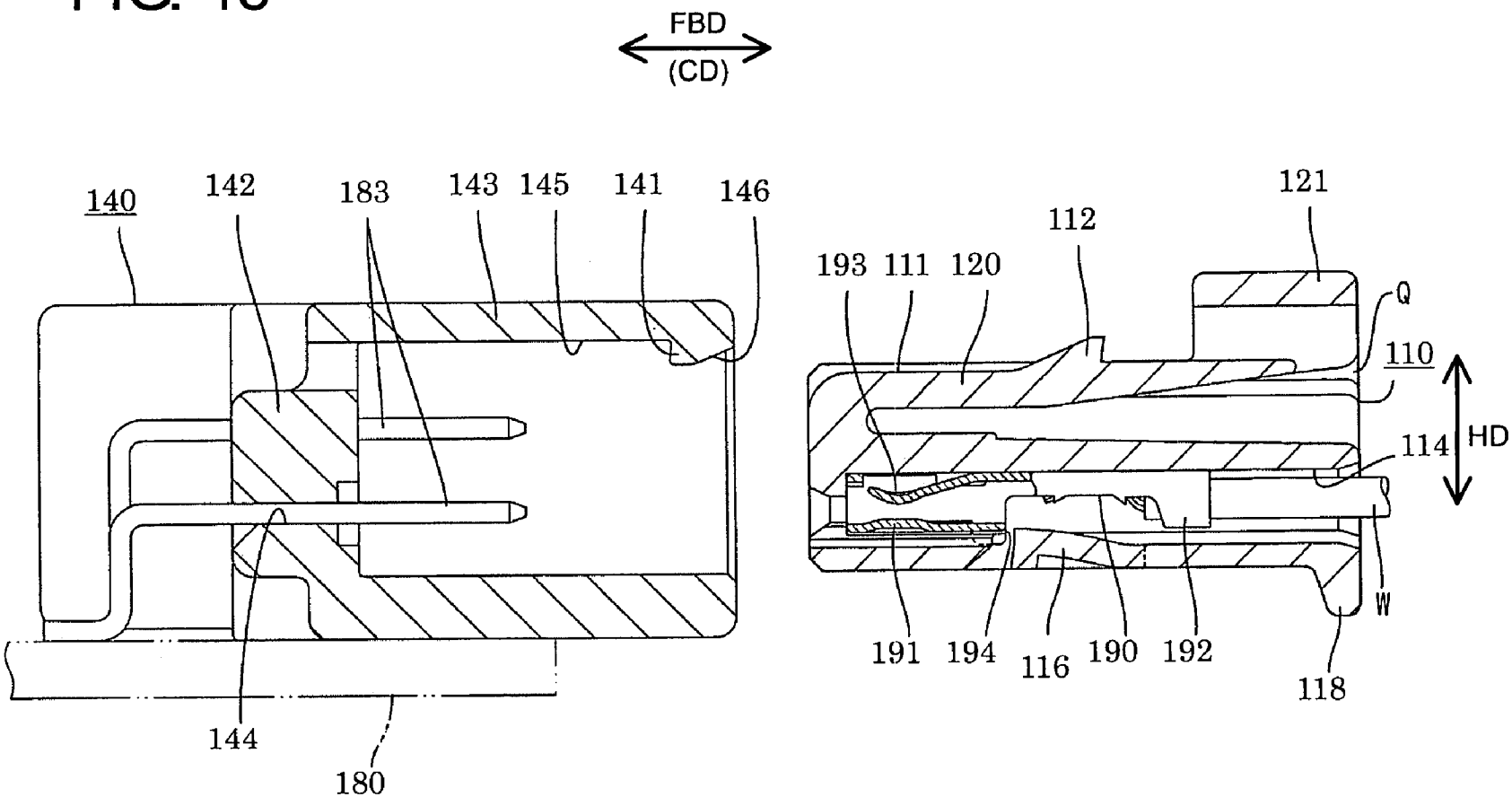
FIG. 48 is an exploded side view in section showing the state before the two housings are connected.
Figure 49:
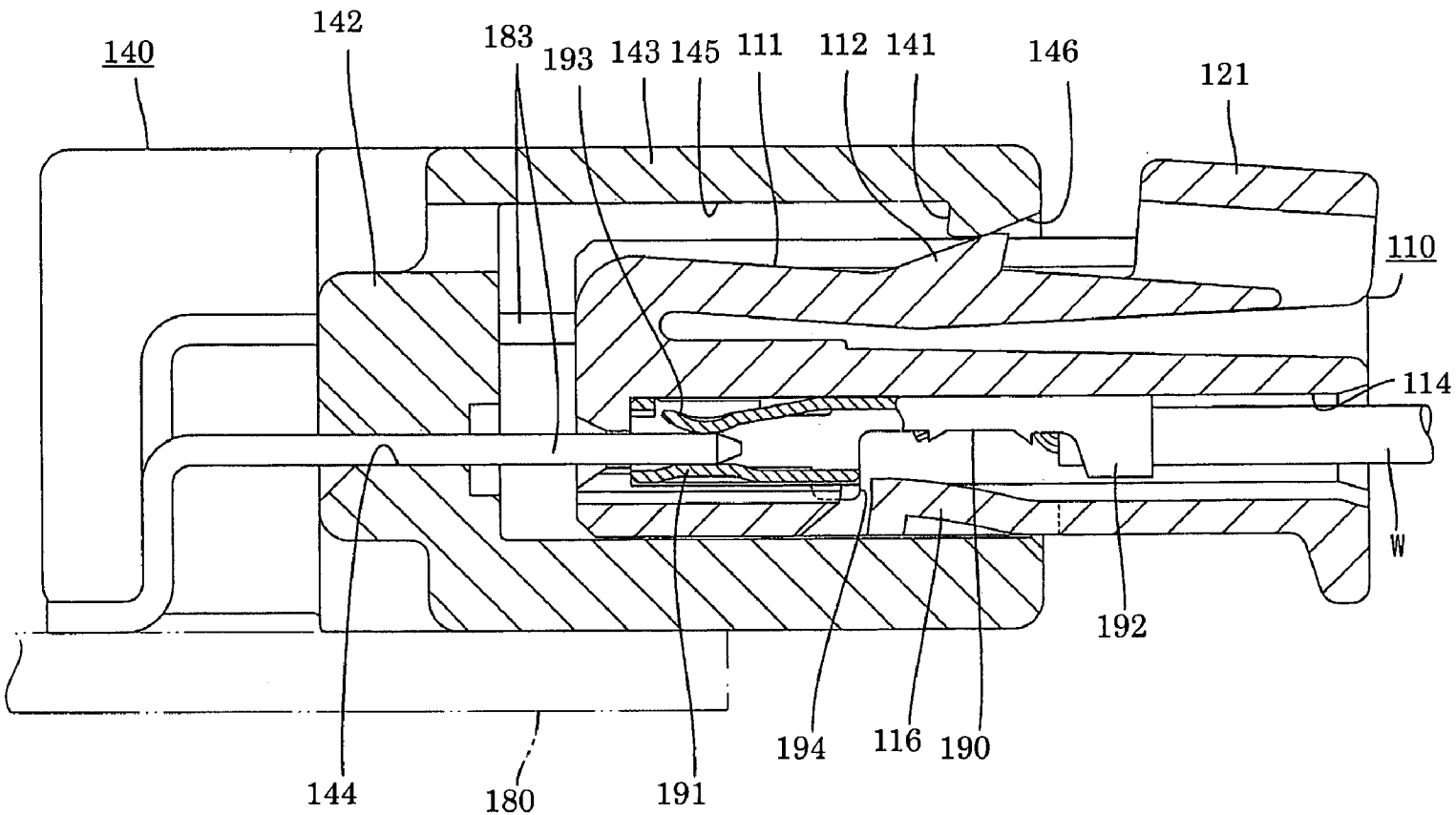
FIG. 49 is a side view in section showing the intermediate state of the connection of the two housings.

The wire cover 160 of the fifth embodiment is illustrated most clearly in FIGS. 41 to 43, and differs from the third and fourth embodiments by the inclusion of a recessed front end edge 165A on one of the two opposed parallel side walls 165. First and second resiliently deformable resin springs 178A and 178B are cantilevered from opposite ends of this recessed front end edge 165A. The first resin spring 178A has a base end that extends obliquely forward from the edge. An intermediate portion of the first resin spring 178A extends substantially parallel to the front end edge 165A when the first resin spring 178A is unbiased. The extending end of the first resin spring 178A extends towards the shaft receiving hole 162. The second resin spring 178B has substantially the same shape as the first resin spring 178A, but is cantilevered in the opposite direction and towards the partial lock 163. Thus, the resin springs 178A, 178B extend to widen the spacing therebetween as they extend from their base ends toward their free ends (see e.g. FIG. 41).

The resin springs 178 have substantially the same thickness as the sidewall 165, are arranged within the thickness range of the sidewall 165 and are resiliently deformable within the thickness range of the side wall 165. The resin springs 178 do not touch the female housing 110 when the wire cover 160 is at the partial locking position (see solid line of FIG. 47), but start touching the protrusions 122 of the female housing 110 on the way from the partial locking position to the full locking position. The protrusions 122 gradually incline the resin springs 178 as the wire cover 160 rotates. As a result, the resin springs accumulate biasing forces in returning direction, i.e. toward the open position (see phantom line of FIG. 47). Therefore, the resin springs 178 push the wire cover 160 back in returning direction if the wire cover 160 is released before reaching the full locking position.

The connector of the fifth embodiment is assembled and used substantially the same as the connectors of the third and fourth embodiments. However, the resin springs 178 provide a clearer indication if the housings 110, 140 are not connected properly. The resin springs 178 are at positions away from the female housing 110 and are in their unbiased state without touching the female housing 110 substantially until the housings 110, 140 reach the proper connection position. The resin springs 178 then deform and accumulate biasing forces in returning direction of the wire cover 160 as the wire cover 160 is moved. The connecting operation could be stopped before the proper connection of the two housings 110, 140 due to an operator's misunderstanding or other reason. In this situation, the wire cover 160 is opened dynamically and returns due to the resilient restoring forces of the resin springs 178 because the wire cover 160 is not yet locked into the male housing 140.

The wires W are bent along the inner surface 166A of the rear wall 166 of the wire cover 160 at this stage, and the resilient restoring forces of the wires W resulting from the bending are added to those of the resin springs 178. As a result, the wire cover 160 is opened widely if the connection is stopped too soon. This opening movement of the wire cover 160 provides a clear indication that the housings 110, 140 are not connected properly. Thus, the two housings 110, 140 are connected properly by continuing the connecting operation and the wire cover 160 is locked into the male housing 140. Then, each resin spring 178 is bent and deformed into an angled shape having moderate inclinations as shown in phantom line of FIG. 47, and is kept with the tip thereof resiliently held in contact with the pressable portion 121 of the female housing 110.

As described above, the wire cover 160 has the resin springs 178 for accumulating biasing forces in returning direction in the wire cover 160 as the two housings 110, 140 move toward the proper connection position. The resilient restoring forces of the resin springs 178 open the wire cover 160 widely when the locks 161 and the engageable sections 149 are disengaged to provide a clear indication that the two housings 110, 140 are freed from the locked state. The opened state of the unlocked wire cover 160 is visually apparent when many connectors are arranged side by side.

The wire cover 160 is movable between the partial locking position and the full locking position, and the wire cover 160 is left at the partial locking position before the housings 110, 140 are connected properly connected. Thus, the wires W can be aligned in the specified direction. This achieves better handling to reduce operation at an assembling site. Further, the resin springs 178 do not to touch the female housing 110 when the wire cover 160 is at the partial locking position, and are in their unbiased state when they are not required. This prevents the deterioration of the resiliency.

The resin springs 178 cantilever from the front end edge of the side wall 165 of the wire cover 160 within the thickness range of the sidewall 165. Thus, the resilient restoring forces can be transmitted efficiently to the sidewall 165 to open the wire cover 160 quickly when the housings 110, 140 are not connected properly.

The resin springs 178 are within the thickness range of the sidewall 165. Thus, the wires W can be accommodated into the wire cover 160 while avoiding the interference with the resin springs 178, and the thickness of the sidewall 165 of the wire cover 160 can be suppressed for miniaturization.

Furthermore, the resin springs 178 prevent the wire cover 160 and the female housing 110 from shaking relative to each other when the wire cover 160 is at the full locking position.

A sixth embodiment of the invention is described with reference to FIGS. 50 to 53. The sixth embodiment differs from the third to fifth embodiments in that the wire cover 160 is locked to the female housing 110, and the connection of the housings 110, 140 is detected between the female housing 110 and the wire cover 160. The sixth embodiment has parts structurally common to the third to fifth embodiments. Similar structures are identified by the same reference numerals, but are not described.

In the sixth embodiment, a locking construction for the wire cover 160 is provided on the female housing 110. More specifically, two engageable sections 149 bulging out sideways from upper and lower ends of the rear end edge of one side surface of the female housing 110.

Figure 50:
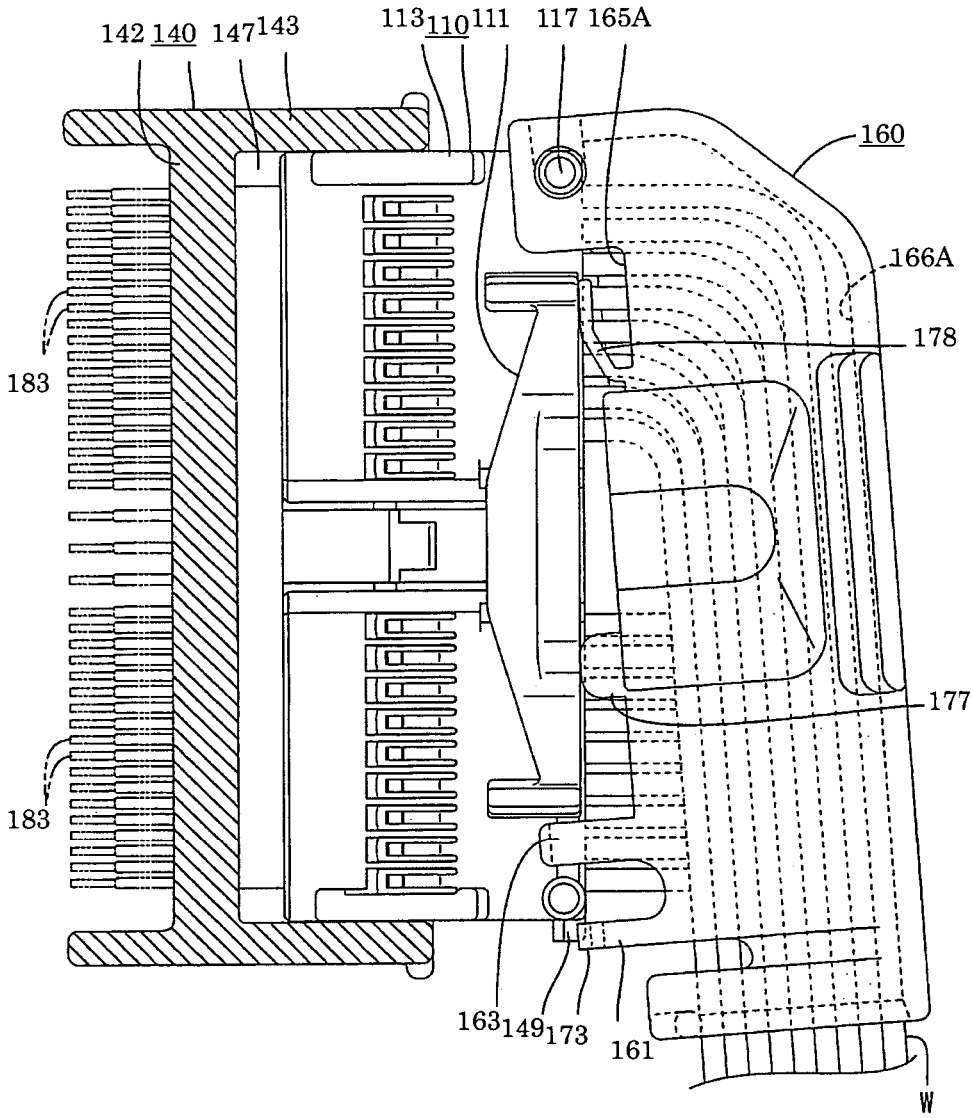
FIG. 50 is a horizontal section showing an intermediate state of the connection of two housings of a connector according to a seventh embodiment.
Figure 51:
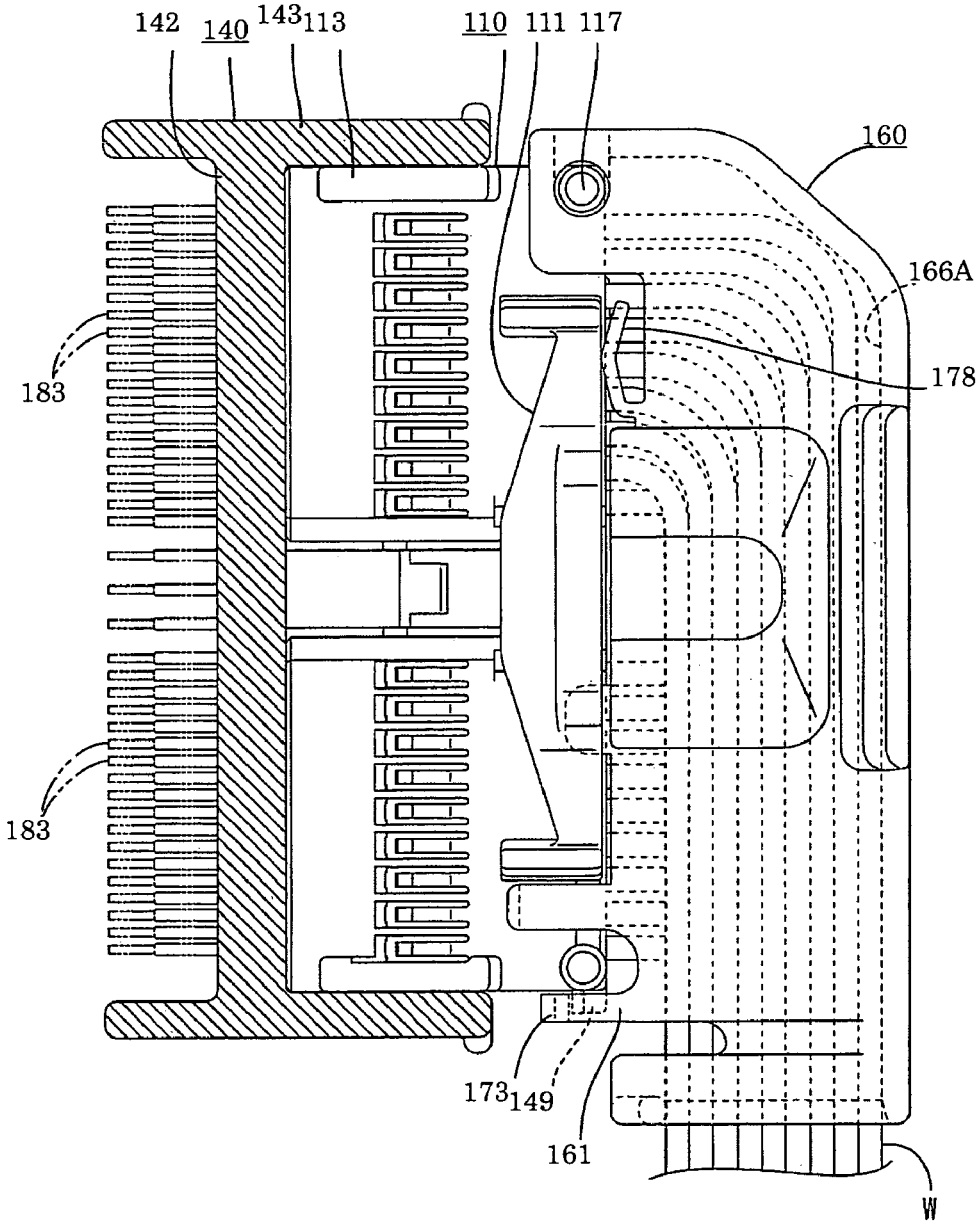
FIG. 51 is a horizontal section showing a state where the two housings are connected.

On the other hand, as shown in FIG. 50, a lock 161 projects forward at a position on the front end edge or edge portion of the wire cover 160 near the other end, and is shorter and narrower than and substantially parallel to the partial locks 163. The locking section 161 is provided with a locking protuberance 173 projecting inward from the projecting end thereof.

Projections 177 project forward at a position of the front end edges of the sidewalls 165 of the wire cover 160 slightly towards the other end from the middle. The projections 177 are wider than the partial lock 163 and shorter than the lock 161 and are insertable into the deformation space Q of the female housing 110 when the wire cover 160 reaches a full locking position. Further, a resin spring 178 is provided at a position of the front end edge 165A of the side wall 165 of the wire cover 160 near the one end, and is substantially identical to that of the fifth embodiment.

Figure 52:
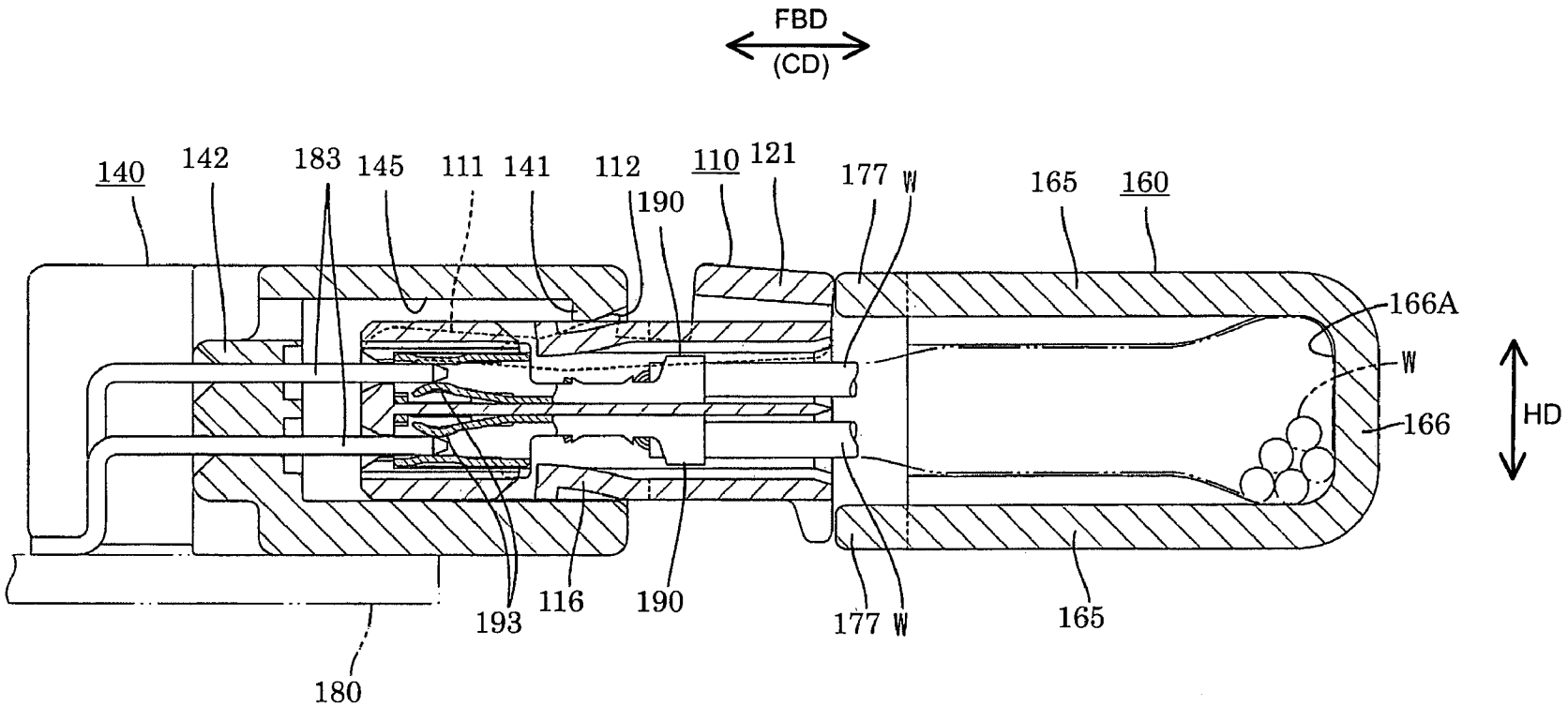
FIG. 52 is a side view in section showing the intermediate state of the connection of the two housings.

As shown in FIG. 50, the wire cover 160 is left at the partial locking position and the female housing 110 is connected with the male housing 140 in this state. While the two housings 110, 140 are being connected, the lock 112 of the lock arm 111 of the female housing 110 slides in contact with the engaging portion 141 of the male housing 140 to resiliently deform the lock arm 111 toward the deformation space Q as shown in FIG. 52. An attempt may be made to rotate the wire cover 160 toward the full locking position in this state. However, the projection 177 contacts the pressable portion 121 of the lock arm 111 to hinder further rotation. Therefore, the wire cover 160 cannot reach the full locking position. Further, the resin spring 178 contacts the pressable portion 121 before the projection 177 contacts the pressable portion 121 to accumulate biasing forces in returning direction of the wire cover 160. Thus, rotation is stopped when the projection 177 contacts the pressable portion 121, and the wire cover 160 is opened by the resilient force of the resin spring 178.

Figure 53:
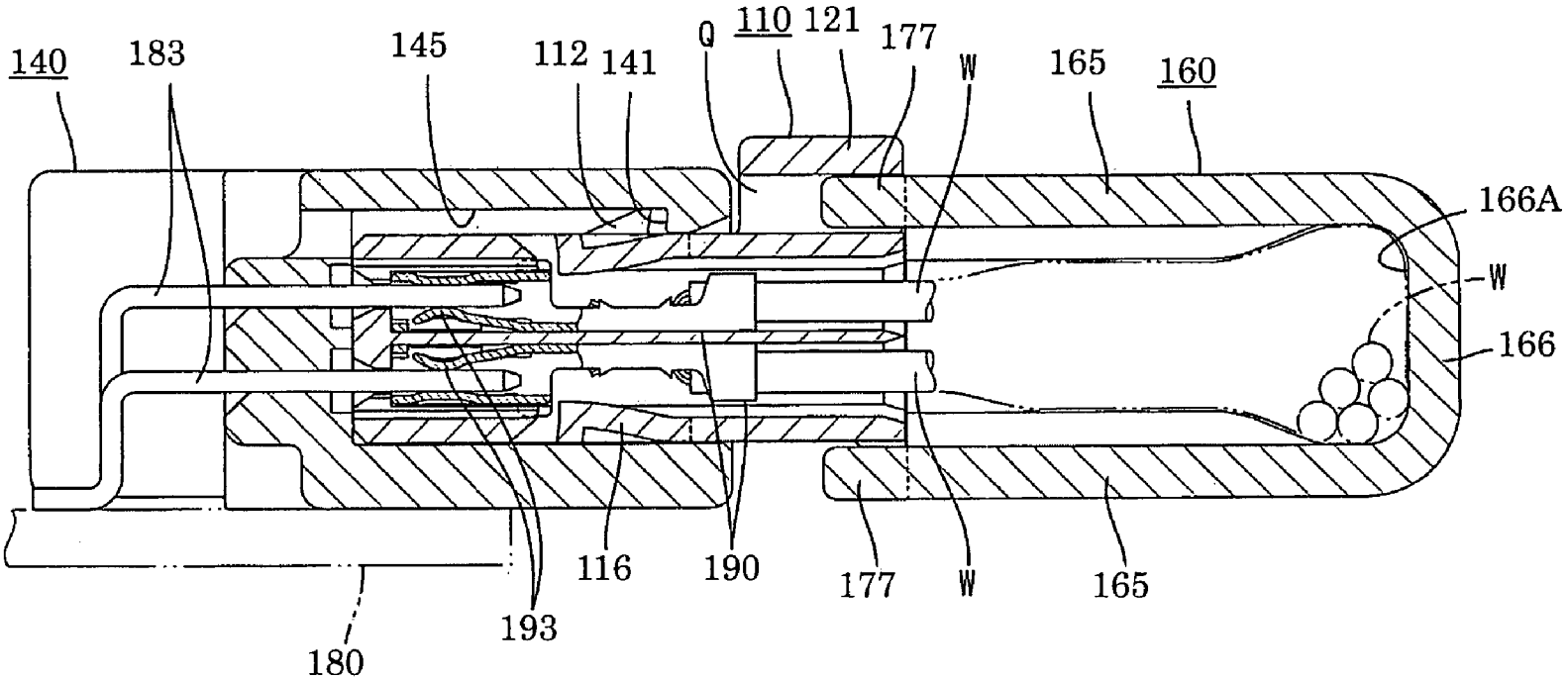
FIG. 53 is a side view in section showing the housings connected.

When the connection of the two housings 110, 140 progresses and the lock 112 of the lock arm 111 passes the engaging portion 141, the lock 112 is engaged with the rear surface of the engaging portion 141 to connect the two housings 110, 140 properly. The lock arm 111 is restored resiliently towards its initial posture to come out of the deformation space Q at the proper connection position as shown in FIG. 53. Thus, the projections 177 can enter the deformation space Q as the wire cover 160 is rotated toward the full locking position. Therefore, the wire cover 160 can reach the full locking position. The locks 161 engage the engageable sections 149 of the female housing 110 to lock the wire cover 160 into the female housing 110 and to close the rear end surface 110A of the female housing 110.

According to the sixth embodiment, the lock arm 111 is deformed into the deformation space Q until the two housings 110, 140 are connected properly, and prevents the projections 177 of the wire cover 160 from entering the deformation space Q. Thus, there is a clear indication that the housings 110, 140 are not properly connected. The resilient restoring force of the resin spring 178 pushes the wire cover 160 back to provide an even clearer visual confirmation that the projections 177 cannot enter the deformation space Q.

The lock arm 111 comes out of the deformation space Q when the two housings 110, 140 are connected properly. Thus, the projections 177 can be inserted into the deformation space Q, and the wire cover 160 can be locked into the female housing 110. In this way, proper connection of the two housings 110, 140 is judged easily. The connected state of the housings 110, 140 is detected by visually confirming the presence or absence of the projections 177 in the deformation space Q, i.e. the open or closed state of the wire cover 160.

The invention is not limited to the above described and illustrated embodiments, and the following embodiments also are embraced by the invention as defined by the claims. Various other changes can be made without departing from the scope of the invention as defined by the claims.

Although the male housing is fixed to the circuit board in the foregoing embodiments, it may be at ends of wires or on another electric/electronic device according to the invention. In such a case, the rear end surface of the male housing may serve as a wire draw-out surface and may be covered by the wire cover.

Although the locks and the fixing member are integral to each other in the first and second embodiments, they may be provided independently.

Parts of the locks of the first two embodiments may contact the male terminal fittings in the receptacle and this contact state may be canceled as the female housing is fit into the receptacle so that the locks are shorting terminals. Further, a detection probe may be inserted into the grooves from front using the grooves of the female housing to bring the leading end thereof into contact with the locks, thereby enabling an electrical connection test to be conducted.

Although the wire cover is rotatably mounted on the female housing in the foregoing embodiments, it may be mounted on the female housing substantially along the connecting direction from behind.

Although the wire cover is displaceable between the partial locking position and the full locking position in the foregoing embodiments, it may reach the full locking position without passing the partial locking position.

Although the deformation space is located below the lock arm in the foregoing embodiments, it may be located above or at a side of the lock arm.

The wire cover may be locked either to the female or male housings.

Although the springs 78 are made of resin in the foregoing embodiments, it may be made of any other material e.g. of metal being insert molded into the cover (e.g. to have higher spring forces).

What is claimed is:

1. A connector, comprising:

a first housing having a front end and a receptacle opening into the front end of the first housing formed from synthetic resin; and a fixing member formed from a metal material and mounted on an outer side surface of the receptacle of the first housing and being configured for mounting the first housing onto a device, a lock being formed unitarily with the fixing member and projecting through a wall of the first housing and into the receptacle; and a second housing being receivable in the receptacle for connecting the first and second housings, at least one receiving projection formed on an outer surface of the second housing and engageable with the lock, wherein the lock is substantially hidden behind the receiving projection when viewed from the front of the first housing at an initial stage of fitting the second housing into the receptacle, and the lock being engaged with the receiving projection and visible from the front of the first housing when the first and second housings are connected properly.

2. The connector of claim 1, wherein the first housing has at least one groove formed in an external surface thereof and a window projecting through the first housing and into the receptacle substantially adjacent the groove, the fixing member having a portion engaged in the groove.

3. The connector of claim 2, wherein the fixing member has at least one side plate for mounting into the groove and at least one fixing portion extending from the side plate for mounting on the device.

4. The connector of claim 3, wherein the lock projects unitarily from the side plate and into the receptacle.

5. The connector of claim 4, wherein the first housing has a bottom wall for mounting on the device and first and second side walls extending from the bottom wall, the at least one groove comprising first and second grooves formed respectively in the first and second side walls, the fixing member having first and second side plates mounted respectively in the first and second grooves and first and second locks projecting respectively from the first and second side plates into the receptacle.

6. The connector of claim 5, wherein the fixing member further includes a ceiling plate extending unitarily between the first and second side plates and disposed on a top surface of the housing substantially opposite the bottom surface thereof.

* * * * *